US010597857B2

(12) United States Patent
Nogoshi et al.

(10) Patent No.: US 10,597,857 B2
(45) Date of Patent: Mar. 24, 2020

(54) TOILET DEVICE AND TOILET SEAT DEVICE

(71) Applicant: TOTO LTD., Kitakyushu-shi, Fukuoka (JP)

(72) Inventors: Yusuke Nogoshi, Kitakyushu (JP); Satoshi Matsunaka, Kitakyushu (JP); Ryo Suzuki, Kitakyushu (JP); Yuki Moriizumi, Kitakyushu (JP); Hiroaki Amemori, Kitakyushu (JP); Kota Yamasaki, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 0 days.

(21) Appl. No.: 16/185,212

(22) Filed: Nov. 9, 2018

(65) Prior Publication Data

US 2019/0301150 A1 Oct. 3, 2019

(30) Foreign Application Priority Data

Mar. 27, 2018 (JP) ..... 2018-60378
Aug. 30, 2018 (JP) ..... 2018-161747

(51) Int. Cl.
*E03D 9/00* (2006.01)
*E03D 9/08* (2006.01)

(52) U.S. Cl.
CPC ..... *E03D 9/002* (2013.01); *E03D 9/08* (2013.01)

(58) Field of Classification Search
CPC ..... E03D 9/002; E03D 9/005
USPC ..... 4/420
See application file for complete search history.

(56) References Cited

U.S. PATENT DOCUMENTS 7,603,726 B2 * 10/2009 Sawalski ..... B65D 83/20 4/223
2009/0217445 A1 9/2009 Nguyen
2011/0030133 A1 * 2/2011 Morotomi ..... E03D 9/08 4/443

(Continued)

FOREIGN PATENT DOCUMENTS

EP 2 628 866 A1 8/2013
EP 2 657 415 A1 10/2013

(Continued)

OTHER PUBLICATIONS

English translation for Japanese Publication No. 2014-163161A published on Sep. 8, 2014 in the name of TOTO LTD.

*Primary Examiner* — Huyen D Le
(74) *Attorney, Agent, or Firm* — Pearne & Gordon LLP

(57) ABSTRACT

According to one embodiment, a toilet device includes a flush toilet, a toilet seat, a spray device, a detecting sensor, and a controller. The flush toilet includes a bowl. The bowl includes a flush region and a non-flush region. The controller executes a pre-mist mode and an after-mist mode. The pre-mist mode includes automatically controlling the spray device, spraying the mist onto the flush region and the non-flush region, and forming a water droplet or a water film by causing the mist to accumulate in the flush region and the non-flush region. The after-mist mode includes automatically controlling the spray device to rinse away the water droplet or the water film formed in the non-flush region in the pre-mist mode by increasing a volume of the water droplet or the water film.

3 Claims, 34 Drawing Sheets

(56) References Cited

U.S. PATENT DOCUMENTS

| | | | | |
|---|---|---|---|---|
| 2012/0173274 | A1* | 7/2012 | Rensvold | G16H 40/20 705/2 |
| 2014/0007337 | A1* | 1/2014 | Zheng | A47K 11/02 4/317 |
| 2014/0059757 | A1 | 3/2014 | Hamakita | |
| 2017/0058500 | A1* | 3/2017 | Garrels | A47K 17/00 |

FOREIGN PATENT DOCUMENTS

| | | | |
|---|---|---|---|
| JP | 2008-057163 | A | 3/2008 |
| JP | 2014-159732 | A | 9/2014 |
| JP | 2016-037702 | A | 3/2016 |

* cited by examiner

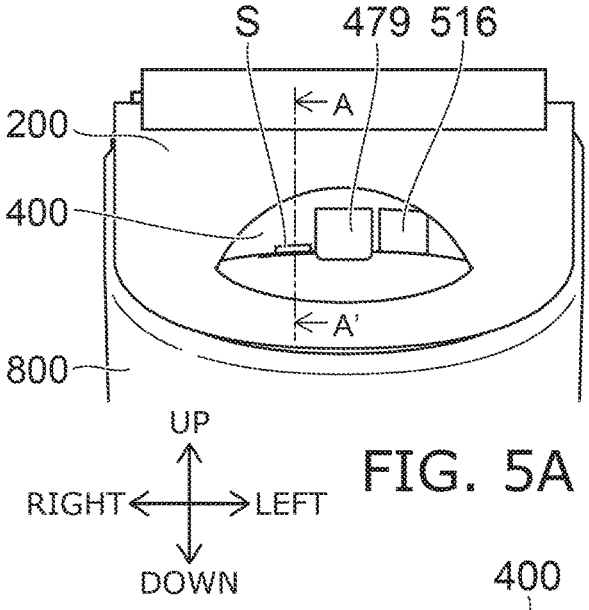
FIG. 5A
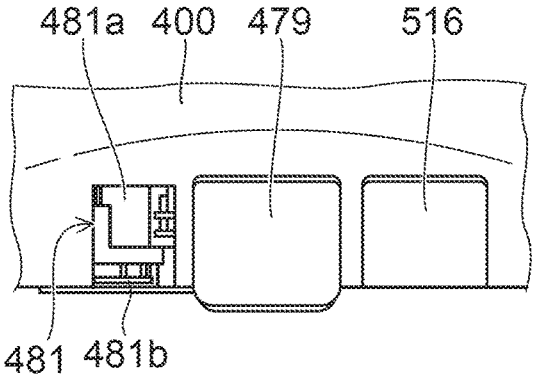
FIG. 5B
FIG. 5C
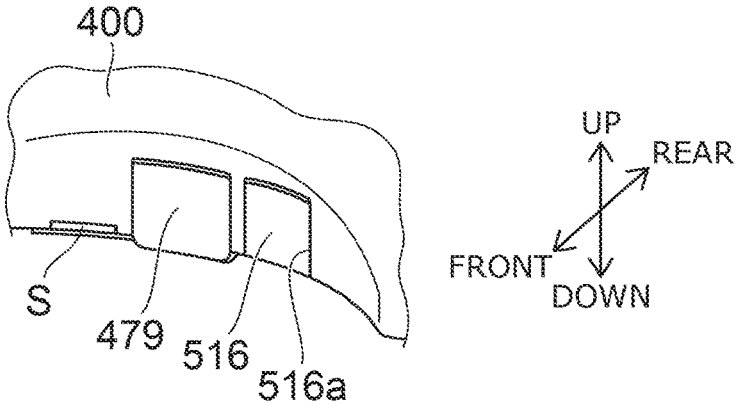
FIG. 5D
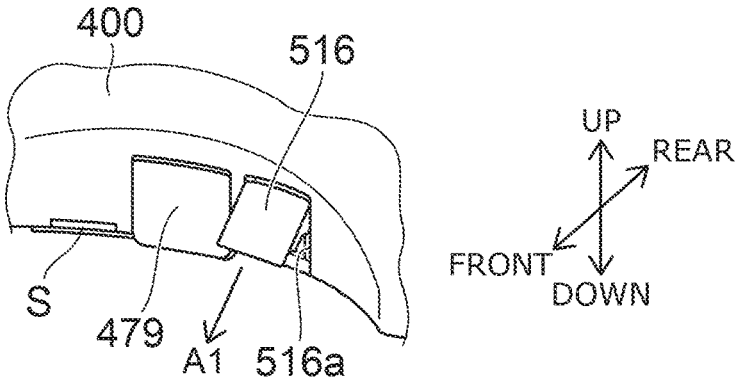
FIG. 5E
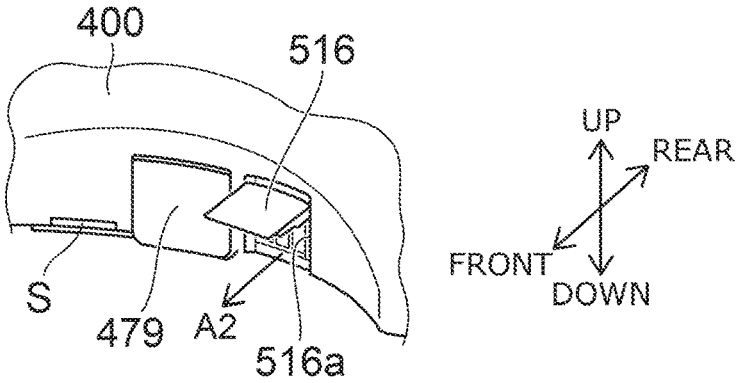

| | PRE-MIST (AUTOMATIC) | AFTER-MIST (AUTOMATIC) | MANUAL MIST (MANUAL) |
|---|---|---|---|
| WETTED SECTION P1 (TOILET SEAT FRONT SURFACE) | — | EXTREMELY SMALL | SMALL |
| WETTED SECTION P2 (TOILET SEAT BACK SURFACE/ RIM UPPER SURFACE) | — | SMALL | SMALL |
| WETTED SECTION P3 (NON-FLUSH REGION) | MEDIUM | LARGE | LARGE |
| WETTED SECTION P4 (FLUSH REGION) | MEDIUM | LARGE | LARGE |

PRE-MIST MODE

AFTER-MIST MODE

FIRST PROCESS OF PRE-MIST MODE

SECOND PROCESS OF PRE-MIST MODE

TOILET DEVICE AND TOILET SEAT DEVICE

CROSS-REFERENCE TO RELATED APPLICATIONS

This application is based upon and claims the benefit of priority from Japanese Patent Application No. 2018-060378, filed on Mar. 27, 2018 and No. 2018-161747, filed on Aug. 30, 2018; the entire contents of which are incorporated herein by reference.

FIELD

Embodiments described herein relate generally to toilet device and a toilet seat device.

BACKGROUND

In a toilet device according to Japanese Patent No. 5029930, a mist of hypochlorous acid water or service water is automatically sprayed into the bowl of a flush toilet before use of the toilet device (e.g., when a human body detection sensor detects a human body). Thereby, a water film is formed on the bowl; and the clinging and/or the adhesion of excrement on the bowl surface can be suppressed.

BRIEF DESCRIPTION OF THE DRAWINGS

FIG. 5A to FIG. 5E are plan views and perspective views illustrating the toilet device according to the embodiment;

DETAILED DESCRIPTION

Figure 1:
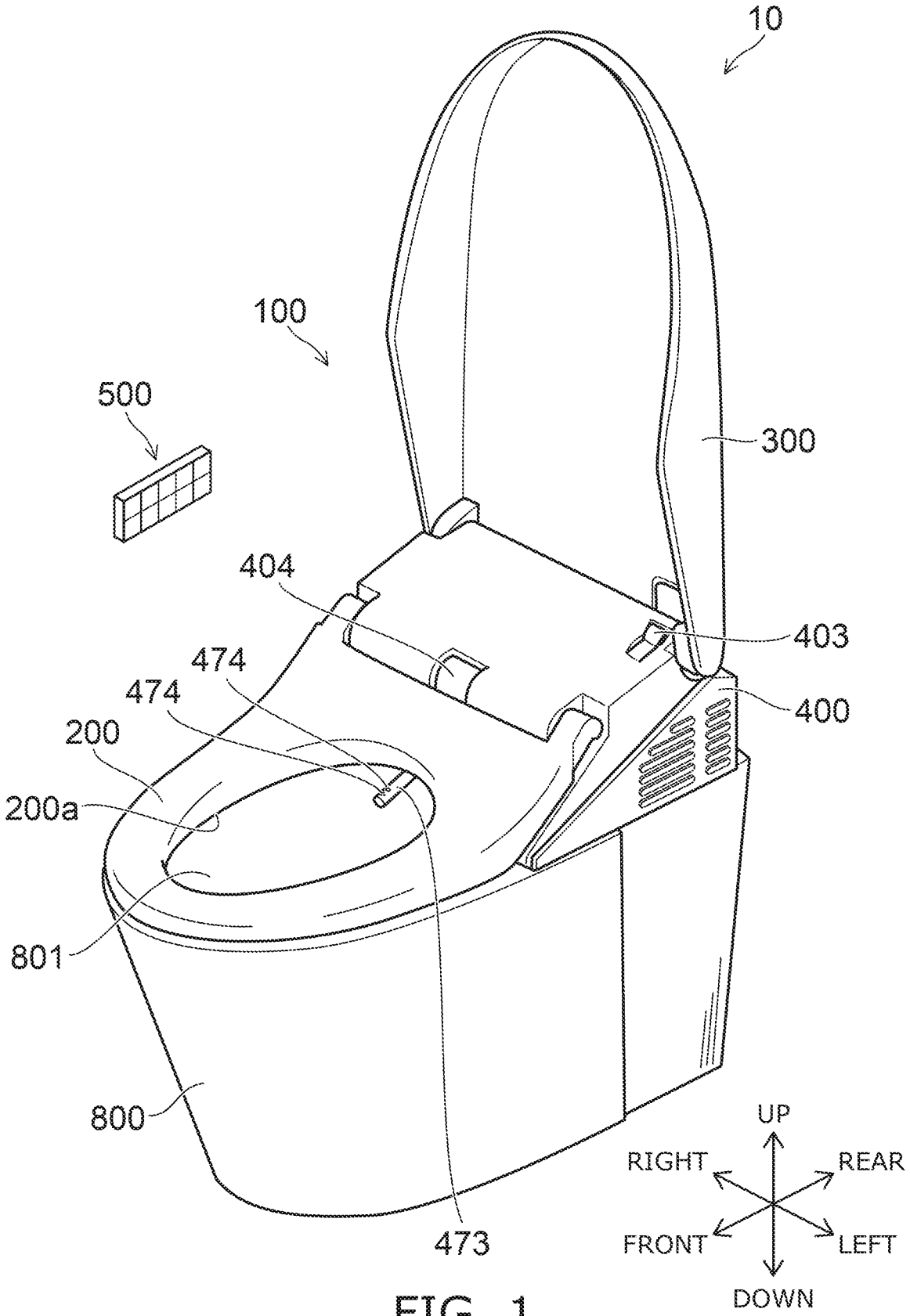
FIG. 1 is a perspective view illustrating a toilet device according to an embodiment.

According to a first aspect of the present invention, there is provided a toilet device including a flush toilet including a bowl, a rim upper surface, and a water discharge port, the bowl receiving excrement, the rim upper surface being positioned on the bowl, the water discharge port discharging flushing water into the bowl to discharge the excrement from the bowl, the bowl including a flush region and a non-flush region, the flush region being where the flushing water passes, the non-flush region being positioned higher than the flush region and lower than the rim upper surface; a toilet seat mounted on the flush toilet, the toilet seat being where a user is seated; a spray device spraying a mist; a detecting sensor detecting the user, the detecting sensor having a detecting state and a non-detecting state, the detecting state being a state in which the detecting sensor detects the user, and the non-detecting state being a state in which the detecting sensor does not detect the user; and a controller controlling the spray device based on detection information of the detecting sensor, the controller executing a pre-mist mode when the detecting sensor changes from the non-detecting state to the detecting state, the pre-mist mode including automatically controlling the spray device, spraying the mist onto the flush region and the non-flush region, and forming a water droplet or a water film by causing the mist to accumulate in the flush region and the non-flush region, and an after-mist mode when the detecting sensor changes from the detecting state to the non-detecting state, the after-mist mode including automatically controlling the spray device to rinse away the water droplet or the water film formed in the non-flush region in the pre-mist mode by increasing a volume of the water droplet or the water film.

According to the toilet device, the mist that is sprayed from the spray device in the pre-mist mode forms a water droplet or a water film on the flush region and the non-flush region. Thereby, the clinging and/or the adhesion of excrement can be suppressed over a wide area inside the bowl including the non-flush region. Also, the wetting mist accumulates in the flush region and the non-flush region and, for example, the water droplet or the water film is not rinsed away until the after-mist mode is executed. Thereby, the clinging and/or the adhesion of excrement can be suppressed further compared to the case where only the interior of the bowl is wet.

Also, in the after-mist mode, the mist of the sterilizing water sprayed from the spray device wets the non-flush region. Thereby, the occurrence of bacteria and/or dirt due to excrement not rinsed away by the flushing water can be suppressed.

In the case where the water droplet or the water film formed by the pre-mist mode remains adhered to the non-flush region, scale may precipitate due to the water droplet or the water film evaporating; and a water stain may occur in the non-flush region. Conversely, the water droplet or the water film that remains in the non-flush region can be suppressed by the water droplet or the water film formed in the non-flush region being rinsed away by the after-mist mode. Thereby, the occurrence of the water stain can be suppressed. Thus, a visible water stain that occurs in a short interval in the non-flush region can be suppressed while suppressing the occurrence of bacteria and/or dirt in a wide area of the flush toilet including the non-flush region.

According to a second aspect of the present invention, there is provided a toilet seat device mounted on a flush toilet; the flush toilet including a bowl, a rim upper surface, and a water discharge port; the bowl receives excrement; the rim upper surface is positioned on the bowl; the water discharge port discharges flushing water into the bowl to discharge the excrement from the bowl; the bowl includes a flush region where the flushing water passes, and a non-flush region positioned higher than the flush region and lower than the rim upper surface; the toilet seat device includes a toilet seat, a spray device, a detecting sensor, and a controller; the toilet seat is where a user is seated; the spray device sprays a mist; the detecting sensor detects the user, the detecting sensor having a detecting state and a non-detecting state, the detecting state being a state in which the detecting sensor detects the user, and the non-detecting state being a state in which the detecting sensor does not detect the user; the controller controls the spray device based on detection information of the detecting sensor; the controller executes a pre-mist mode when the detecting sensor changes from the non-detecting state to the detecting state; the pre-mist mode includes automatically controlling the spray device, spraying the mist onto the flush region and the non-flush region, and forming a water droplet or a water film by causing the mist to accumulate in the flush region and the non-flush region; the controller executes an after-mist mode when the detecting sensor changes from the detecting state to the non-detecting state; and the after-mist mode includes automatically controlling the spray device to rinse away the water droplet or the water film formed in the non-flush region in the pre-mist mode by increasing a volume of the water droplet or the water film.

According to the toilet seat device, the mist that is sprayed from the spray device in the pre-mist mode forms a water droplet or a water film in the flush region and the non-flush region. Thereby, the clinging and/or the adhesion of excrement can be suppressed over a wide area inside the bowl including the non-flush region. Also, the wetting mist accumulates in the flush region and the non-flush region and, for example, the water droplet or the water film is not rinsed away until the after-mist mode is executed. Thereby, the clinging and/or the adhesion of excrement can be suppressed further compared to the case where only the interior of the bowl is wet.

Also, in the after-mist mode, the mist of the sterilizing water sprayed from the spray device wets the non-flush region. Thereby, the occurrence of bacteria and/or dirt due to excrement not rinsed away by the flushing water can be suppressed.

In the case where the water droplet or the water film that is formed by the pre-mist mode remains adhered to the non-flush region, scale may precipitate due to the water droplet or the water film evaporating; and a water stain may occur in the non-flush region. Conversely, the water droplet or the water film that remains in the non-flush region can be suppressed by the water droplet or the water film formed in the non-flush region being rinsed away by the after-mist mode. Thereby, the occurrence of the water stain can be suppressed. Thus, the visible water stain that occurs in a short interval in the non-flush region can be suppressed while suppressing the occurrence of bacteria and/or dirt in a wide area of the flush toilet including the non-flush region.

According to a third aspect of the present invention, there is provided a toilet device including a flush toilet, a toilet seat, a spray device, a detecting sensor, and a controller; the flush toilet includes a bowl, a rim upper surface, and a water discharge port; the bowl receives excrement; the rim upper surface is positioned on the bowl; the water discharge port discharges flushing water into the bowl to discharge the excrement from the bowl; the bowl includes a flush region where the flushing water passes, and a non-flush region positioned higher than the flush region and lower than the rim upper surface; the toilet seat is mounted on the flush toilet and is where a user is seated; the spray device sprays a mist; the detecting sensor detects the user, the detecting sensor having a detecting state and a non-detecting state, the detecting state being a state in which the detecting sensor detects the user, and the non-detecting state being a state in which the detecting sensor does not detect the user; the controller controls the spray device based on detection information of the detecting sensor; the controller executes a pre-mist mode by automatically controlling the spray device to spray the mist when the detecting sensor changes from the non-detecting state to the detecting state; the pre-mist mode includes a first process and a second process; the first process includes forming a water droplet or a water film by causing the mist to wet the non-flush region; and the second process includes rinsing away the water droplet or the water film formed in the non-flush region in the first process by increasing a volume of the water droplet or the water film.

According to the toilet device, the flush region and the non-flush region can become wet due to the pre-mist mode before the user uses the toilet device. Thereby, the clinging and/or the adhesion of excrement can be suppressed the over a wide area inside the bowl including the non-flush region.

In the case where the water droplet or the water film that is formed by the pre-mist mode remains adhered in the non-flush region, scale may precipitate due to the water droplet or the water film evaporating; and a water stain may occur in the non-flush region. Conversely, the water droplet or the water film that remains in the non-flush region can be suppressed by the water droplet or the water film formed in the non-flush region being rinsed away by the second process. Thereby, the occurrence of the water stain can be suppressed. Thus, the visible water stain that occurs in a short interval in the non-flush region can be suppressed while suppressing the occurrence of bacteria and/or dirt in a wide area of the flush toilet including the non-flush region.

Also, in the pre-mist mode, because the particle size and/or the flow rate of the mist are large if the mist is sprayed so that the wetting mist soon flows off, there is an undesirable risk that the mist may splatter inside the bowl and scatter outside the flush toilet. Conversely, in the invention, the water droplet or the water film is caused to flow down by increasing the volume of the water droplet or the water film by the second process after forming the water droplet or the water film by the first process. Thereby, the scattering of the mist outside the flush toilet can be suppressed.

Embodiments of the invention will now be described in reference to the drawings. Similar components in the drawings are marked with the same reference numerals; and a detailed description is omitted as appropriate.

FIG. 1 is a perspective view illustrating a toilet device according to an embodiment.

The toilet device 10 illustrated in FIG. 1 includes a western-style sit-down toilet (called simply the "flush toilet" for convenience of description hereinbelow) 800 and a toilet seat device 100. The flush toilet 800 includes a concave bowl 801 receiving excrement. The toilet seat device 100 is mounted on the flush toilet 800.

The toilet seat device 100 includes a casing 400 (a main body portion), a toilet seat 200 where a user is seated, and a toilet lid 300. The toilet seat 200 and the toilet lid 300 each are pivotally supported openably and closeably with respect to the casing 400. The state of FIG. 1 is a state in which the toilet seat 200 is closed (the lowered state) and is a state in which the toilet lid 300 is open (the raised state). In the closed state, the toilet lid 300 covers the seat surface of the toilet seat 200 from above.

A body wash function part that realizes the washing of a human private part (a "bottom" or the like) of the user sitting on the toilet seat 200, etc., are built into the interior of the casing 400. Also, for example, a seat contact detection sensor 404 that detects the user sitting on the toilet seat 200 is provided in the casing 400. In the case where the seat contact detection sensor 404 detects the user sitting on the toilet seat 200, a washing nozzle (called simply the "nozzle" for convenience of description hereinbelow) 473 can be caused to advance into the bowl 801 of the flush toilet 800 when the user operates a manual operation part 500 such as, for example, a remote control, etc. A state in which the nozzle 473 is advanced into the bowl 801 is illustrated in the toilet seat device 100 illustrated in FIG. 1.

One or multiple water discharge ports 474 are provided in the tip part of the nozzle 473. The nozzle 473 can wash the "bottom" or the like of the user sitting on the toilet seat 200 by squirting water from the water discharge ports 474 provided in the tip part of the nozzle 473.

In this specification, "up," "down," "front," "rear," "left," and "right" each are directions when viewed by the user sitting on the toilet seat 200 with the user's back facing the open toilet lid 300.

Figure 2:
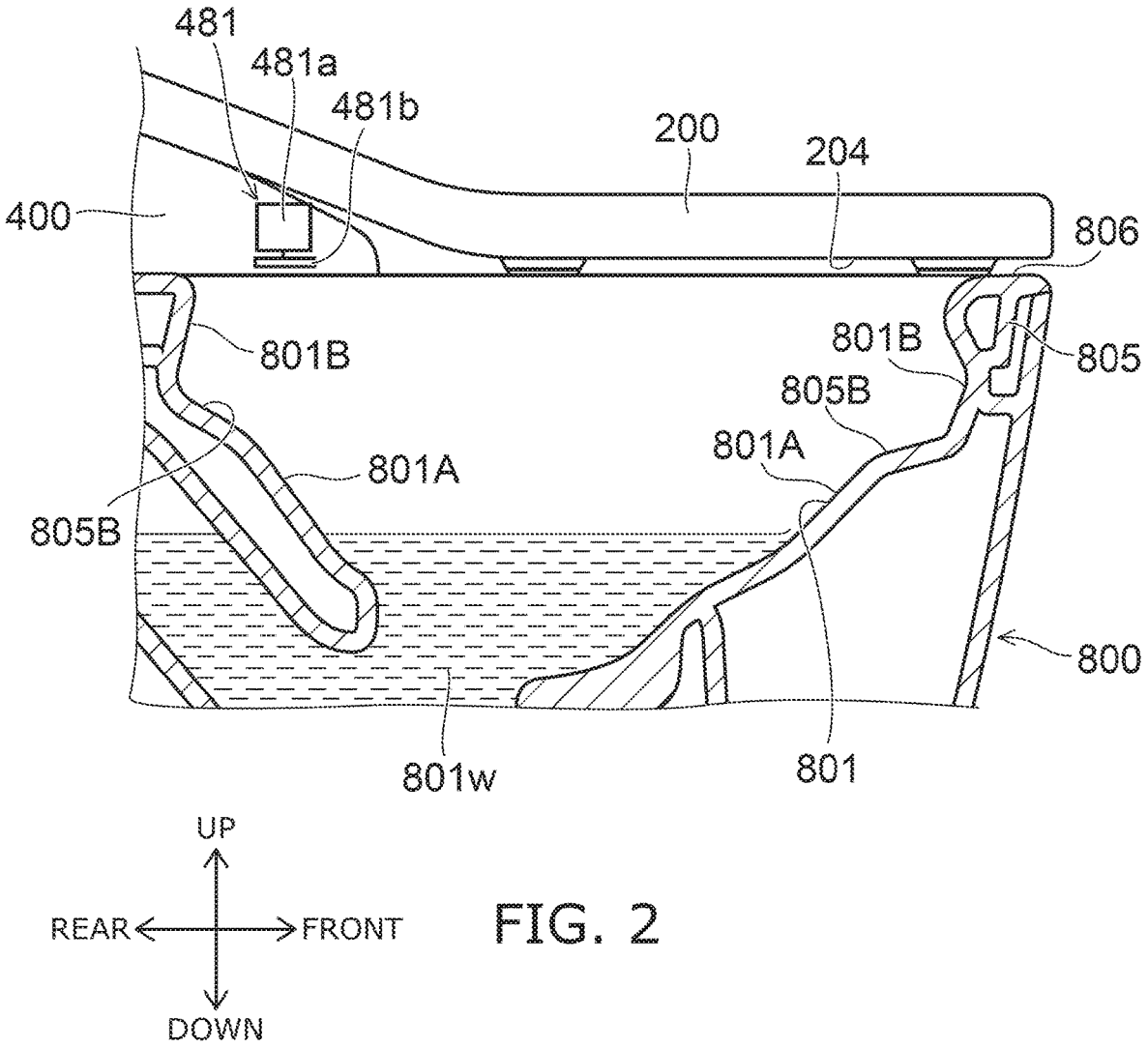
FIG. 2 is a cross-sectional view illustrating a part of the toilet device according to the embodiment.

FIG. 2 is a cross-sectional view illustrating a part of the toilet device according to the embodiment.

As shown in FIG. 2, the upper part of the bowl 801 is a rim part 805. The rim part 805 is a ring-like part of which the upper edge part of the flush toilet 800 is formed. Accumulated water 801*w* accumulates inside the bowl 801.

The flush toilet 800 also has a rim upper surface 806 positioned on the bowl 801. The rim upper surface 806 is the upper surface of the rim part 805 and opposes, for example, a back surface 204 of the closed toilet seat 200.

Figure 3A:
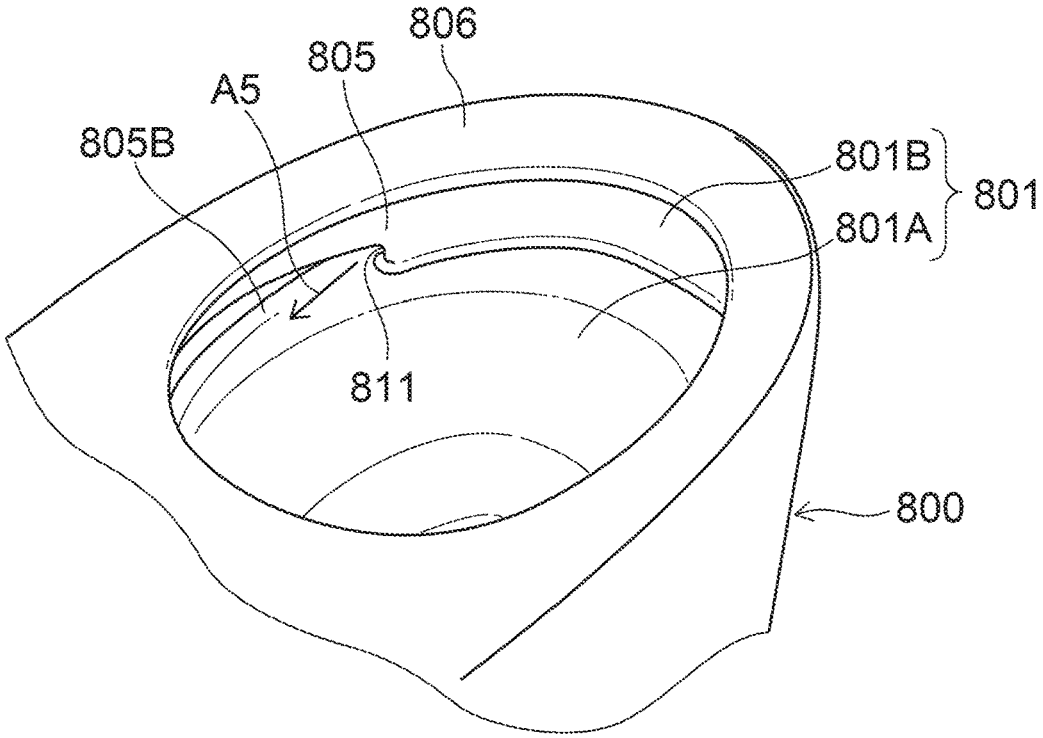
FIG. 3A and FIG. 3B are schematic views illustrating a part of the toilet device according to the embodiment.
Figure 3B:
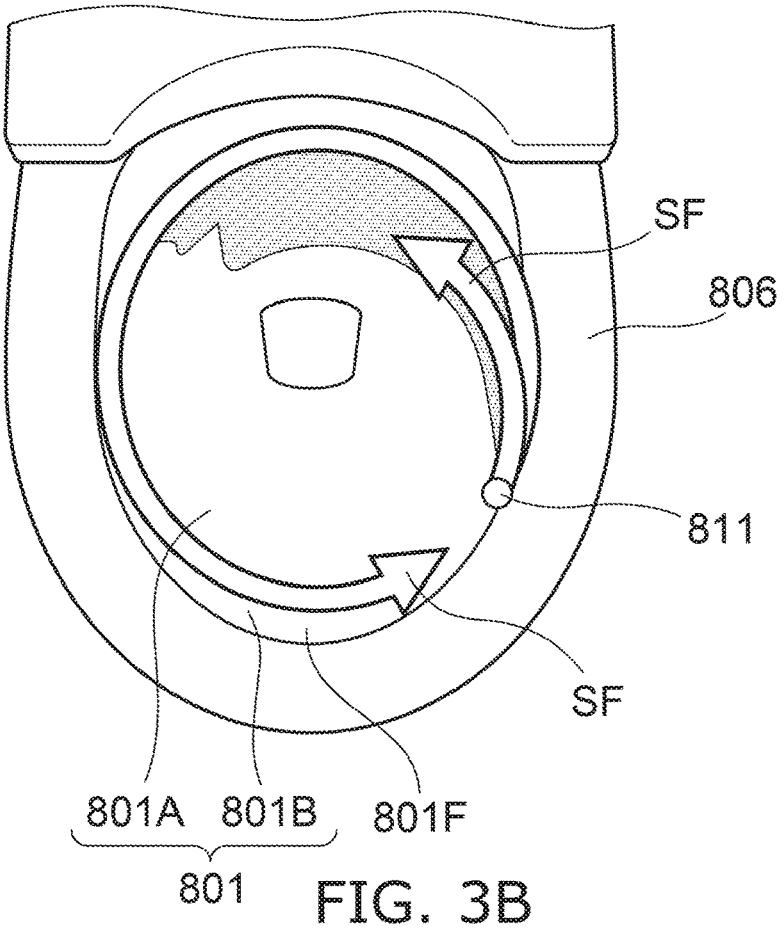

FIG. 3A and FIG. 3B are schematic views illustrating a part of the toilet device according to the embodiment.

FIG. 3A is a perspective view illustrating the flush toilet 800; and FIG. 3B is a plan view illustrating the flush toilet 800. The flush toilet 800 has a water discharge port 811 provided in the rim part 805. The water discharge port 811 discharges flushing water into the bowl 801 to discharge excrement from the bowl 801.

A toilet flush of supplying the flushing water from the water discharge port 811 into the bowl 801 is executed when, for example, the user performs the operation of the toilet flush by using a switch provided in the remote control, etc., or when the user stands up from the toilet seat 200. Thereby, the excrement that is inside the bowl 801 is discharged; and the surface of the bowl 801 is washed.

The water discharge port 811 dispenses the flushing water rearward as in arrow A5 shown in FIG. 3A. The flushing water that is dispensed from the water discharge port 811 flows over a shelf-shaped part 805B provided along the rim part 805 and forms a swirling flow SF swirling inside the bowl 801 as shown in FIG. 3B.

The bowl 801 includes a flush region 801A where the flushing water passes, and a non-flush region 801B positioned higher than the flush region 801A and lower than the rim upper surface 806. The flush region 801A is a region of the inner surface of the bowl 801 that becomes wet due to the flushing water passing. The non-flush region 801B is a region of the inner surface of the bowl 801 where the flushing water does not pass. As in FIG. 3B, when viewed from above, the non-flush region 801B has substantially a ring configuration along the rim part 805; and the flush region 801A is positioned on the inner side of the non-flush region 801B.

For example, as shown in FIG. 2, the flush region 801A is the region under the shelf-shaped part 805B; and the non-flush region 801B includes the vertical surface (the rim part inner wall surface) of the rim part 805 positioned on the shelf-shaped part 805B.

In the embodiment, the flushing water may not have the embodiment that forms the swirling flow SF. For example, the water discharge port 811 may discharge the flushing water downward from the rim part 805. In such a case as well, the bowl 801 includes a flush region where the flushing water passes, and a non-flush region positioned between the rim upper surface and the flush region where the flushing water does not pass.

Figure 4:
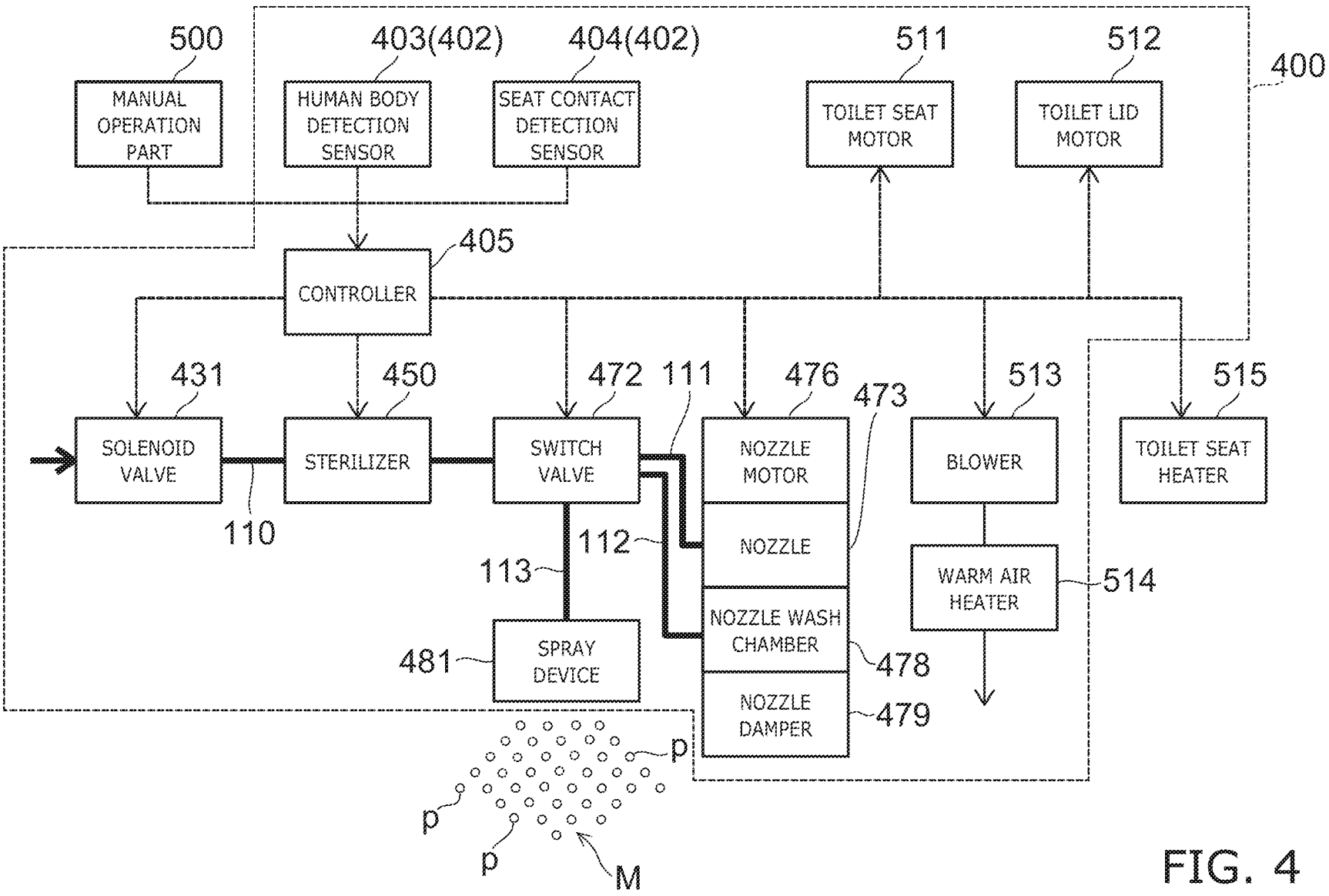
FIG. 4 is a block diagram illustrating relevant components of the toilet seat device according to the embodiment.

FIG. 4 is a block diagram illustrating relevant components of the toilet seat device according to the embodiment.

FIG. 4 illustrates the relevant components of both the water channel system and the electrical system.

Figure 35:
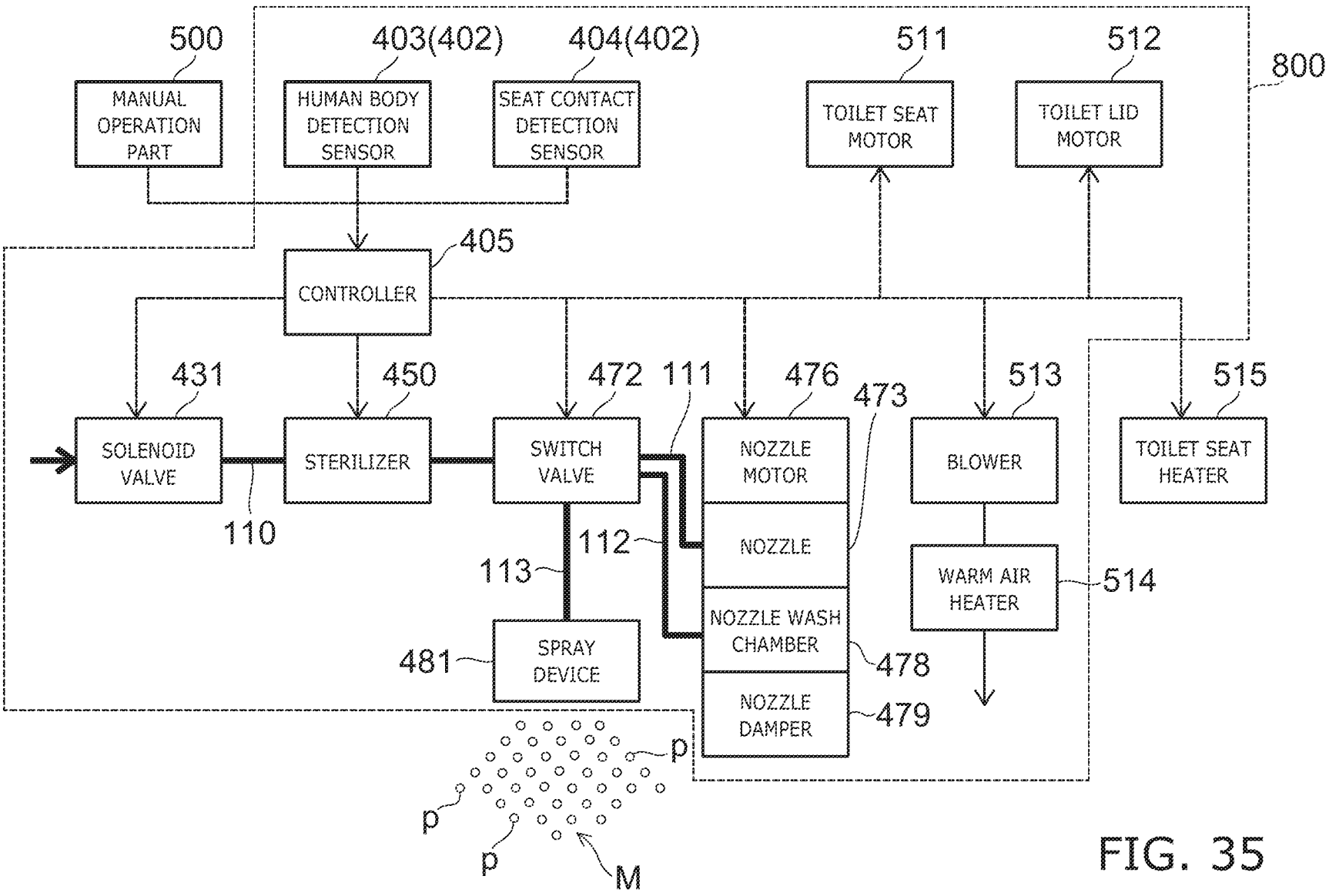
FIG. 35 is a block diagram illustrating relevant components of a toilet device according to a modification of the embodiment.

The toilet seat device 100 includes a solenoid valve 431, a sterilizer 450, a switch valve 472, a spray device 481, a nozzle motor 476, the nozzle 473, a nozzle wash chamber 478, flow channels 110 to 113, etc. For example, these components are disposed inside the casing 400. As shown in FIG. 35, these components may be included in the interior of the flush toilet 800.

The flow channel 110 is a flow channel for guiding water supplied from a not-illustrated water supply source such as a service water line, a water storage tank, etc., to the spray device 481, the nozzle 473, etc. The solenoid valve 431 is provided on the upstream side of the flow channel 110. The solenoid valve 431 is an openable and closable solenoid valve and controls the supply of the water based on a command from a controller 405 provided in the interior of the casing 400.

The sterilizer 450 that generates sterilizing water is provided downstream of the solenoid valve 431 on the flow channel 110. For example, the sterilizer 450 generates sterilizing water including hypochlorous acid, etc. For example, an electrolytic cell unit is an example of the sterilizer 450. The electrolytic cell unit electrolyzes service water flowing through a space (a flow channel) between an anode plate (not illustrated) and a cathode plate (not illustrated) by controlling the flow of current from the controller 405. The sterilizing water is not limited to sterilizing water including hypochlorous acid. For example, the sterilizing water may be a solution including metal ions such as silver ions, copper ions, etc., a solution including electrolytic chlorine, ozone, etc., acidic water, alkaline water, etc. The sterilizer 450 is not limited to an electrolytic cell and may have any configuration that can generate sterilizing water.

The switch valve 472 is provided downstream of the sterilizer 450 on the flow channel 110. The nozzle 473, the nozzle wash chamber 478, and the spray device 481 are provided downstream of the switch valve 472. Due to the switch valve 472, the flow channel 110 branches into the flow channel 111 guiding the water to the nozzle 473, the flow channel 112 guiding the water to the nozzle wash chamber 478, and the flow channel 113 guiding the water to the spray device 481. The switch valve 472 controls the opening and closing of each of the flow channel 111, the flow channel 112, and the flow channel 113 based on a command from the controller 405. That is, the switch valve 472 controls the supply of the water to the nozzle 473, the nozzle wash chamber 478, and the spray device 481. Also, the switch valve 472 switches the flow rate of the water supplied downstream of the switch valve 472.

The nozzle 473 receives a drive force from the nozzle motor 476 and advances into and retracts from the bowl 801 of the flush toilet 800. That is, the nozzle motor 476 causes the nozzle 473 to advance and retract based on a command from the controller 405. The nozzle 473 is stored inside the casing 400 when not in use. The nozzle 473 dispenses water from the water discharge ports 474 and washes the human private part in a state of being advanced frontward from the casing 400.

The nozzle wash chamber 478 washes the outer perimeter surface (the central body) of the nozzle 473 by squirting sterilizing water or service water from water discharge ports provided in the interior of the nozzle wash chamber 478.

The spray device 481 changes the service water or the sterilizing water generated by the sterilizer 450 into a mist-like form. The spray device 481 sprays a mist M (a mist of the sterilizing water or a mist of the service water) onto the bowl 801, the rim part 805, the toilet seat 200, etc. In other words, the spray device 481 causes the mist of the sterilizing water or the mist of the service water to wet the bowl 801, the rim part 805, the toilet seat 200, etc. In this specification, "wetting" refers to the water (the sterilizing water or the service water) adhering to the surface of an object. In particular, the case of "directly wetting" means that the water (fine particles p of the sterilizing water or the service water) floating in air reaches the surface of the object.

A toilet seat motor 511 (a rotating device), a toilet lid motor 512 (a rotating device), a blower 513, and a warm air heater 514 also are provided in the interior of the casing 400.

The toilet seat motor 511 opens and closes the toilet seat 200 by causing the toilet seat 200 to rotate by electric power based on a command from the controller 405. The toilet lid motor 512 opens and closes the toilet lid 300 by causing the toilet lid 300 to rotate by electric power based on a command from the controller 405.

The blower 513 is, for example, a fan provided in the interior of the casing 400. The blower 513 operates based on a command from the controller 405. For example, vanes rotate due to the rotation of a motor of the blower 513. Thereby, the blower 513 can blow air toward the interior of the flush toilet 800 (e.g., the interior of the bowl 801). Also, the blower 513 may blow air toward a private part of the user sitting on the toilet seat 200. The warm air heater 514 warms the air blown outside the casing 400 by the blower 513. Thereby, the warm air can be blown toward the private part of the user; and the private part can be dried.

For example, a toilet seat heater 515 (a dryer) is provided in the interior of the toilet seat 200. The toilet seat heater 515 includes, for example, a metal member having a ring configuration provided along the periphery of an opening 200*a* formed at the center of the toilet seat 200 (FIG. 1). The toilet seat heater 515 warms the toilet seat 200 by providing a current to the toilet seat heater 515 based on a command from the controller 405. For example, a tubing heater, a sheathed heater, a halogen heater, a carbon heater, etc., may be used as the toilet seat heater 515. The metal member includes, for example, aluminum, copper, etc. Various configurations such as a sheet configuration, a wire configuration, a mesh configuration, etc., can be employed as the configuration of the metal member.

The controller 405 includes a circuit that supplies electrical power from a not-illustrated power supply circuit. For example, the controller 405 includes an integrated circuit such as a microcomputer, etc. The controller 405 controls the solenoid valve 431, the sterilizer 450, the switch valve 472, the nozzle motor 476, the spray device 481, the blower 513, the warm air heater 514, the toilet seat heater 515, the toilet seat motor 511, and the toilet lid motor 512 based on detection information of a detecting sensor 402 (e.g., a human body detection sensor 403 or the seat contact detection sensor 404) detecting the user or based on operation information of the manual operation part 500.

The manual operation part 500 is, for example, an operation part for the user to spray the sterilizing water at any timing. For example, the manual operation part 500 is a remote control including a switch, a button, etc.; and when the user operates the manual operation part 500, operation information (a signal) that instructs the spraying of the sterilizing water is transmitted to the controller 405. Based on the operation information, the controller 405 controls the sterilizer 450 and/or the spray device 481. Thereby, the user can perform the spraying of the sterilizing water by operating the manual operation part 500.

The manual operation part 500 also may include a switch, a button, etc., not only for spraying the sterilizing water but also for the user to operate the functions of the toilet seat device 100. When operations that correspond to the functions are performed, the operation information is transmitted to the controller 405; and the controller 405 controls the operation of each part of the toilet seat device 100 based on the operation information.

The seat contact detection sensor 404 can detect the seated state (the existence or absence of seat contact) of the user on the toilet seat 200. The seat contact detection sensor 404 detects the user being seated and rising from the seat. The seat contact detection sensor 404 may include a microwave sensor, a distance sensor (an infrared-transmitting sensor), an ultrasonic sensor, a tactile switch, a capacitance switch (a touch sensor), or a strain sensor. In the example, a distance sensor that is provided in the casing 400 is included in the seat contact detection sensor 404.

In the case where a contact sensor such as a tactile switch, an electrostatic sensor, a strain sensor, or the like is used, such a contact sensor is provided in the toilet seat 200. When the user sits on the toilet seat 200, the tactile switch is pressed by the body weight of the user. Or, the user contacts the electrostatic sensor. Or, pressure is applied to the strain sensor by the body weight of the user. The user being seated can be detected by an electrical signal from such a sensor.

The human body detection sensor 403 can detect the user in front of the flush toilet 800, that is, the user existing at a position separated frontward from the toilet seat 200. That is, the human body detection sensor 403 can detect the user entering the toilet room and approaching the toilet seat 200. For example, a pyroelectric sensor, a microwave sensor, an ultrasonic sensor, or a distance sensor (an infrared-transmitting sensor) can be used as such a human body detection sensor. In the example, the human body detection sensor 403 includes a pyroelectric sensor provided in the casing. Also, the human body detection sensor 403 may detect the user directly after opening the door of the toilet room and entering the toilet room, or the user directly before entering the toilet room, that is, the user existing in front of the door about to enter the toilet room. For example, in the case where a microwave sensor is used, it is possible to detect the existence of the user through the door of the toilet room.

The controller 405 receives detection information of the human body detection sensor 403 (a signal indicating the existence or absence of the user) and/or detection information of the seat contact detection sensor 404 (a signal indicating the existence or absence of the seated user) and controls the operation of each part of the toilet seat device 100 based on the received detection information.

The controller 405 can execute the three types of mist modes of an after-mist mode, a pre-mist mode, and a manual mist mode.

For example, the after-mist mode is an operation mode of automatically spraying the mist of the sterilizing water based on the detection information of the detecting sensor 402 after the user uses the toilet device 10. The pre-mist mode is, for example, an operation mode of automatically spraying the mist of the sterilizing water or the service water based on the detection information of the detecting sensor 402 before the user uses the toilet device 10. The manual mist mode is an operation mode of spraying the mist of the sterilizing water based on the operation information of the manual operation part 500.

FIG. 5A to FIG. 5E are plan views and perspective views illustrating the toilet device according to the embodiment.

FIG. 5A shows a state in which a part of the toilet device 10 is viewed from the front.

FIG. 5B illustrates a part of FIG. 5A as being enlarged. In FIG. 5B, a part of the casing 400 positioned frontward of the spray device 481 is not illustrated for easier viewing.

The spray device 481, a nozzle damper 479, and a blower damper 516 are positioned at the rearward upper part of the bowl 801 in a state in which the toilet seat device 100 is mounted on the flush toilet 800.

The nozzle damper 479 is pivotally supported to be rotatable with respect to the casing 400. The nozzle 473 is positioned rearward of the nozzle damper 479 in a state of being retracted into the interior of the casing 400. When washing the human private part, etc., the nozzle 473 contacts the nozzle damper 479, opens the nozzle damper 479 by causing the nozzle damper 479 to rotate, and advances from the interior of the casing 400.

FIG. 5C to FIG. 5E are perspective views illustrating the periphery of the nozzle damper 479 and the blower damper 516 as being enlarged.

The blower damper 516 is pivotally supported to be rotatable with respect to the casing 400. The blower 513 is disposed rearward of the blower damper 516. The blower damper 516 covers an opening 5166*a* of the casing 400. The air that is blown from the blower 513 passes through the opening 516*a* and is blown into the flush toilet 800.

FIG. 5C is a state in which the operation of the blower 513 is stopped; and FIG. 5D and FIG. SE show states in which the blower 513 operates and blows air into the bowl 801.

As shown in FIG. 5C, the blower damper 516 is closed in the state in which the air blow is stopped.

When the blower 513 is operated as shown in FIG. 5D, the blower damper 516 is rotated and opened by the pressure (the wind pressure) of the air blown from the blower 513. Thereby, for example, the blower 513 blows air from the rear upper part inside the bowl 801 toward the front lower part inside the bowl 801 as in arrow A1.

Compared to the state of FIG. 5D, the airflow rate that is blown by the blower 513 is high (or the air velocity is high) in the state of FIG. 5E. In such a case, compared to the state of FIG. 5D, the blower damper 516 is further rotated and opened. Thereby, for example, the blower 513 blows air from the rear upper part inside the bowl 801 toward the front upper part inside the bowl 801 as in arrow A2.

Thus, the direction of the air blown from the blower 513 is changed by the blower damper 516. In other words, the blower 513 can control the blowing direction by using the airflow rate (the air velocity). By the mist being sprayed from the spray device 481 and floating on the air stream generated by the air from the blower 513, the area that is wetted by the mist and the wetting amount of the mist in each area (the amount of the sterilizing water or the service water wetting in each area) may be controlled.

Figure 6A:
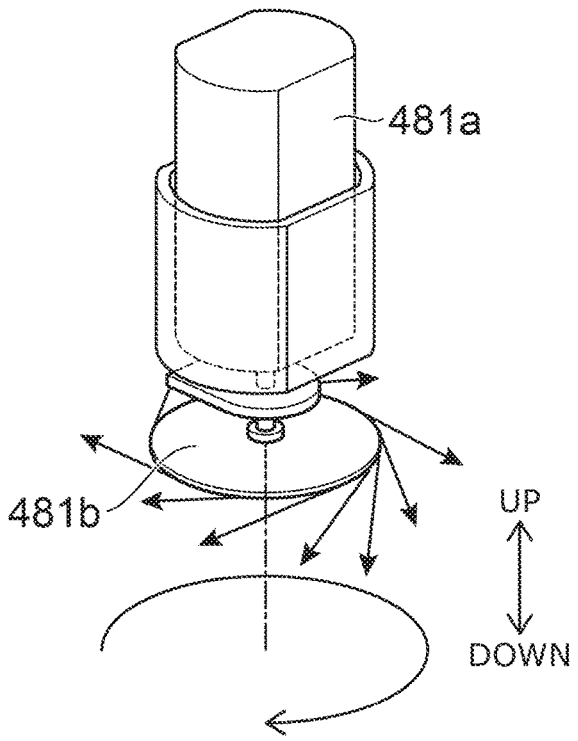
FIG. 6A to FIG. 6C are schematic views illustrating the spray device according to the embodiment.
Figure 6B:
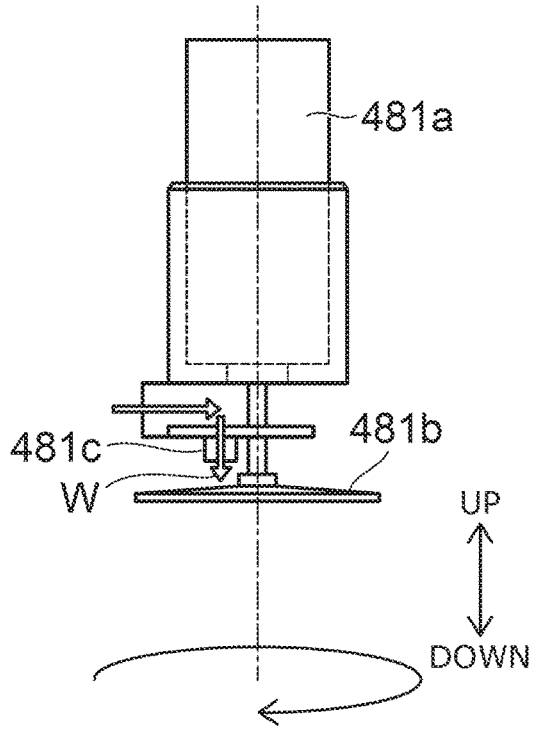
Figure 6C:
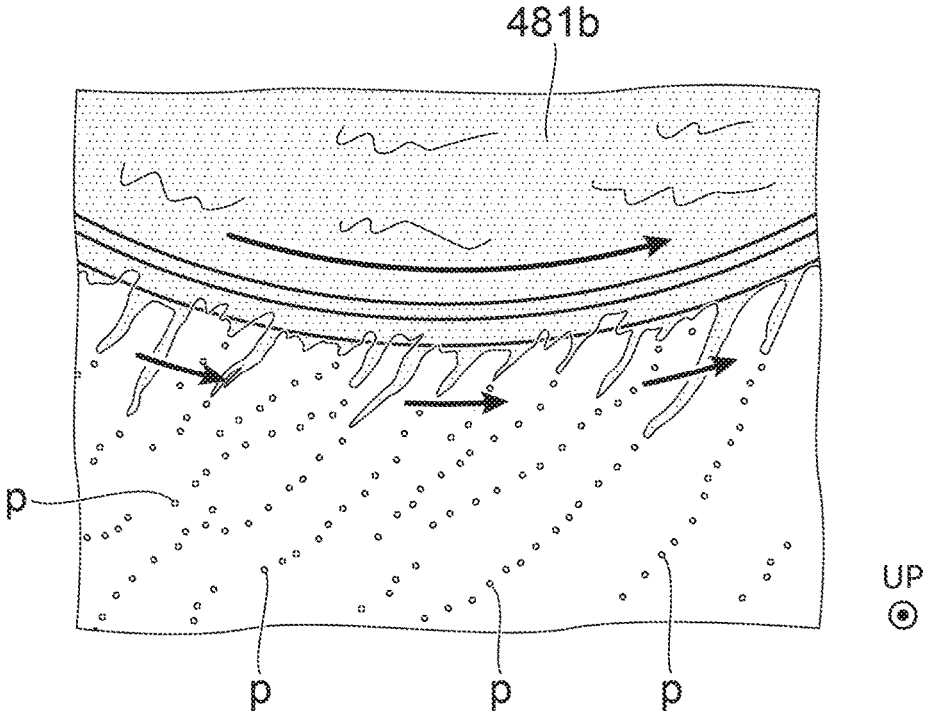

FIG. 6A to FIG. 6C are schematic views illustrating the spray device according to the embodiment.

FIG. 6A is a perspective view of the spray device 481; and FIG. 6B is a side view of the spray device 481.

The spray device 481 includes a motor 481*a*, and a disk 481*b* connected below the motor 481*a*. The rotation of the motor 481*a* is controlled by the controller 405. When the motor 481*a* rotates, the drive force of the rotation is transferred to the disk 481*b*; and the disk 481*b* rotates.

As shown in FIG. 6B, water W (the service water or the sterilizing water generated by the sterilizer 450) is supplied to the upper surface of the disk 481*b*. By supplying the water W while the disk 481*b* rotates, the spray device 481 sprays the water W in a mist-like form.

FIG. 6C is an enlarged view of a part of the disk 481*b* when viewed from above. The water W that is dropped on the upper surface of the rotating disk 481*b* is spread in a film configuration on the disk 481*b* by a centrifugal force and is radiated from the disk 481*b*. At this time, the water W breaks up from the edge vicinity of the disk 481*b* while still being in a film configuration, breaks up after becoming string-like, and subsequently becomes the fine particles p (the mist). The particle size (the diameter of the fine particle p) of the mist can be controlled by the rotational speed of the disk 481*b*, i.e., the rotational speed of the motor 481*a*. The particle size of the mist decreases as the rotational speed increases. For example, the desired particle size is obtained by appropriately using a low-speed rotation having a rotational speed of about 1000 (rotations per minute (rpm)), a medium-speed rotation having a rotational speed of about 10000 rpm, or a high-speed rotation having a rotational speed of about 20000 rpm. Also, the particle size of the mist can be controlled by adjusting the flow rate of the water W supplied from a water supply port 481*c* to the spray device 481.

In this specification, the particle size is the particle size of the fine particle p existing in air before wetting the toilet device 10 and is, for example, the Sauter mean diameter (total volume/total surface area). The method for measuring the "particle size" of this specification is described below with reference to FIGS. 34A and 34B. The mist refers to a range of particle sizes that is not less than 10 micrometers (μm) and not more than 300 μm. In the case where the particle size of the mist is less than 10 μm, an undesirably long length of time is necessary for the wetted sections of the bowl 801, the rim part 805, the toilet seat 200, etc., to become wet. Also, in the case where sterilizing water including hypochlorous acid is used, if the particle size of the mist is less than 10 μm, the concentration of the hypochlorous acid inside the mist attenuates easily; and the sterilizing performance degrades easily. On the other hand, in the case where the particle size of the mist is greater than 300 the mist does not diffuse easily; and it is difficult to spray the mist in a wide area. In the following description, the mist that has the large particle size is a mist having a range of particle sizes that is not less than 100 μm and not more than 300 μm, and favorably not less than 150 μm and not more than 300 μm; the mist that has the medium particle size is a mist having a range of particle sizes that is not less than 50 μm and not more than 200 μm, and favorably not less than 60 μm and not more than 150 μm; and the mist that has the small particle size is a mist having a range of particle sizes that is not less than 10 μm and not more than 100 μm, and favorably not less than 10 μm and not more than 60 μm.

For example, it is also possible to adjust the particle size, the flow rate, the direction, etc., of the mist sprayed from the spray device 481 into the flush toilet 800 by using the positions and/or the number of the water supply ports 481*c* and the rotation direction (clockwise or counterclockwise) of the disk 481*b*. Thereby, for the mist that is sprayed from the spray device 481, the area that is wetted by the mist and the wetting amount of the mist in each area may be controlled. Also, a cover or the like that controls the direction in which the mist is sprayed may be appropriately provided at the periphery of the disk 481*b*.

Figure 7:
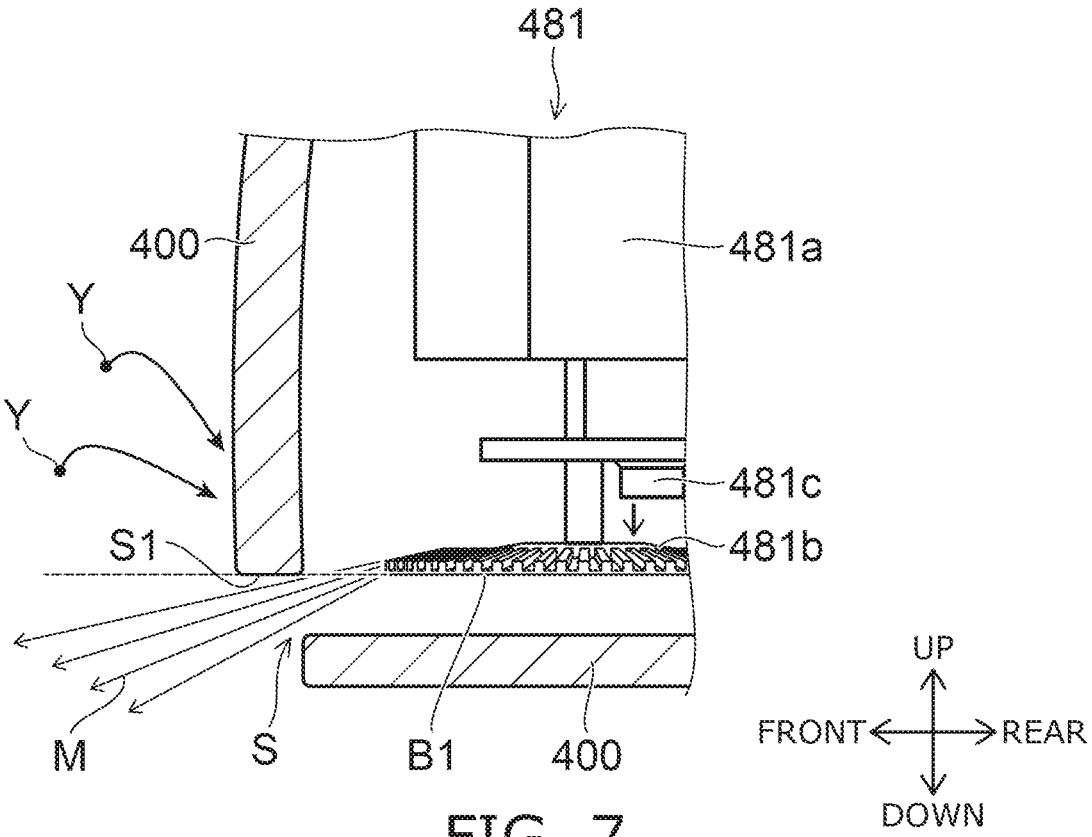
FIG. 7 is a cross-sectional view illustrating a part of a toilet device according to a modification of the embodiment.

FIG. 7 is a cross-sectional view illustrating a part of a toilet device according to a modification of the embodiment.

FIG. 7 shows a cross section along line A-A' shown in FIG. 5A.

As shown in FIG. 7, a slit S is provided in the casing 400. In the example, the spray device 481 is disposed inside the casing 400; and the slit S is positioned at the front lower part of the spray device 481. For example, the height (the position in the vertical direction) of an upper end surface S1 of the slit S is the same as the height of a bottom surface B1 of the disk 481*b*; and the upper end surface S1 and the bottom surface B1 are in the same plane. Or, the upper end surface S1 may be lower than the bottom surface B1.

The upper surface of the disk 481*b* is tilted from horizontal; and the disk 481*b* sprays the mist M slightly downward from horizontal. The mist M that is sprayed from the disk 481*b* passes through the slit S and is sprayed into the bowl 801. Thereby, dirt Y such as urine, etc., can be prevented from adhering to the spray device 481 without losing the designability and/or the cleanability of the toilet device 10. The configuration of the disk 481*b* may be a flat disk configuration; an unevenness may be provided as appropriate; or a circular conic configuration or a sphere may be used. Thereby, the spray direction of the mist, the particle size of the mist, etc., also can be adjusted.

The spray device 481 is disposed below a part of the toilet seat 200 in the state in which the toilet seat device 100 is mounted on the flush toilet 800 (referring to FIG. 2) and sprays the mist into the flush toilet 800.

In the embodiment, the spray device is not limited to the devices described in reference to FIG. 6A to FIG. 7. For example, an ultrasonic atomizing device may be used as the spray device. The ultrasonic atomizing device changes a liquid into a mist-like form by irradiating an ultrasonic wave on the liquid. For example, a two-fluid nozzle may be used as the spray device. The two-fluid nozzle changes a liquid into a mist-like form by squirting both a gas and the liquid. However, in the case where the devices described in reference to FIG. 6A to FIG. 7 are used, an advantage is provided in that the spraying area is controlled easily by the blower 513. Also, the risk of clogging is low; and a supplemental device such as a compressor or the like is unnecessary.

Figure 8A:
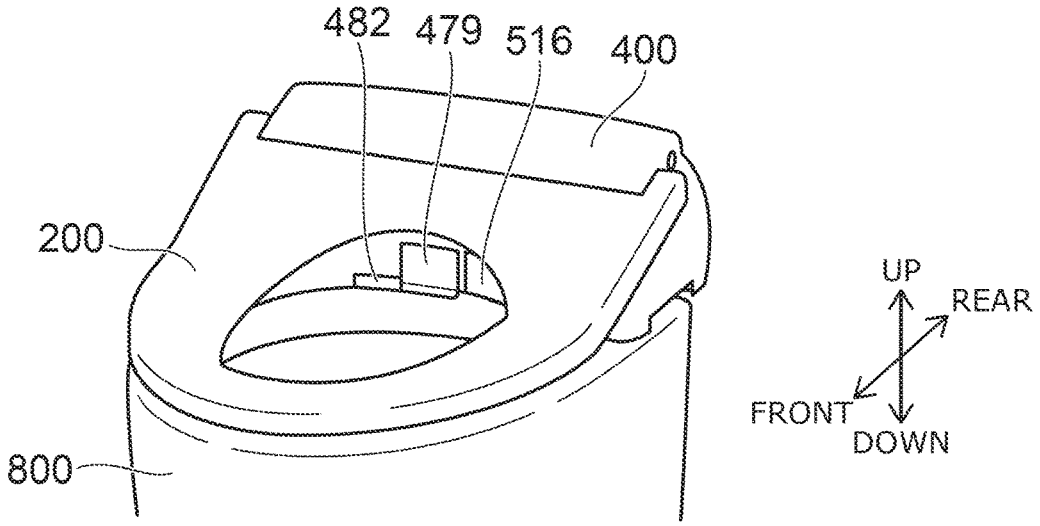
FIG. 8A to FIG. 8C are perspective views illustrating another toilet device according to the embodiment.
Figure 8B:
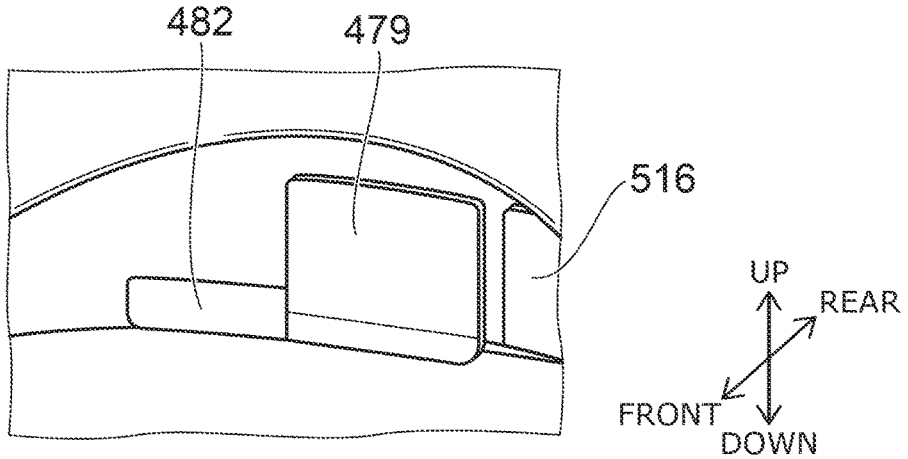
Figure 8C:
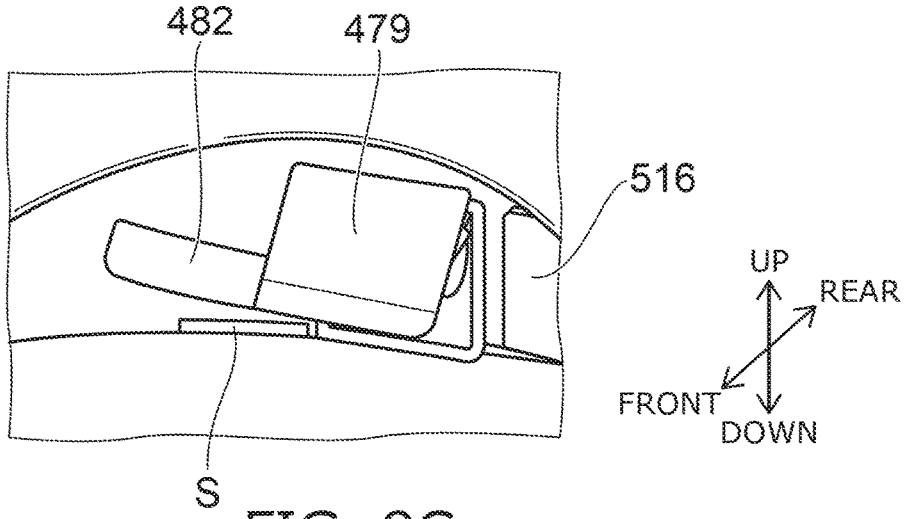

FIG. 8A to FIG. 8C are perspective views illustrating another toilet device according to the embodiment. In the example, a mist damper 482 is provided frontward of the spray device 481. The mist damper 482 covers the slit S at the front of the spray device 481 in the closed state.

For example, the mist damper 482 is fixed to the nozzle damper 479 and operates with the nozzle damper 479. When the nozzle damper 479 is opened, the mist damper 482 also is opened; and when the nozzle damper 479 is closed, the mist damper 482 also is closed.

FIG. 8B and FIG. 8C illustrate the periphery of the nozzle damper 479 and the mist damper 482 as being enlarged. FIG. 8B is a state in which the nozzle 473 is retracted into the interior of the casing 400. At this time, the nozzle damper 479 is in the closed state and covers the front of the nozzle 473. Also, the mist damper 482 is in the closed state and covers the front of the slit S.

When the spray device 481 is unused, the spray device 481 is concealed from the bowl 801 side by the mist damper 482 as in FIG. 8B. Thereby, the adhesion of urine and/or dirt on the spray device 481 can be prevented further.

FIG. 8C is a state in which the nozzle 473 advances frontward and causes the nozzle damper 479 to rotate. The frontward advancement distance of the nozzle 473 at this time may be shorter than the frontward advancement distance when washing the human private part. For example, the tip of the nozzle 473 contacts the nozzle damper 479.

Also, in FIG. 8C, the mist damper 482 is rotated and opened with the nozzle damper 479. The direction and/or the area where the mist is sprayed may be controlled by the mist damper 482.

Figure 9:
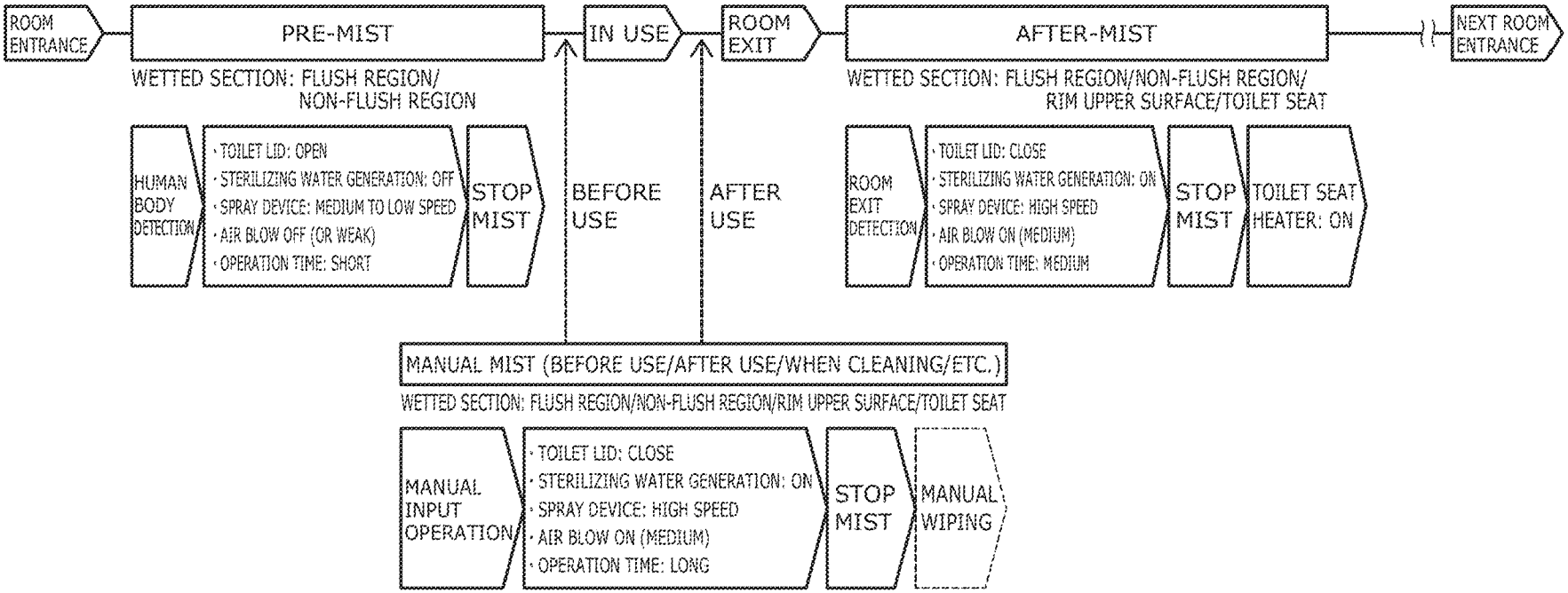
FIG. 9 is a flowchart illustrating operations of the toilet seat device according to the embodiment.

FIG. 9 is a flowchart illustrating operations of the toilet seat device according to the embodiment.

Figures 10A, 10B:
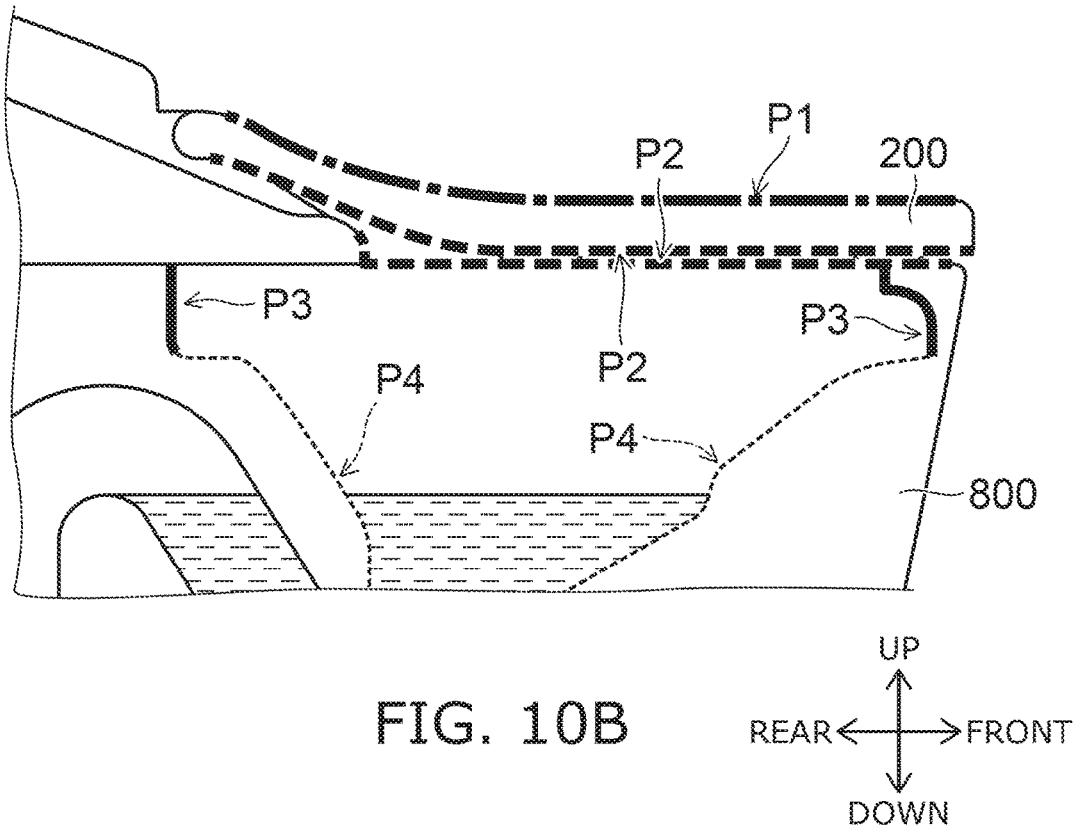
FIG. 10A and FIG. 10B are schematic views illustrating the operations of the toilet seat device according to the embodiment.

FIG. 10A and FIG. 10B are schematic views illustrating the operations of the toilet seat device according to the embodiment.

FIG. 10B shows wetted sections (P1 to P4) wetted by the mist of the sterilizing water or the service water. FIG. 10A shows examples of the wetting amount (the wetting amount per unit area) of each wetted section of each mist mode using the four levels of "large," "medium," "small," and "extremely small."

The detecting sensor 402 has a detecting state and a non-detecting state. The detecting state is a state in which the detecting sensor 402 detects the user. The non-detecting state is a state in which the detecting sensor 402 does not detect the user. When the detecting sensor 402 changes from the non-detecting state to the detecting state, the controller 405 executes the pre-mist mode by automatically controlling the spray device 481 to spray the mist of the service water or the mist of the sterilizing water into the bowl 801.

For example, as shown in FIG. 9, when the user enters the toilet room and the human body detection sensor 403 detects the entrance of the user, a signal (detection information) that indicates the entrance of the user is transmitted to the controller 405. Based on the signal, the controller 405 automatically executes the pre-mist mode. In the pre-mist mode, the controller 405 causes the spray device 481 to spray the mist of the service water and cause the mist to wet the wetted sections. The wetted sections of the pre-mist mode are the wetted section P3 (the non-flush region 801B of the bowl 801) and the wetted section P4 (the flush region 801A of the bowl 801) as shown in FIG. 10A and FIG. 10B. In the pre-mist mode, the toilet seat 200 and the rim upper surface 806 of the rim part 805 are not wetted sections of the spraying.

Thus, the mist that is sprayed from the spray device 481 in the pre-mist mode wets not only the flush region 801A but also the non-flush region 801B; and a water film is formed in the flush region 801A and the non-flush region 801B. Thereby, the clinging and/or the adhesion of excrement can be suppressed in a wide area of the flush toilet 800 including the non-flush region 801B.

When the detecting sensor 402 changes from the detecting state to the non-detecting state, the controller 405 executes the after-mist mode by automatically controlling the spray device 481 to spray the mist of the sterilizing water into the flush toilet 800 and onto the toilet seat 200.

For example, as shown in FIG. 9, when the user exits the toilet room and the human body detection sensor 403 detects the exit of the user, a signal (detection information) that indicates the exit of the user is transmitted to the controller 405. Based on the signal, the controller 405 automatically executes the after-mist mode. In the after-mist mode, the controller 405 causes the sterilizer 450 to generate the sterilizing water, causes the spray device 481 to spray the mist of the sterilizing water, and causes the mist to wet the wetted sections. The wetted sections of the after-mist mode are the wetted section P1 (a front surface 203 of the toilet seat 200), the wetted section P2 (the back surface 204 of the toilet seat 200 and the rim upper surface 806), the wetted section P3, and the wetted section P4 as shown in FIG. 10A and FIG. 10B.

Thus, by executing the after-mist mode, the sterilizing water can be automatically caused to wet the interior of the flush toilet 800 and the toilet seat 200 after the user uses the toilet seat device 100. Thereby, the occurrence of bacteria and/or dirt can be suppressed automatically in a wide area including not only the flush toilet 800 but also the toilet seat 200, etc.

When the user operates the manual operation part 500, the controller 405 executes the manual mist mode by controlling the spray device 481 to spray the mist of the sterilizing water into the flush toilet 800 and onto the toilet seat 200.

For example, as shown in FIG. 9, when the user operates the manual operation part 500 when entering the toilet room (e.g., after executing the pre-mist mode), a signal (operation information) that corresponds to the operation is transmitted to the controller 405. The controller 405 executes the manual mist mode based on the signal. The manual mist mode is executed for the toilet seat device 100 at the timing of before use/after use/when cleaning/etc. In the manual mist mode, the controller 405 causes the sterilizer 450 to generate the sterilizing water, causes the spray device 481 to spray the mist of the sterilizing water, and causes the mist to wet the wetted sections. The wetted sections of the manual mist mode are the wetted section P1, the wetted section P2, the wetted section P3, and the wetted section P4 as shown in FIG. 10A and FIG. 10B.

Thus, by the manual mist mode, the occurrence of bacteria and/or dirt can be suppressed in a wide area including not only the interior of the flush toilet 800 but also the toilet seat 200 by causing the sterilizing water to wet the interior of the flush toilet 800 and the toilet seat 200 at the timing of the operation of the manual operation part 500. Also, the user can remove the bacteria and/or the dirt occurring on the toilet seat 200 by wiping the mist of the sterilizing water wetting the toilet seat 200. For example, for adhered dirt that is difficult to suppress by the after-mist mode, sterilization can be performed by wiping the wetting sterilizing water using toilet paper, etc. For example, a user that is anxious about the dirt of the toilet seat 200 before use of the toilet seat device 100 can sterilize the toilet seat 200 by using the manual mist mode. The sense of security and/or the satisfaction of the user can be increased because the sterilization is executed based on an operation performed personally by the user.

Figure 11:
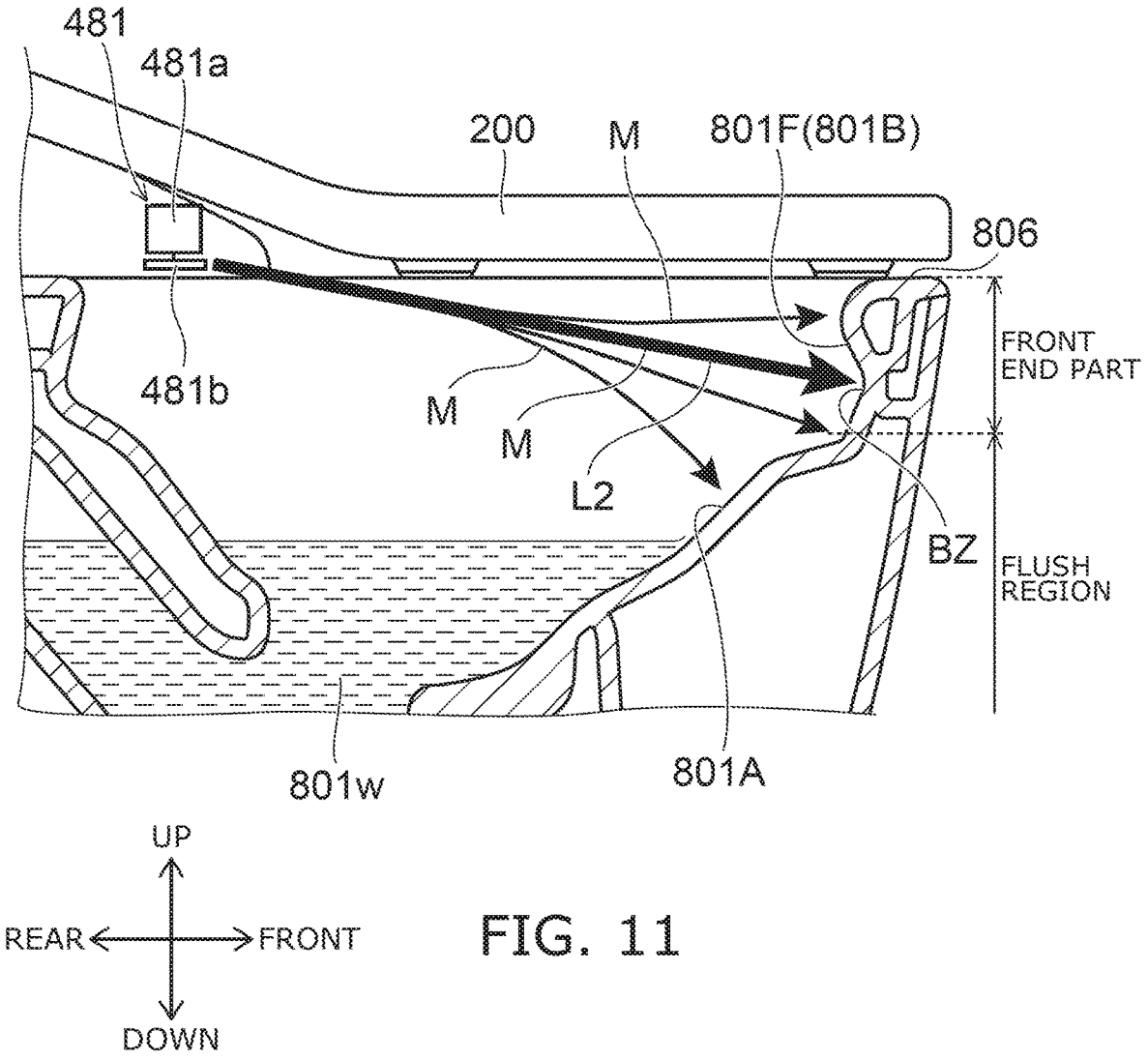
FIG. 11 is a cross-sectional view illustrating operations in the pre-mist mode of the toilet seat device according to the embodiment.

FIG. 11 is a cross-sectional view illustrating operations in the pre-mist mode of the toilet seat device according to the embodiment.

As shown in FIG. 11, the non-flush region 801B of the bowl 801 includes a front end part 801F. The front end part 801F is the front end part of the non-flush region 801B and is positioned at, for example, the center in the left/right direction of the bowl 801. The front end-side non-flush region 801F includes the frontwardmost end of the non-flush region 801B and is a region extending vertically from the upper end of the flush region 801A to the rim upper surface 806.

To suppress the clinging of excrement at the bowl 801, etc., it is favorable to cause much of the mist also to wet the non-flush region 801B so that a water film is formed on the non-flush region 801B. Therefore, a method may be considered in which the blower 513 is operated to generate an air stream inside the bowl 801; and the mist is caused to reach the non-flush region 801B by the air stream. However, in such a case, the mist that floats on the air stream also may wet the toilet seat 200 and/or the rim upper surface 806. Then, when the user is seated on the toilet seat 200 and/or the toilet seat 200 is rotated by hand, there is a risk that discomfort may occur due to the buttocks and/or the hand of the user contacting the mist wetting the toilet seat 200. Also, because the rim upper surface 806 is formed substantially horizontally, there is a risk that the mist wetting the rim upper surface 806 may drip outside the flush toilet 800.

Therefore, in the pre-mist mode, the controller 405 does not operate the blower 513 to generate a rising air stream inside the bowl 801. Also, in the pre-mist mode, the controller 405 controls the speed of the mist sprayed by the spray device 481 to reach the front end part 801F while maintaining the state in which the mist sprayed from the spray device 481 travels straight so that the mist directly wets the front end part 801F without the mist that wets the rim upper surface 806 dripping outside the flush toilet 800.

Thereby, even though much of the mist is caused to wet the non-flush region 801B, the mist does not float around by floating on a rising air stream generated by the blower 513; therefore, the amount of the mist wetting the rim upper surface 806 and/or the toilet seat 200 can be suppressed. Thereby, the dripping outside the flush toilet 800 of the mist wetting the rim upper surface 806 can be suppressed. Also, the toilet seat 200 that becomes wet due to the mist can be suppressed; and the contact of the buttocks and/or the hand of the user with the mist wetting the toilet seat 200 can be suppressed when the user is seated on the toilet seat 200 or when the toilet seat 200 is rotated by hand.

In this specification, the "wetting mist" includes water droplets and/or a water film formed by coalescing after the wetting of the mist, etc.

For example, in the pre-mist mode, the controller 405 controls the speed of the mist (the speed at which the fine particle p flies) and/or the particle size of the mist by controlling the rotational speed of the disk 481*b* of the spray device 481. For example, the state in which the mist travels straight is maintained more easily as the speed of the mist increases.

In FIG. 11 (and FIG. 14, FIGS. 17A and 17B, FIGS. 20A and 20B, FIGS. 24A and 24B, FIGS. 25A and 25B, FIGS. 27A and 27B, FIGS. 28A and 28B, FIG. 30, and FIGS. 31A and 31B described below), the path of the mist M sprayed from the spray device 481 is illustrated by arrows. A thick arrow illustrates a high amount of the mist. As shown in FIG. 11, the area where the mist is sprayed spreads vertically.

Figure 12:
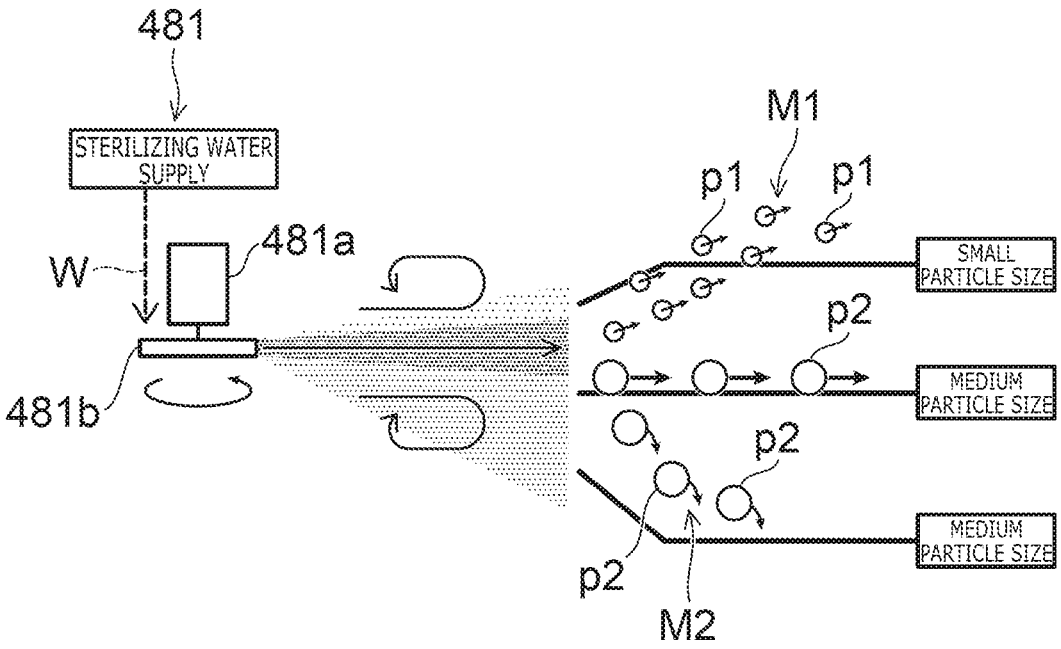
FIG. 12 is a schematic view illustrating the mist sprayed by the spray device according to the embodiment.

FIG. 12 is a schematic view illustrating the mist sprayed by the spray device according to the embodiment.

The particle size of the mist sprayed from the spray device 481 has a distribution. For example, as shown in FIG. 12, a mist M1 (a fine particle p1 of the service water or the sterilizing water) that has a small particle size and a mist M2 (a fine particle p2 of the service water or the sterilizing water) that has a medium particle size or a large particle size are sprayed from the spray device 481. The fine particle p2 of the mist M2 moves easily horizontally or downward because its weight is large. On the other hand, there are cases where the fine particle p1 of the mist M1 moves upward due to the effect of the air stream because its weight is small.

Therefore, as shown in FIG. 11, a distribution also occurs in the amount of the mist wetting the front end part 801F. The part of the front end part 801F directly wetted the most by the mist is a volume zone BZ. In the embodiment, the controller 405 controls the spray device 481 so that the state in which the mist travels straight is maintained for the mist reaching the volume zone BZ.

Figure 13:
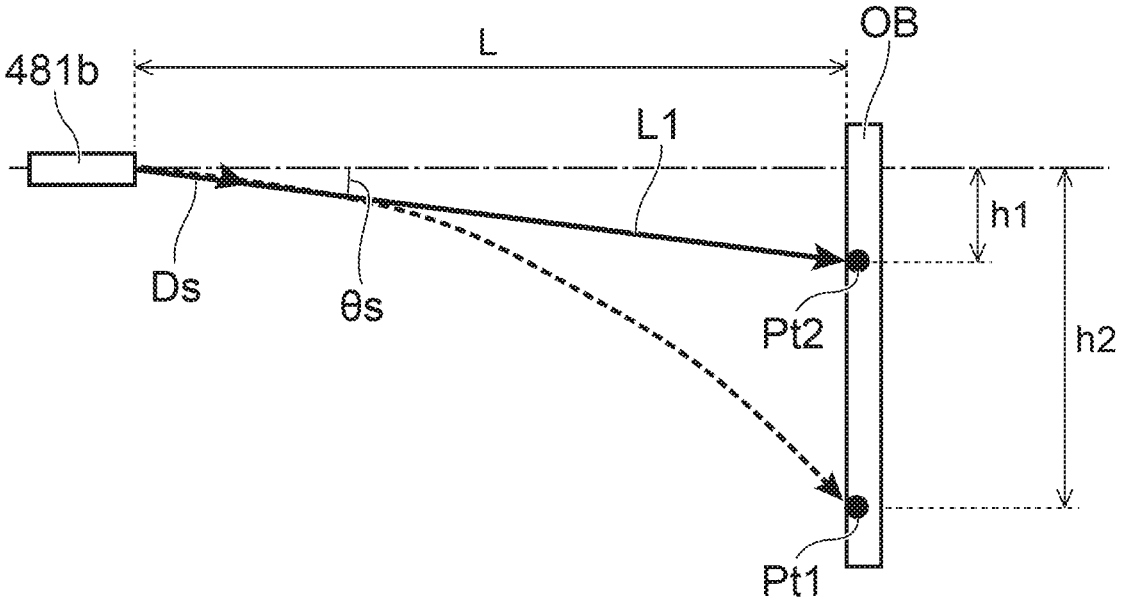
FIG. 13 is a schematic view for describing the state in which the mist travels straight.

FIG. 13 is a schematic view for describing the state in which the mist travels straight.

Whether or not the state is maintained in which the mist sprayed from the spray device 481 travels straight is determined as follows.

A spray object OB is disposed at a position separated in the horizontal direction from the spray device 481 (the disk 481*b*) by a distance L. The distance L is, for example, the distance (of about 300 to 400 mm) along the horizontal direction between the spray device 481 and the front end part 801F.

The mist is sprayed from the spray device 481 toward the spray object OB; and a wetting point Pt1 of the mist at the spray object OB is measured. The wetting point Pt1 is the point on the spray object OB directly wetted the most by the mist. For example, the wetting point Pt1 can be visualized by receiving the mist using water-sensitive paper, a transparent plate, etc., and by observing the distribution of the water droplets.

A spray direction Ds (a spray angle θs) in which the spray device 481 sprays the mist is measured. The spray direction Ds is the direction in which most of the mist is sprayed at the vicinity of the spray device 481. The vicinity of the spray device 481 is, for example, the area where the distance from the spray device 481 is within 50 mm. For example, the spray direction Ds can be measured by acquiring an image of the spray device 481 spraying the mist and by image processing. Or, the spray direction Ds may be measured by visualizing the sprayed mist by irradiating a sheet laser on the mist. The spray angle θs is the angle between the horizontal direction and the spray direction Ds.

A height h1 of an intersection Pt2 between the spray object OB and a straight line L1 extending in the spray direction Ds from the spray device 481 is calculated. The height h1 is the distance along the vertical direction between the spray device 481 and the intersection Pt2 and is calculated by L×tan θs. Also, an actual wetting height h2 is measured. The wetting height h2 is the distance along the vertical direction between the spray device 481 and the wetting point Pt1.

In the case where the wetting height h2 is the same as the height h1, it is determined that the mist that is sprayed from the spray device 481 reached the spray object OB while the state in which the mist travels straight is maintained. The range in which the wetting height h2 is the same as the height hi is taken to include the case where the difference between the wetting height h2 and the height h1 is within 20 mm.

Figure 14:
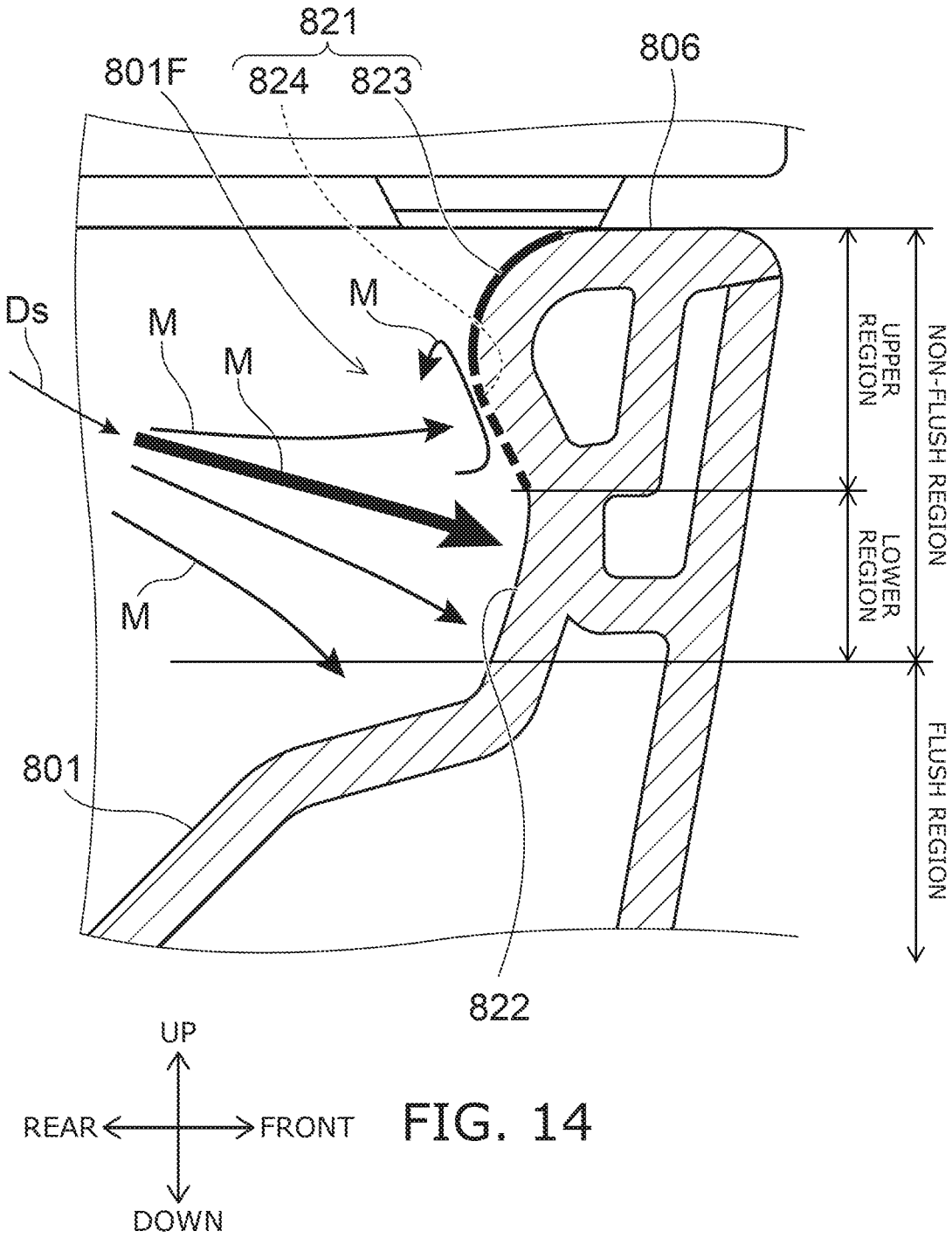
FIG. 14 is a cross-sectional view illustrating the operations in the pre-mist mode of the toilet seat device according to the embodiment.

FIG. 14 is a cross-sectional view illustrating the operations in the pre-mist mode of the toilet seat device according to the embodiment.

FIG. 14 shows the periphery of the front end part 801F shown in FIG. 11 as being enlarged.

As shown in FIG. 14, the front end part 801F includes an upper region 821 and a lower region 822. Also, the upper region 821 includes an R-part 823 and a mist guide part 824.

The R-part 823 includes the upper end of the front end part 801F and has a curved configuration having a downward tilt toward the inner side of the bowl 801. The mist guide part 824 is provided below the R-part 823 and has a downward tilt toward the outer side of the bowl 801. Or, the mist guide part 824 may extend in the vertical direction. The mist guide part 824 is continuous with the R-part 823.

The R-part 823 is positioned at the vicinity of the rim upper surface 806. Therefore, the rim upper surface 806 becomes wet easily in the case where the spray direction Ds in which the spray device 481 sprays the mist is a direction such that much of the mist wets the R-part 823. In such a case, there is a risk that the mist that wets the rim upper surface 806 may drip outside the flush toilet 800. Also, because the R-part 823 has the downward tilt toward the inner side of the bowl 801, the mist that reaches the R-part 823 easily is reflected by the R-part 823 and scatters toward the rim upper surface 806 side. In particular, the mist undesirably scatters easily in the case where the speed of the mist is increased so that the mist reaches the non-flush region 801B while the state is maintained in which the mist travels straight.

Conversely, in the embodiment, the spray direction Ds in which the spray device 481 sprays the mist is set so that the mist that reaches the front end part 801F while maintaining the state of traveling straight as sprayed from the spray device 481 wets a region lower than the R-part 823. Thereby, the amount of the mist wetting the rim upper surface 806 positioned above the R-part 823 can be reduced. Also, even in the case where the speed of the mist is increased to maintain the state of traveling straight, the scattering of the mist toward the rim upper surface 806 side can be suppressed.

In the example shown in FIG. 14, the mist guide part 824 has the downward tilt toward the outer side of the bowl 801 and guides the mist reaching the front end part 801F downward. For example, the mist that reaches the mist guide part 824 is reflected downward. Thereby, the scattering of the mist toward the rim upper surface 806 side can be suppressed even in the case where the speed of the mist is increased so that the mist reaches the front end part 801F while maintaining the state of traveling straight.

A sprayer (e.g., the disk 481*b*) that sprays the mist also is provided below a part of the toilet seat 200. Also, the spray direction Ds in which the spray device 481 sprays the mist is set obliquely downward toward the front end part 801F. Thereby, the mist that reaches the front end part 801F easily scatters downward. That is, the mist is easily reflected downward at the front end part 801F. Accordingly, the scattering of the mist toward the rim upper surface 806 side can be suppressed even in the case where the speed of the mist is increased so that the mist reaches the front end part 801F while maintaining the state of traveling straight.

The spray device 481 is disposed so that an imaginary line segment L2 connecting the sprayer (e.g., the disk 481*b*) and the front end part 801F (referring to FIG. 11) does not intersect the toilet seat 200. Also, the spray direction Ds is set to cause the mist to be sprayed along the line segment L2 to reach the front end part 801F while maintaining the state of traveling straight. Thereby, the mist can be caused to wet the non-flush region 801B while suppressing the toilet seat 200 becoming wet due to the mist.

In the pre-mist mode, the controller 405 controls the spray device 481 to cause the average wetting amount per unit area of the mist directly wetting the upper region 821 of the front end part 801F to be less than the average wetting amount per unit area of the mist directly wetting the lower region 822 of the front end part 801F.

Specifically, for example, in the pre-mist mode, the controller 405 controls the spray device 481 to cause the particle size of the mist directly wetting the lower region 822 to be larger than the particle size of the mist directly wetting the upper region 821. The average wetting amount per unit area of the mist directly wetting the lower region 822 can be increased by increasing the particle size of the mist directly wetting the lower region 822. Also, the average wetting amount per unit area of the mist directly wetting the lower region 822 can be reduced by reducing the particle size of the mist directly wetting the upper region 821.

The clinging and/or the adhesion of excrement at the lower region 822 can be suppressed by causing the average wetting amount per unit area of the mist directly wetting the lower region 822 to be relatively large. On the other hand, the amount of the mist wetting the rim upper surface 806 and/or the toilet seat 200 can be suppressed by causing the average wetting amount per unit area of the mist directly wetting the upper region 821 to be relatively small. For example, the scattering onto the rim upper surface 806 and/or the toilet seat 200 of the mist reaching the upper region 821 can be suppressed. Thereby, the dripping outside the flush toilet of the mist wetting the rim upper surface 806 can be suppressed. Also, the toilet seat 200 becoming wet due to the mist can be suppressed; and the buttocks and/or the hand of the user contacting the mist wetting the toilet seat 200 when the user is seated on the toilet seat 200 or when the toilet seat 200 is rotated by hand can be suppressed.

Figure 15A:
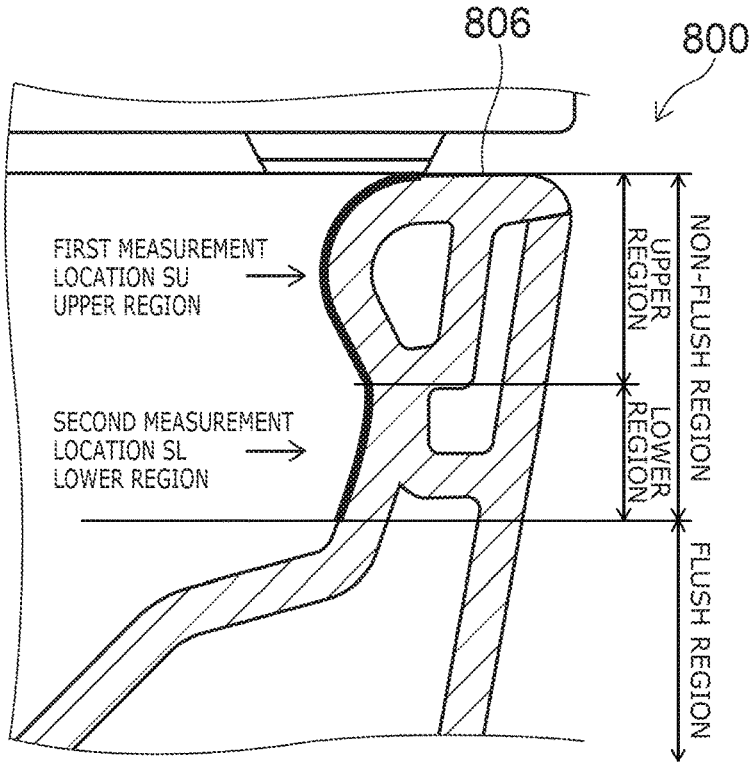
FIG. 15A to FIG. 15C are schematic views for describing a method for measuring the average wetting amount per unit area of the mist directly wetting the upper region and the lower region of the non-flush region.
Figure 15B:
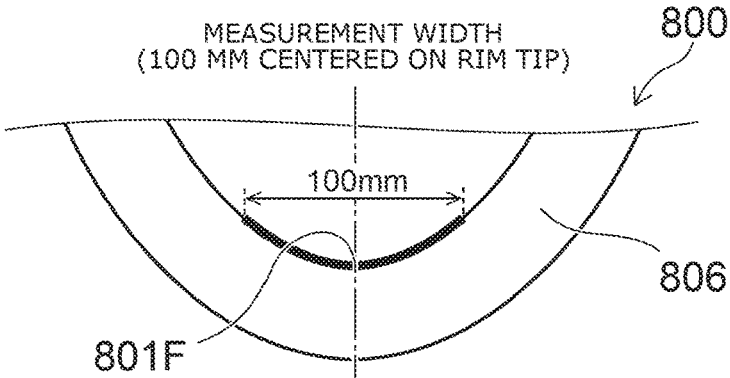
Figure 15C:
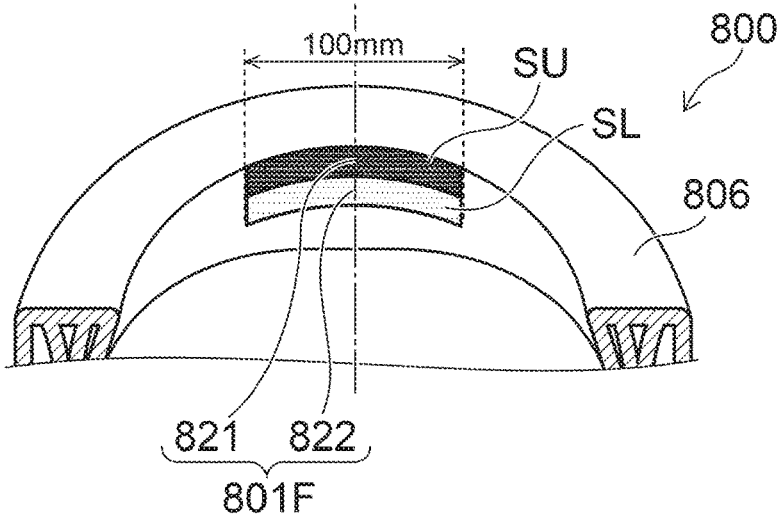

FIG. 15A to FIG. 15C are schematic views for describing a method for measuring the average wetting amount per unit area of the mist directly wetting the upper region and the lower region of the non-flush region.

First, a first measurement location SU that includes the upper region 821 of the front end part 801F is set; and a second measurement location SL that includes the lower region 822 of the front end part 801F is set. The areas in the left/right direction of the first measurement location SU and the second measurement location SL each are areas having widths of 100 mm centered on the tip of the non-flush region 801B. Also, the area in the vertical direction of the first measurement location SU is substantially the same as the area in the vertical direction of the upper region 821; and the area in the vertical direction of the second measurement location SL is substantially the same as the area in the vertical direction of the lower region 822.

After a specified length of time of spraying the mist onto the front end part 801F, the first measurement location SU and the second measurement location SL each are wiped using kim towels (made by Nippon Paper Crecia Co., Ltd.). Thereby, the wetting mist is absorbed by the kim towel for each of the first measurement location SU and the second measurement location SL.

The specified length of time of spraying the mist is determined according to a spray flow rate Q (L/min) of the mist. In the case where the spray flow rate Q is $Q<0.03$ L/min, the specified length of time is set to 10 seconds. In the case where the spray flow rate Q is $0.03\ \text{L/min} \leq Q < 0.2$ L/min, the specified length of time is set to 4 seconds. In the case where the spray flow rate Q is $Q \leq 0.2$ L/min, the specified length of time is set to 2 seconds.

The difference between the weight of the kim towel after absorbing the mist wetting the first measurement location SU and the weight of the kim towel before being wetted by the mist is the wetting amount of the mist wetting the first measurement location SU. The value of the wetting amount of the mist wetting the first measurement location SU divided by the surface area of the first measurement location SU is used as the average wetting amount per unit area of the mist directly wetting the upper region 821.

Similarly, the difference between the weight of the kim towel after absorbing the mist wetting the second measurement location SL and the weight of the kim towel before being wetted by the mist is the wetting amount of the mist wetting the second measurement location SL. The value of the wetting amount of the mist wetting the second measurement location SL divided by the surface area of the second measurement location SL is used as the average wetting amount per unit area of the mist directly wetting the lower region 822.

Instead of wiping each measurement location with the kim towel, the kim towel may absorb the mist by performing the spraying in a state in which the kim towel is adhered to each measurement location. For example, the kim towel which is originally formed to be 4-ply is unfolded; and the kim towel that is in the unfolded state is cut into shapes matching the measurement locations. The kim towels that are cut are adhered to the measurement locations.

In the example recited above, the R-part 823 and the mist guide part 824 are taken as the upper region 821; and the region that is lower than the lower end of the mist guide part 824 is taken as the lower region 822. This is not limited thereto; and the boundary between the upper region 821 and the lower region 822 may be taken as the center in the vertical direction of the front end part 801F. In other words, the region on the upper side of the center in the vertical direction of the front end part 801F may be taken as the upper region 821; and the region on the lower side of the center in the vertical direction of the front end part 801F may be taken as the lower region 822.

Figure 16A:
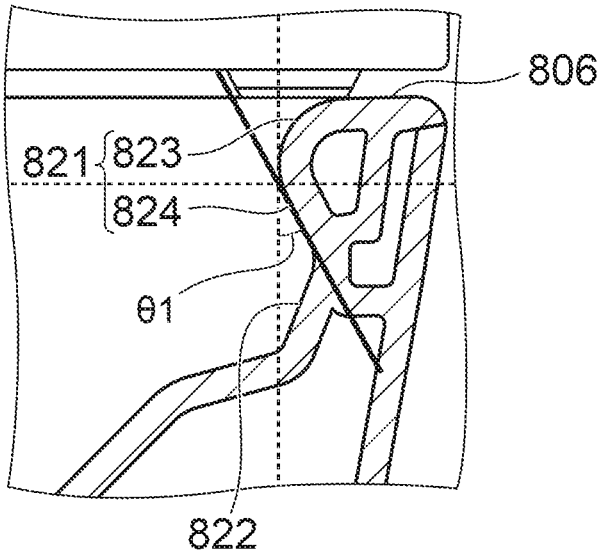
FIG. 16A and FIG. 16B are cross-sectional views illustrating the front end part of the non-flush region of the flush toilet according to the embodiment.
Figure 16B:
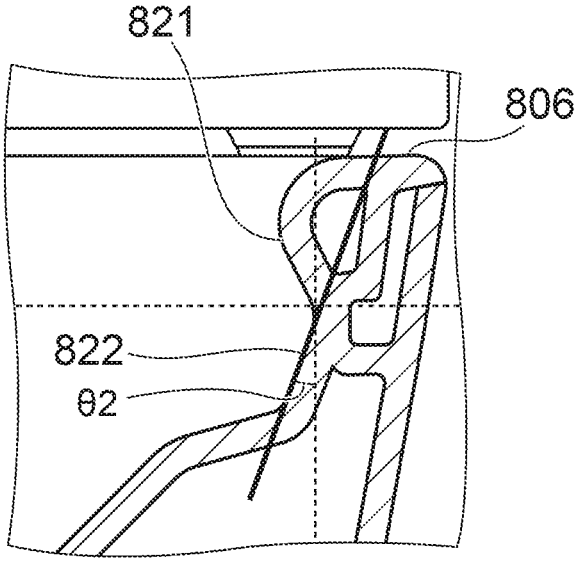

FIG. 16A and FIG. 16B are cross-sectional views illustrating the front end part of the flush toilet according to the embodiment.

As shown in FIG. 16A, the upper region 821 has the tilted surface (the mist guide part 824) tilted downward toward the outer side of the bowl 801. As described above, the mist guide part 824 (the tilted surface of the upper region 821) guides the mist downward.

On the other hand, as shown in FIG. 16B, the lower region 822 has the tilted surface tilted downward toward the inner side of the bowl 801. Thereby, the lower region 822 guides the mist reaching the lower region 822 upward. Thereby, a part of the mist reaching the lower region 822 can be caused to wet the upper region 821; and the wetting amount (the indirect wetting amount) at the upper region 821 can be increased. Because the tilted surface of the upper region 821 is provided on the tilted surface of the lower region 822, the mist that is guided upward by the tilted surface of the lower region 822 is suppressed from scattering across the upper region 821 to the rim upper surface 806.

For example, a tilt angle θ1 of the upper region 821 is larger than a tilt angle θ2 of the lower region 822. The tilt angle θ1 is the angle between the vertical direction and the tilted surface (the mist guide part 824) of the upper region 821. The tilt angle θ2 is the angle between the vertical direction and the tilted surface of the lower region 822.

By setting the tilt angle θ1 to be large, the mist that reaches the upper region 821 can be guided downward more actively. Also, by setting the tilt angle θ2 to be small, the amount of the mist guided upward by the lower region 822 can be suppressed. By setting the tilt angle θ1 to be larger than the tilt angle θ2, the mist that is guided to the upper region 821 by the lower region 822 decelerates at the tilted surface of the upper region 821 and therefore is not scattered to the rim upper surface 806.

Figure 17A:
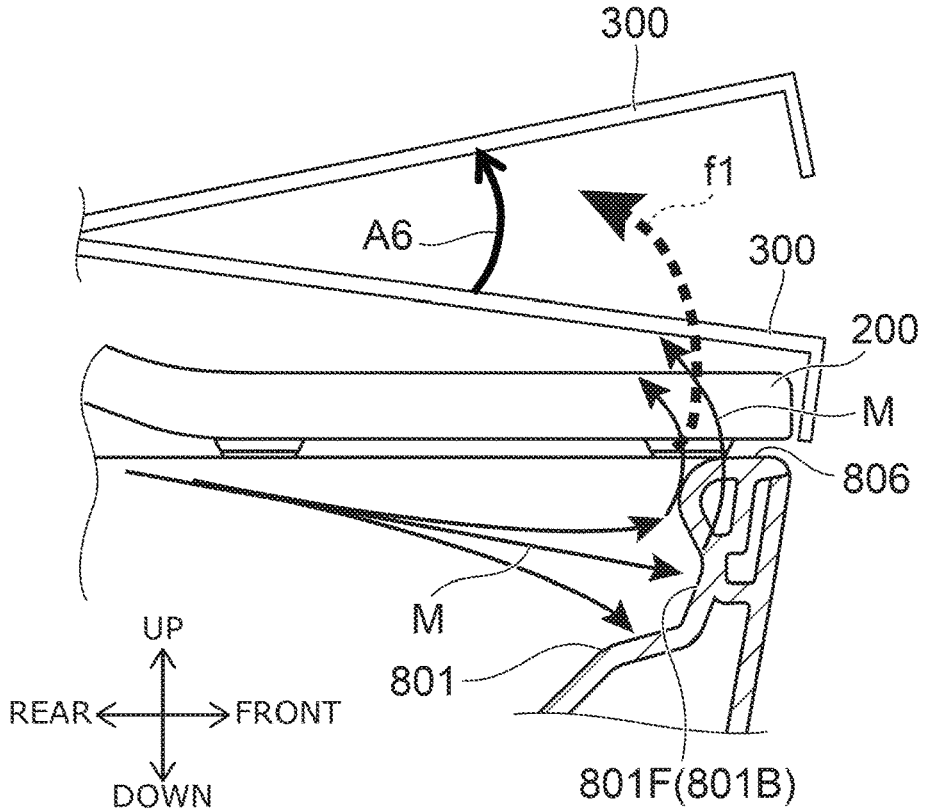
FIG. 17A and FIG. 17B are cross-sectional views illustrating operations in the pre-mist mode and the automatic toilet lid-open mode of the toilet seat device.
Figure 17B:
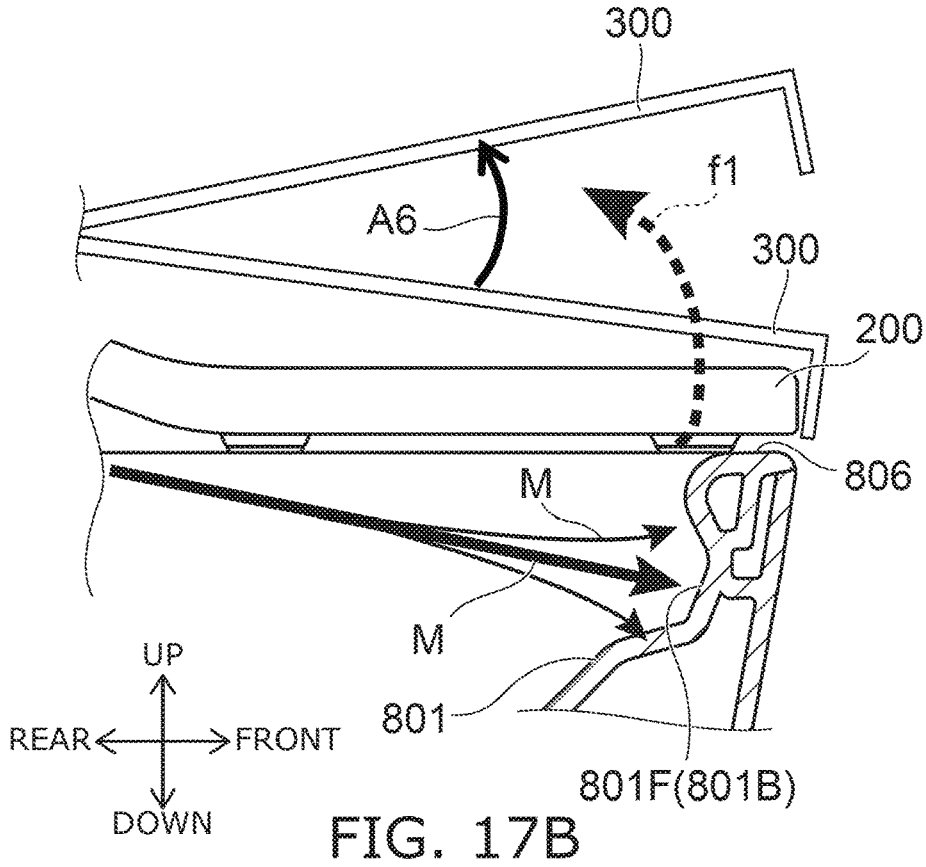

FIG. 17A and FIG. 17B are cross-sectional views illustrating operations in the pre-mist mode and the automatic toilet lid-open mode of the toilet seat device.

When the detecting sensor 402 changes from the non-detecting state to the detecting state, the controller 405 executes the automatic toilet lid-open mode by automatically controlling the toilet lid motor 512 to change from a state in which the toilet lid 300 is closed to a state in which the toilet lid 300 is open.

For example, in the case where the user is not in the toilet room, the toilet lid 300 is in the closed state. Subsequently, when the user enters the toilet room and the human body detection sensor 403 detects the entrance of the user, the controller 405 executes the automatic toilet lid-open mode. Also, the controller 405 executes the pre-mist mode when executing the automatic toilet lid-open mode.

For example, in the case where the automatic toilet lid-open mode is executed and the toilet lid 300 is opened as in arrow A6 of FIG. 17A and FIG. 17B, a rising air stream f1 is generated inside the bowl 801 and at the periphery of the bowl 801 by the open operation of the toilet lid 300. In the example of FIG. 17A, a part of the mist M sprayed by the pre-mist mode floats on the rising air stream f1 and is lifted higher than the bowl 801. In such a case, the mist that is lifted higher than the bowl 801 undesirably wets the toilet seat 200 and/or the rim upper surface 806.

Conversely, in the example of FIG. 17B, the controller 405 controls the particle size of the mist sprayed by the spray device 481 so that the mist that flies toward the front end part 801F is not lifted higher than the bowl 801 by the rising air stream f1. Specifically, for example, the controller 405 limits the rotational speed of the disk 481*b* of the spray device 481 so that the particle size of the mist does not become too small.

Thereby, even when the rising air stream f1 is generated by the automatic toilet lid-open mode, the mist can be caused to reach the non-flush region 801B while suppressing the mist wetting the rim upper surface 806 and/or the toilet seat 200. Accordingly, the dripping outside the flush toilet 800 of the mist wetting the rim upper surface 806 can be suppressed. Also, the toilet seat 200 becoming wet due to the mist can be suppressed; and the buttocks and/or the hand of the user contacting the mist wetting the toilet seat 200 when the user is seated on the toilet seat 200 or when the toilet seat 200 is rotated by hand can be suppressed.

The scope of the mist not being lifted higher than the bowl 801 by the rising air stream f1 may include not only the case where none of the mist is lifted higher than the bowl 801 but also the case where an amount of the mist slight enough not to cause discomfort of the user is lifted higher than the bowl 801.

Figure 18:
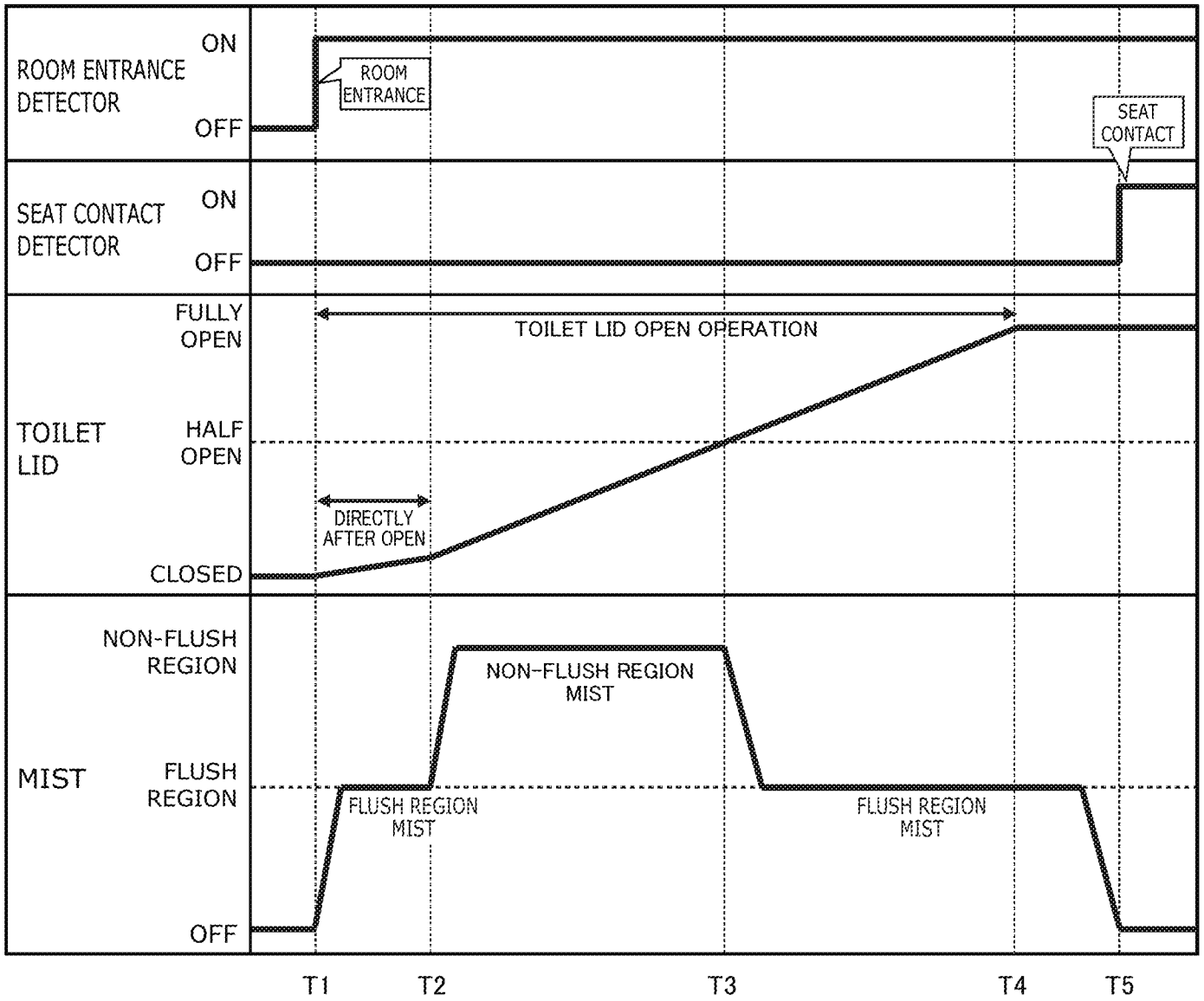
FIG. 18 is a timing chart illustrating the operations in the pre-mist mode of the toilet seat device according to the embodiment.

FIG. 18 is a timing chart illustrating the operations in the pre-mist mode of the toilet seat device according to the embodiment.

Figure 19A:
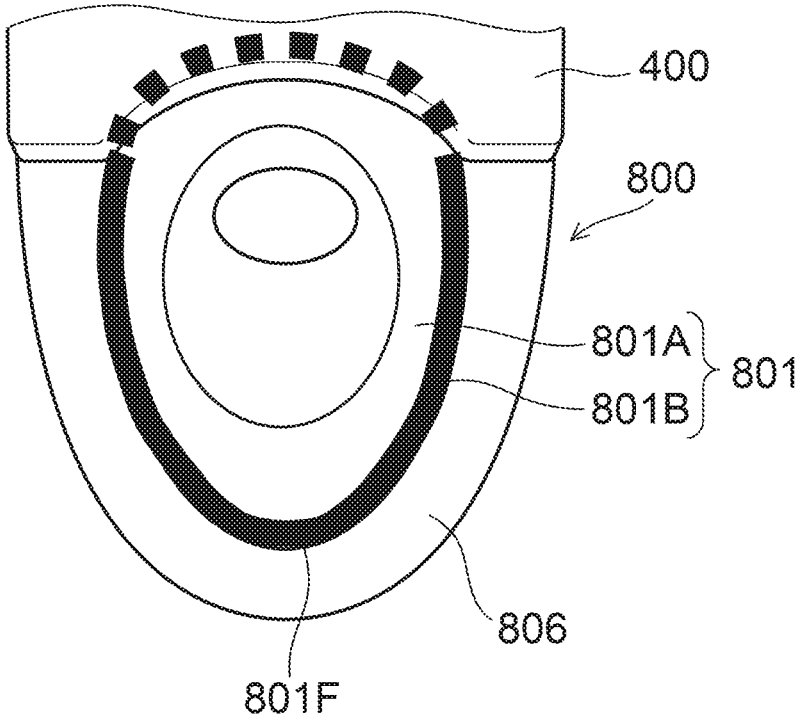
FIG. 19A and FIG. 19B are plan views illustrating the operations in the pre-mist mode of the toilet seat device according to the embodiment.
Figure 19B:
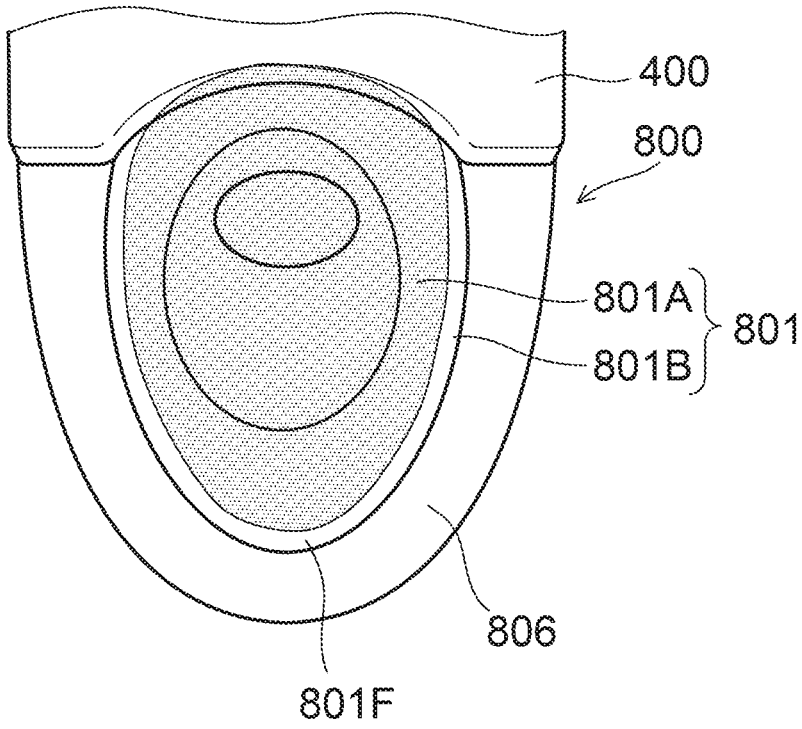

FIG. 19A and FIG. 19B are plan views illustrating the operations in the pre-mist mode of the toilet seat device according to the embodiment.

As shown in FIG. 18, for example, at a time T1, a room entrance detector such as the human body detection sensor 403 or the like detects the entrance of the user. Then, the controller 405 starts the execution of the automatic toilet lid-open mode and the pre-mist mode. Thereby, the toilet lid 300 that is in the closed state starts to open; and the spraying of the mist into the bowl 801 is started. The open operation of the toilet lid 300 continues from the time T1 to a time T4; and the toilet lid 300 is in the fully-open state at the time T4.

FIG. 19B illustrates the wetting area of the mist sprayed from the spray device 481 from the time T1 to a time T2. Thus, in the time period directly after starting the pre-mist mode and the automatic toilet lid-open mode, the controller 405 controls the spray device 481 to cause the mist to wet the region (the flush region 801A) of the bowl 801 other than the non-flush region 801B.

FIG. 19A illustrates the wetting area of the mist sprayed from the spray device 481 from the time T2 to a time T3.

From the time T2 to the time T3, the controller 405 controls the spray device 481 to cause the mist to wet the non-flush region 801B.

Subsequently, from the time T3 to the time T4, the controller 405 controls the spray device 481 to again cause the mist to wet the flush region 801A.

Then, the automatic toilet lid-open mode and the pre-mist mode end by a time T5 which is after the time T4. For example, the user is seated on the toilet seat 200 at the time T5.

The force of the rising air stream f1 generated by the open operation of the toilet lid 300 due to the automatic toilet lid-open mode easily becomes greatest directly after the toilet lid 300 is opened from the closed state (i.e., the timing when the toilet lid starts to open). Conversely, in the embodiment, the controller 405 starts the spraying of the mist toward the front end part 801F after starting the execution of the automatic toilet lid-open mode. In other words, as shown in FIG. 18, the spraying of the mist toward the front end part 801F is started at the time T2 which is after the time T1 at which the automatic toilet lid-open mode is started. Thereby, the mist that is lifted higher than the bowl 801 by the rising air stream f1 can be suppressed further.

The force of the rising air stream f1 generated by the open operation of the toilet lid 300 due to the automatic toilet lid-open mode easily becomes large when the opening speed of the toilet lid 300 is high. Conversely, as shown in FIG. 18, the controller 405 controls the toilet lid motor 512 so that the opening speed of the toilet lid 300 in a first time period directly after starting the execution of the automatic toilet lid-open mode (from the time T1 to the time T2) is lower than the opening speed of the toilet lid 300 in a second time period after the first time period (from the time T2 to the time T3). Thereby, the rising air stream f1 directly after starting the automatic toilet lid-open mode can be reduced. Accordingly, the mist that is lifted higher than the bowl 801 by the rising air stream f1 due to the automatic toilet lid-open mode can be suppressed further.

Further, the controller 405 controls the spray device 481 to cause the mist to wet the region other than the front end part 801F in a third time period directly after starting the execution of the automatic toilet lid-open mode (from the time T1 to the time T2) and cause the mist to wet the front end part 801F in a fourth time period after the third time period (from the time T2 to the time T3). Thereby, the mist that is lifted higher than the bowl 801 by the rising air stream f1 due to the automatic toilet lid-open mode can be suppressed further.

Figure 20A:
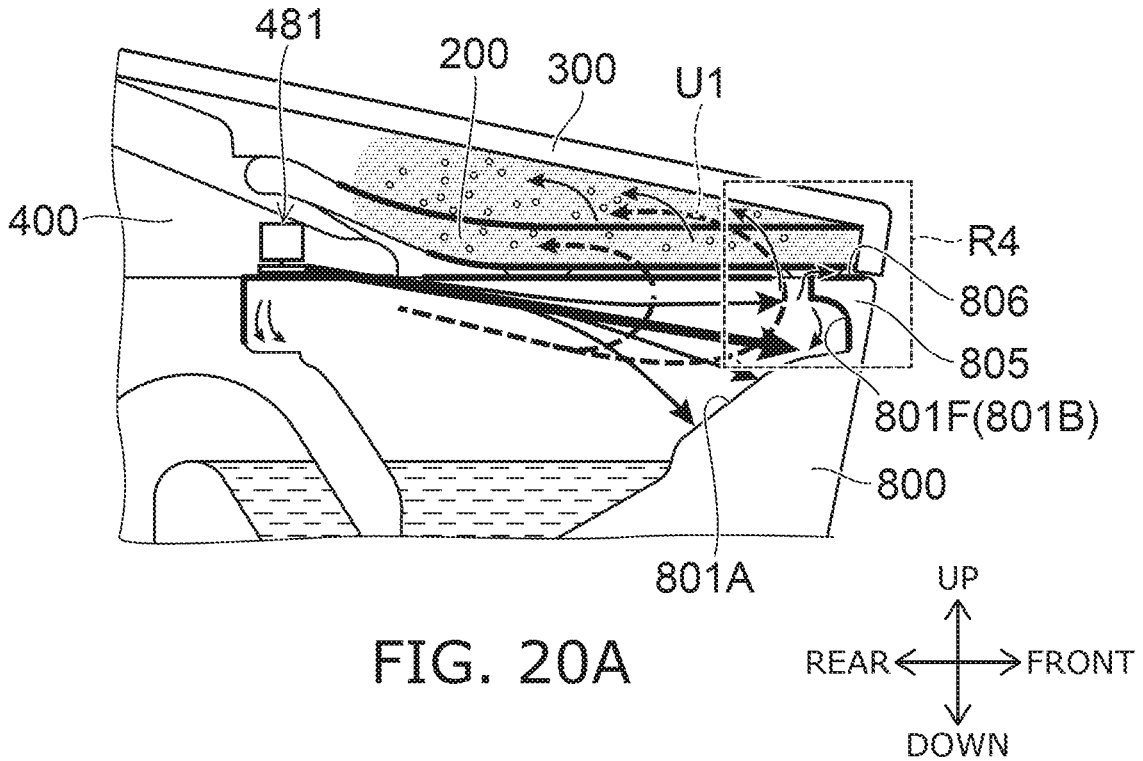
FIG. 20A and FIG. 20B are cross-sectional views illustrating operations in the after-mist mode or the manual mist mode of the toilet seat device according to the embodiment.
Figure 20B:
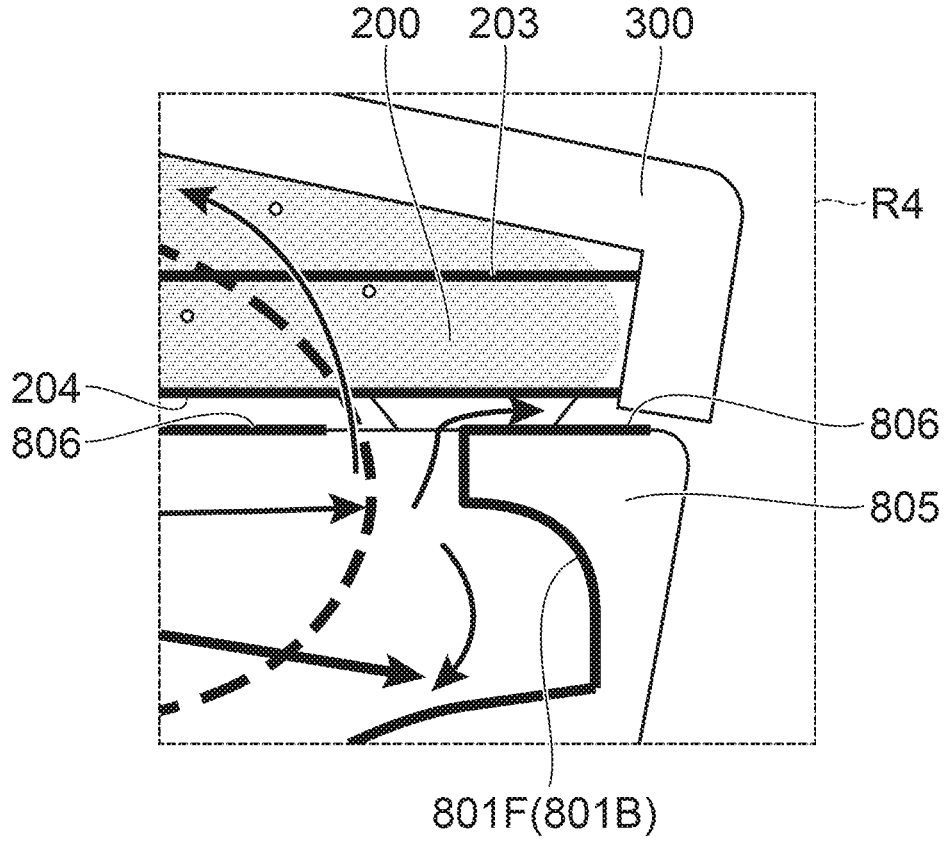

FIG. 20A and FIG. 20B are cross-sectional views illustrating operations in the after-mist mode or the manual mist mode of the toilet seat device according to the embodiment.

FIG. 20B is an enlarged view of region R4 shown in FIG. 20A.

The broken-line arrows illustrate the air stream formed by the blower 513 (this is similar for FIGS. 24A and 24B, FIGS. 27A and 27B, FIGS. 28A and 28B, and FIG. 30 described below as well). As shown in FIG. 20A, the blower 513 blows air frontward and downward in the after-mist mode or the manual mist mode. At least a part of the air blown from the blower 513 strikes the interior of the flush toilet 800 (the flush region 801A or the non-flush region 801B) and moves upward. Thereby, a rising air stream U1 that curls upward above the toilet seat 200 from the interior of the flush toilet 800 lower than the toilet seat 200 is formed.

For example, in the after-mist mode or the manual mist mode, a part of the mist is radiated from the spray device 481 toward the non-flush region 801B. Also, the mist that has the relatively large particle size wets the flush region 801A. The mist that has the relatively small particle size wets the rim upper surface 806, the toilet seat 200, the toilet lid 300, etc., due to the rising air stream U1. Thereby, every nook and corner of the toilet device 10 including the non-flush region 801B, the rim upper surface 806, the toilet seat 200, the toilet lid 300, etc., can be sterilized.

Generally, the service water may include a scale component (e.g., sodium, calcium, potassium, magnesium, etc.). In such a case, the scale component is included also in the mist of the sterilizing water generated from the service water. In the case where the mist that includes the scale component evaporates after wetting the toilet seat device 100, etc., the scale may precipitate on the part wetted by the mist; and a visible water stain may undesirably occur in a short interval.

Therefore, in one embodiment of the toilet seat device 100, the after-mist mode includes not only a mode (a second mode) of spraying the mist onto the flush toilet 800 and the toilet seat 200 but also a first mode of spraying the mist only into the flush toilet 800. In one time of performing the after-mist mode, the controller 405 executes one of the first mode or the second mode.

For example, in the first mode, the controller 405 causes the mist to wet only the interior of the flush toilet 800 (the flush region 801A and the non-flush region 801B) by stopping the blower 513 and/or controlling the particle size of the mist. In the first mode, the occurrence of bacteria and/or dirt inside the flush toilet 800 can be suppressed by spraying the mist of the sterilizing water into the flush toilet 800. Also, the scale component that is included in the mist wetting the interior of the flush toilet 800 is rinsed away by the flushing water flowing inside the flush toilet 800. Therefore, by the first mode that sprays the mist only into the flush toilet 800, the occurrence of bacteria and/or dirt inside the flush toilet 800 can be suppressed; and the occurrence of the visible water stain caused by the scale component on the rim upper surface 806, the toilet seat 200, the toilet lid 300, etc., can be suppressed.

On the other hand, in the second mode, for example, as in the example of FIGS. 20A and 20B, the controller 405 operates the blower 513 and/or controls the particle size of the mist to cause the mist to wet the toilet seat 200, etc. In the second mode, by spraying the mist of the sterilizing water into the flush toilet 800 and onto the toilet seat 200, the occurrence of bacteria and/or dirt can be suppressed not only inside the flush toilet 800 but also on the toilet seat 200.

Then, in the after-mist mode, the controller 405 executes one of the first mode or the second mode; thereby, compared to the case where the second mode is executed each time, the frequency of the mist adhering to the toilet seat 200 can be reduced. Thereby, the interval can be longer until the scale precipitating due to the adhered mist evaporating grows to become a visible water stain. Accordingly, the visible water stain that occurs in a short interval can be suppressed in the regions where the flushing water does not flow such as the toilet seat 200, the toilet lid 300, the rim upper surface 806, etc.

Although one of the first or second mode is executed in the after-mist mode, the mist of the sterilizing water is sprayed into the flush toilet 800 where the dirt occurs easily; therefore, the frequency of the cleaning by the user can be reduced reliably by executing the after-mist mode. Also, because the toilet seat 200 is a section where dirt does not occur easily compared to the interior of the flush toilet 800, visible dirt does not occur easily even without spraying the mist of the sterilizing water onto the toilet seat 200 each time.

The scope of the mist wetting only the interior of the flush toilet 800 in the first mode may include not only the case where all of the mist wets the interior of the flush toilet 800 but also the case where an amount of the mist slight enough not to contribute to the visible water stain wets the toilet seat 200, etc.

Figure 21:
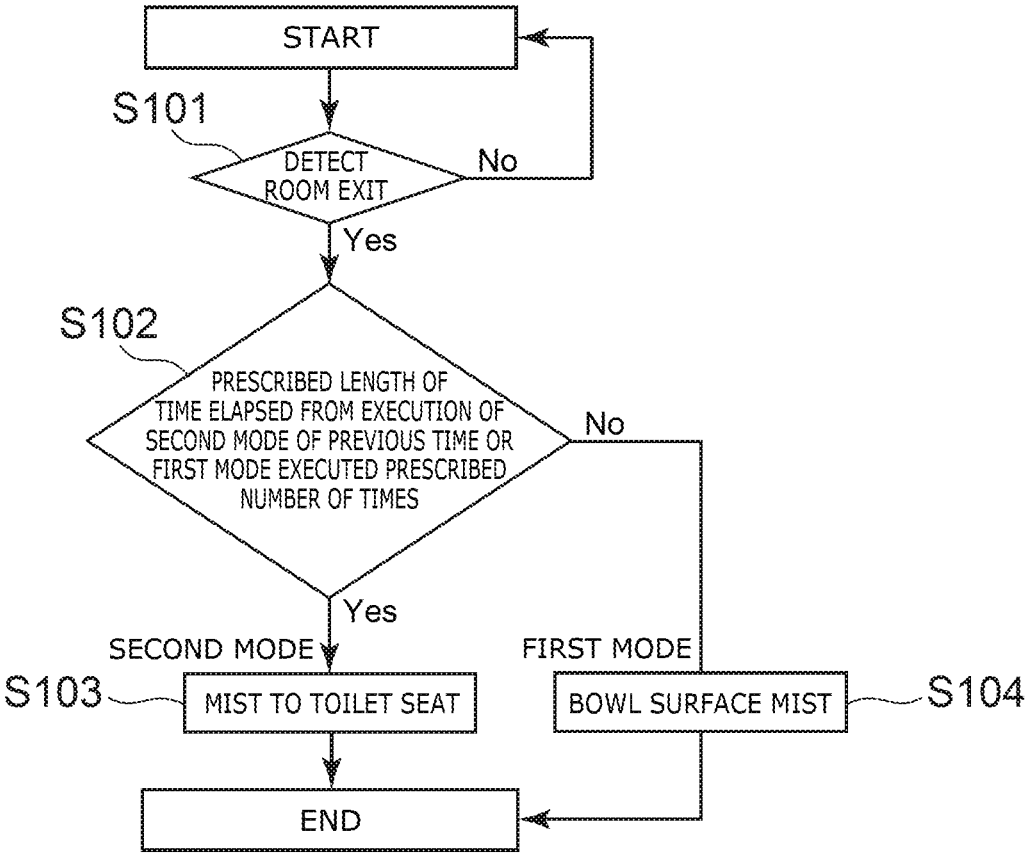
FIG. 21 is a flowchart illustrating the operations in the after-mist mode of the toilet seat device according to the embodiment.

FIG. 21 is a flowchart illustrating the operations in the after-mist mode of the toilet seat device according to the embodiment.

When the user is inside the toilet room, the after-mist mode is not executed (step S101: No). When the user exits the toilet room and the detecting sensor 402 changes from the detecting state to the non-detecting state (step S101: Yes), the controller 405 closes the toilet seat 200 and the toilet lid 300 and starts the after-mist mode.

At this time, the controller 405 automatically determines whether to execute one of the first mode or the second mode of the after-mist mode (step S102). Thereby, the burden of the user can be reduced because it is unnecessary for the user to select one of the first mode or the second mode each time.

For example, in step S102, the controller 405 performs the determination so that the execution frequency of the second mode is lower than the execution frequency of the first mode. By reducing the execution frequency of the second mode, the amount of the mist including the scale component and adhering to the toilet seat 200 can be reduced. Accordingly, the interval can be longer until the scale precipitates and grows to become a visible water stain.

More specifically, for example, in the case where a prescribed length of time has elapsed from the execution of the second mode of the previous time or in the case where the first mode has been executed a prescribed number of times after executing the second mode of the previous time (step S102: Yes), the controller 405 again executes the second mode (step S103); and the after-mist mode ends. Thereby, because the second mode is executed regularly, the occurrence of bacteria and/or dirt due to excrement can be suppressed while suppressing the visible water stain occurring in a short interval.

On the other hand, in the case where the prescribed length of time has not elapsed from the execution of the second mode of the previous time and the first mode has not been executed the prescribed number of times after executing the second mode of the previous time (step S102: No), the controller 405 executes the first mode (step S104); and the after-mist mode ends. It is sufficient to appropriately determine the prescribed length of time and/or the prescribed number of times in step S102 by considering the concentration of the scale component included in the service water and/or the spray amount of the mist so that the water stain does not occur in a short interval.

Figure 22:
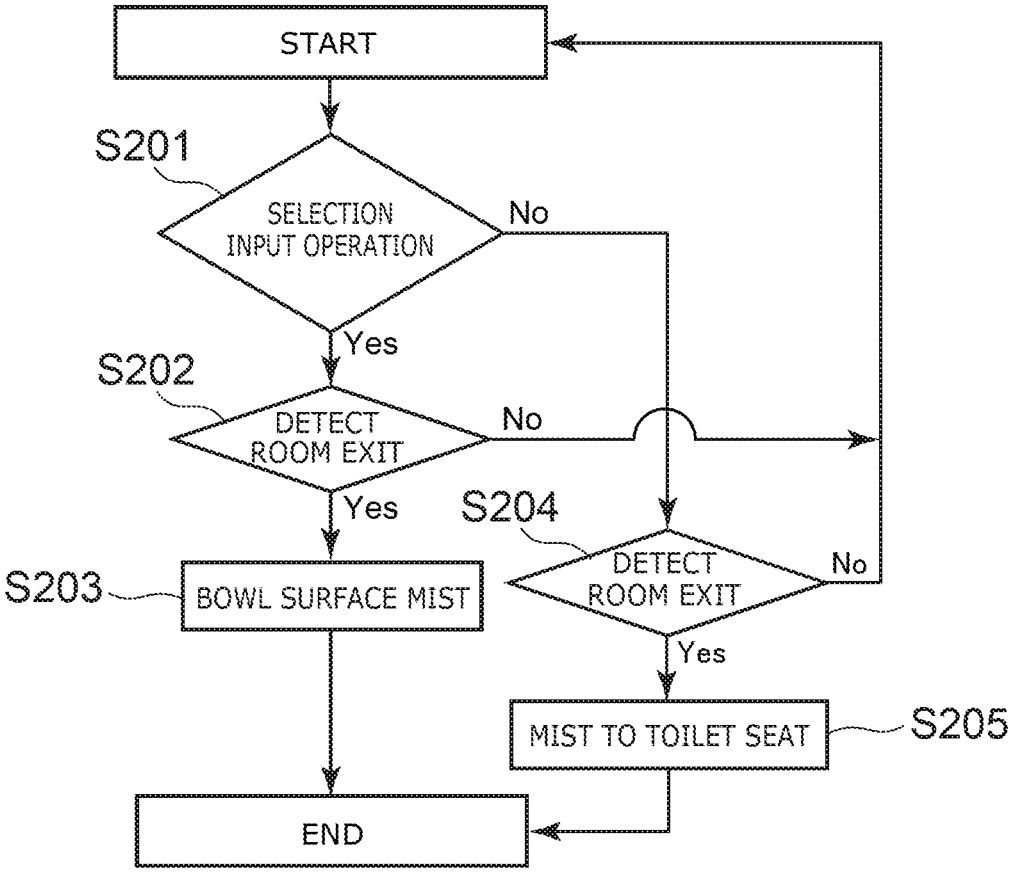
FIG. 22 is a flowchart illustrating another operation in the after-mist mode of the toilet seat device according to the embodiment.

FIG. 22 is a flowchart illustrating another operation in the after-mist mode of the toilet seat device according to the embodiment.

In the after-mist mode, the controller 405 may determine whether to execute one of the first mode or the second mode based on a selection by a manual operation of the user. For example, a switch, a button, or the like for the user to select whether to execute one of the first mode or the second mode is provided in the manual operation part 500.

The user performs the input operation of selecting the one of the first mode or the second mode by using the manual operation part 500. Then, the controller 405 receives information indicating which mode is selected by the user (step S201).

When the detecting sensor detects the exit of the user in the case where the user has selected the first mode by using the manual operation part 500 (step S202: Yes), the controller 405 executes the first mode (step S203); and the after-mist mode ends. In the case where the exit of the user is not detected, the after-mist mode is not executed (step S202: No).

When the detecting sensor detects the exit of the user in the case where the user has selected the second mode by using the manual operation part 500 (step S204: Yes), the controller 405 executes the second mode (step S205); and the after-mist mode ends. In the case where the exit of the user is not detected, the after-mist mode is not executed (step S204: No).

Thus, in the after-mist mode, the controller 405 executes one of the first mode or the second mode based on the selection of the user using the manual operation part 500. That is, the user can preset whether to execute the one of the first mode or the second mode by operating the manual operation part 500.

For example, if the setting is not modified, the controller 405 executes one of the first mode or the second mode in the after-mist mode each time. The concentration of the scale component included in the service water is different according to the geographical region. In a geographical region where the concentration of the scale component is low, even in the case where the second mode that sprays the mist onto the toilet seat 200 is executed each time, the interval is long until the visible water stain caused by the scale component occurs. In such a geographical region, by executing the second mode in the after-mist mode, the occurrence of bacteria and/or dirt due to excrement can be suppressed; and the frequency of the cleaning can be reduced. On the other hand, in a geographical region where the concentration of the scale component is high, in the case where the second mode that sprays the mist also onto the toilet seat 200 is executed, the visible water stain that is caused by the scale component occurs easily in a short interval. In such a geographical region, the frequency of the cleaning can be reduced by not executing the second mode that sprays the mist onto the toilet seat 200. By the user selecting whether to execute one of the first mode or the second mode by using the manual operation part 500, the frequency of the cleaning can be reduced in both a geographical region where the concentration of the scale component included in the service water is high and a geographical region where the concentration is low.

Also, a switch, a button, or the like for the user to select at least one of the execution frequency of the first mode or the execution frequency of the second mode may be provided in the manual operation part 500. For example, in the case where the second mode is executed when the prescribed length of time has elapsed from the execution of the second mode of the previous time, the user can select the prescribed length of time by using the manual operation part 500. Also, for example, in the case where the second mode is executed when the first mode has been executed the prescribed number of times after executing the second mode of the previous time, the user can select the prescribed number of times by using the manual operation part 500. The controller 405 executes at least one of the first mode or the second mode based on the selection (the set frequency) of the user using the manual operation part 500. Thereby, the execution frequency of the first mode or the execution frequency of the second mode can be selected to reduce the frequency of the cleaning according to the concentration of the scale component included in the service water of the geographical region where the toilet seat device 100 is used, etc.

Figure 23:
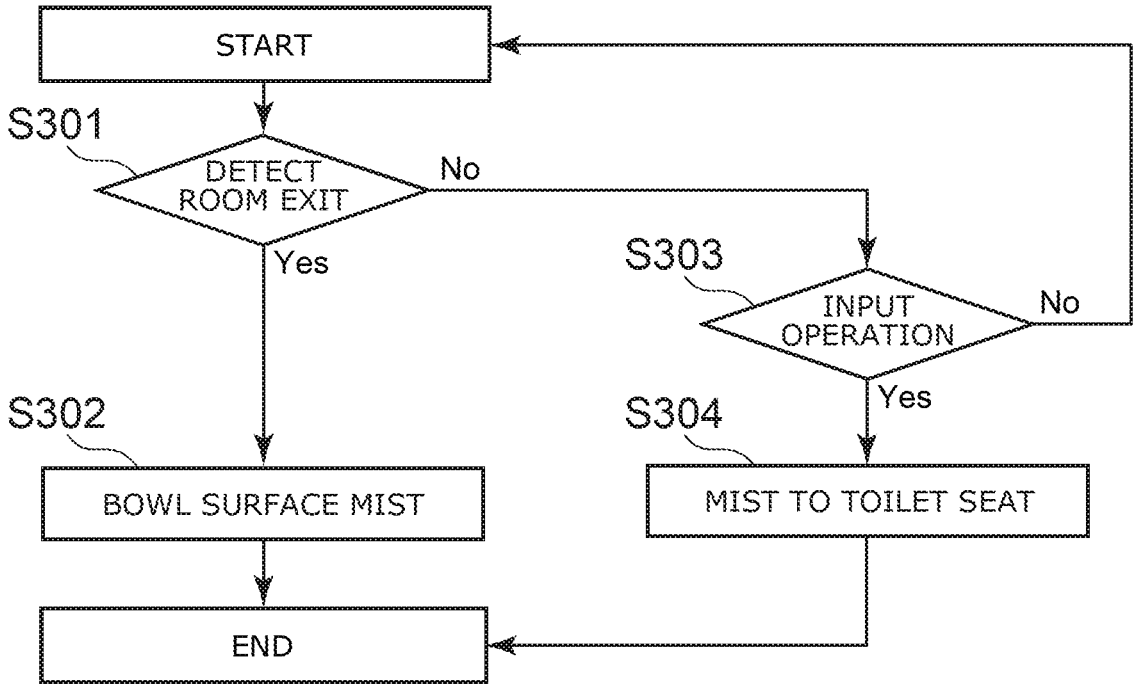
FIG. 23 is a flowchart illustrating another operation in the after-mist mode of the toilet seat device according to the embodiment.

FIG. 23 is a flowchart illustrating another operation in the after-mist mode of the toilet seat device according to the embodiment.

In the example shown in FIG. 23, the after-mist mode controls the mist of the sterilizing water to be sprayed only into the flush toilet 800. In other words, the first mode described above is executed each time. FIG. 23 also illustrates the operation in the manual mist mode. In the example, similarly to the example described in reference to FIG. 9 and FIGS. 20A and 20B, the manual mist mode sprays the mist of the sterilizing water into the flush toilet 800 and onto the toilet seat 2001.

When the user exits the toilet room and the detecting sensor 402 changes from the detecting state to the non-detecting state (step S301: Yes), the controller 405 starts the after-mist mode. The mist of the sterilizing water is sprayed only into the flush toilet 800 (step S302); and the after-mist mode ends. In the after-mist mode, the visible water stain that occurs in a short interval due to the scale component can be suppressed by not spraying the sterilizing water onto the toilet seat 200, etc.

When the user has not exited the toilet room (step S301: No) and when the user operates the manual operation part 500 (step S303: Yes), the controller 405 starts the manual mist mode. The mist of the sterilizing water is sprayed onto the flush toilet 800 and the toilet seat 200 (step S304); and the manual mist mode ends. In the case where the user does not operate the manual operation part 500 (step S303: No), the manual mist mode is not executed.

Because the manual mist mode is a mode in which the user wipes using paper or the like after the mist, there is a tendency for the execution frequency of the manual mist mode to be low compared to the execution frequency of the after-mist mode. Therefore, as in the example shown in FIG. 23, the frequency of the mist adhering to the toilet seat 200 can be reduced by spraying the mist only into the flush toilet 800 in the after-mist mode and by spraying the mist into the flush toilet 800 and onto the toilet seat 200 in the manual mist mode. Thereby, the interval can be longer until the scale component precipitating due to the adhered mist evaporating grows to become a visible water stain. Accordingly, the visible water stain that occurs in a short interval can be suppressed in the regions such as the toilet seat 200, etc., where the flushing water does not flow.

Figure 24A:
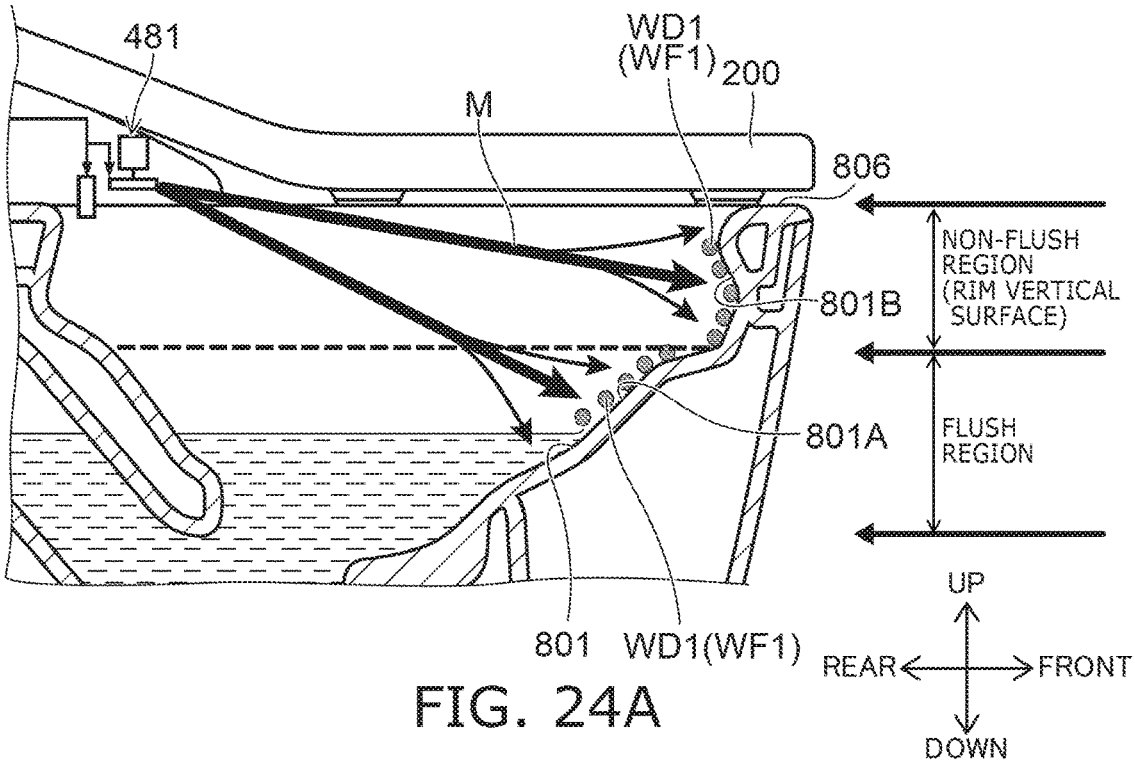
FIG. 24A and FIG. 24B are cross-sectional views illustrating operations in the pre-mist mode and the after-mist mode of the toilet seat device according to the embodiment.
Figure 24B:
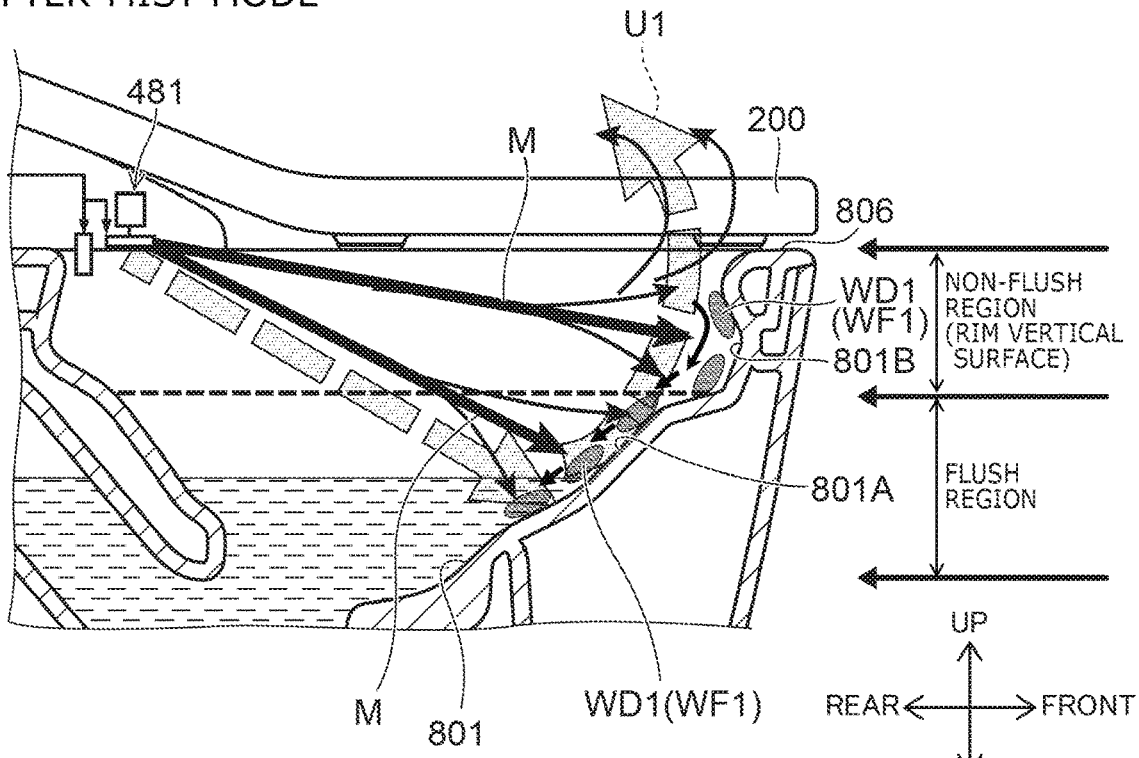

FIG. 24A and FIG. 24B are cross-sectional views illustrating operations in the pre-mist mode and the after-mist mode of the toilet seat device according to the embodiment.

As shown in FIG. 24A, the pre-mist mode sprays the mist of the service water or the sterilizing water onto the flush region 801A and the non-flush region 801B; and water droplets WD1 or a water film WF1 form in the flush region 801A and the non-flush region 801B due to the service water or the sterilizing water accumulating. For example, the controller 405 causes the wetting mist to accumulate by reducing the particle size of the mist and/or controlling the wetting amount of the mist in the pre-mist mode. It is unnecessary for all of the wetting mist to accumulate; and it is sufficient for enough of the mist to accumulate so that the clinging or the adhesion of excrement at the flush region 801A and the non-flush region 801B can be suppressed.

Subsequently, the after-mist mode is executed when the user exits the toilet room. As shown in FIG. 24B, the after-mist mode causes the mist of the sterilizing water to wet the water droplets WD1 or the water film WF1 formed in the non-flush region 801B in the pre-mist mode. Thereby, the after-mist mode rinses away the water droplets WD1 or the water film WF1 by increasing the volume of the water droplets WD1 or the water film WF1. In other words, the water droplets WD1 or the water film WF1 that are formed in the non-flush region 801B flow down into the flush region 801A by the volume increasing and the weight increasing. In the pre-mist mode, it is unnecessary to rinse away all of the mist wetting the water droplets WD1 or the water film WF1 formed in the non-flush region 801B; and the occurrence of the visible water stain can be delayed by rinsing away the majority of the mist.

The mist that is sprayed in the pre-mist mode accumulates in the flush region 801A and the non-flush region 801B; for example, the water droplets WD1 or the water film WF1 are not rinsed away until the after-mist mode is executed. Thereby, compared to the case where only the interior of the bowl 801 is wet, the clinging and/or the adhesion of excrement can be suppressed further. Also, in the after-mist mode, the mist of the sterilizing water sprayed from the spray device 481 wets the non-flush region 801B. Thereby, the occurrence of bacteria and/or dirt due to excrement not rinsed away by the flushing water can be suppressed.

In the case where the water droplets WD1 or the water film WF1 that are formed by the pre-mist mode remain adhered to the non-flush region 801B, scale may precipitate due to the evaporation of the water droplets WD1 or the water film WF1; and a water stain may occur in the non-flush region 801B. Conversely, the water droplets WD1 or the water film WF1 that remain in the non-flush region 801B can be suppressed by the after-mist mode rinsing away the water droplets WD1 or the water film WF1 formed in the non-flush region 801B. Thereby, the occurrence of the water stain can be suppressed. Accordingly, the visible water stain that occurs in a short interval in the non-flush region 801B can be suppressed while suppressing the occurrence of bacteria and/or dirt in a wide area of the flush toilet 800 including the non-flush region 801B.

Figure 25A:
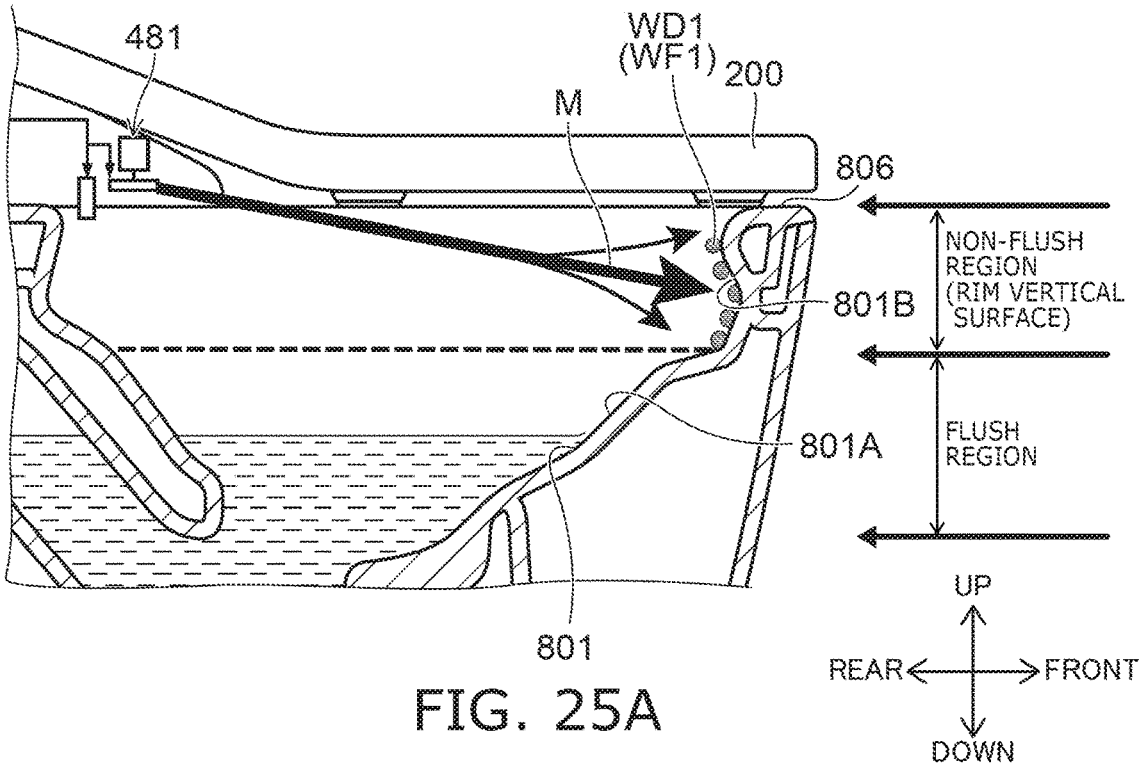
FIG. 25A and FIG. 25B are cross-sectional views illustrating other operations in the pre-mist mode of the toilet seat device according to the embodiment.
Figure 25B:
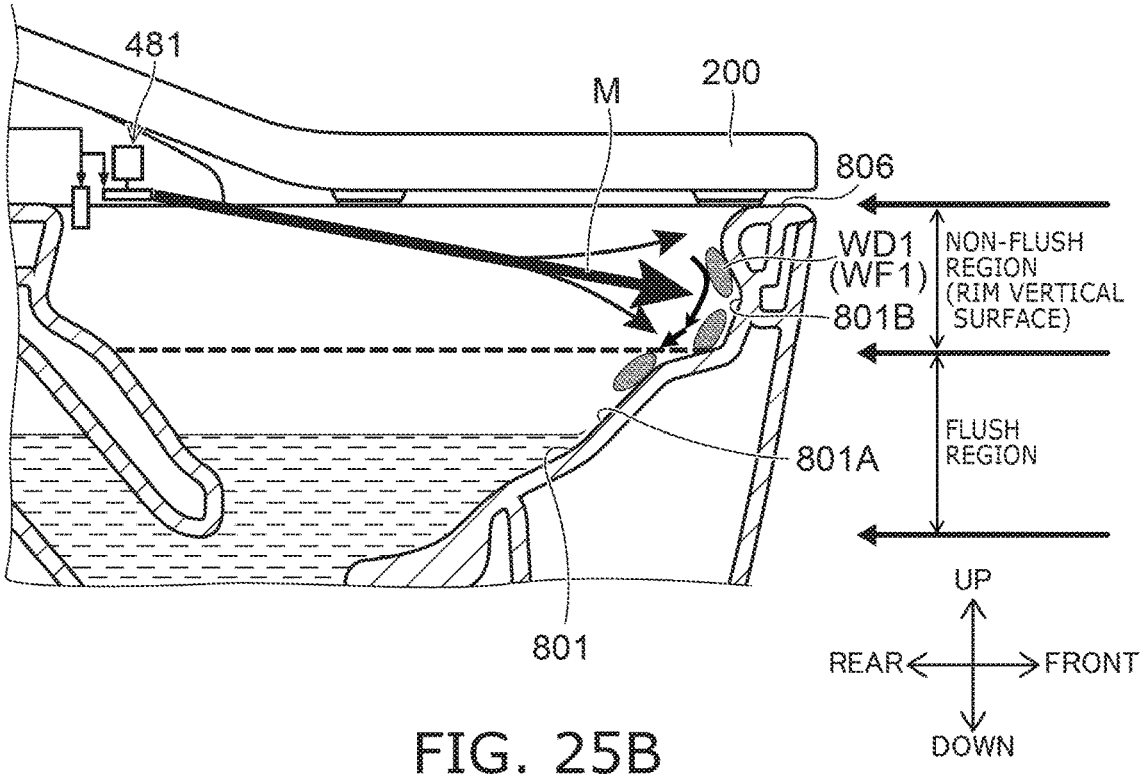

FIG. 25A and FIG. 25B are cross-sectional views illustrating other operations in the pre-mist mode of the toilet seat device according to the embodiment.

In the example, the pre-mist mode includes the first process shown in FIG. 25A and the second process shown in FIG. 25B.

As shown in FIG. 25A, the first process causes the mist to wet the non-flush region 801B and forms the water droplets WD1 or the water film WF1 in the non-flush region 801B. The first process may cause the mist also to wet the flush region 801A to form the water droplets or the water film.

As shown in FIG. 25B, the second process causes the mist to wet the water droplets WD1 or the water film WF1 formed in the non-flush region 801B in the first process. Thereby, the second process rinses away the water droplets WD1 or the water film WF1 by increasing the volume of the water droplets WD1 or the water film WF1. In other words, the water droplets WD1 or the water film WF1 that are formed in the non-flush region 801B flow down onto the flush region 801A due to the volume increasing and the weight increasing. In the pre-mist mode, the first process and the second process may be temporally continuous.

For example, in the case where the first process of the pre-mist mode is executed due to the detecting sensor 402 detecting the user by an erroneous room entrance, etc., the water droplets WD1 or the water film WF1 that are formed in the non-flush region 801B are caused to flow down by executing the second process.

The water droplets WD1 or the water film WF1 that remain in the non-flush region 801B can be suppressed by the second process rinsing away the water droplets WD1 or the water film WF1 formed in the non-flush region 801B by the first process. Thereby, the occurrence of the water stain can be suppressed. Accordingly, the visible water stain that occurs in a short interval in the non-flush region 801B can be suppressed while suppressing the occurrence of bacteria and/or dirt in a wide area of the flush toilet 800 including the non-flush region 801B.

The particle size and/or the flow rate of the mist are large in the case where the mist is sprayed so that the wetting mist flows off soon in the pre-mist mode; therefore, there is an undesirable risk that the mist may splatter inside the bowl 801 and scatter outside the flush toilet 800. Conversely, in the example, after the water droplets WD1 or the water film WF1 are formed by the first process, the water droplets WD1 or the water film WF1 are caused to flow down by increasing the volume of the water droplets WD1 or the water film WF1 by the second process. Thereby, the scattering of the mist outside the flush toilet can be suppressed.

Figure 26A:
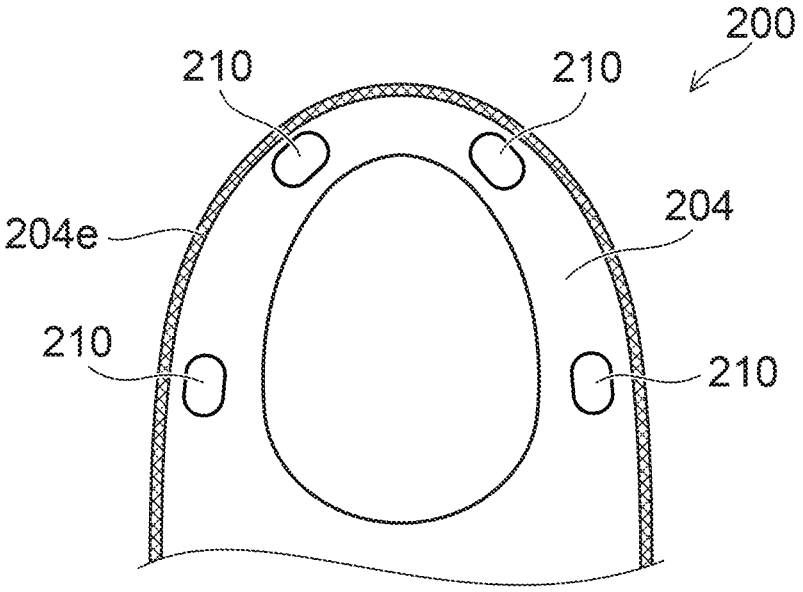
FIG. 26A and FIG. 26B are plan views illustrating the flush toilet and the toilet seat according to the embodiment.
Figure 26B:
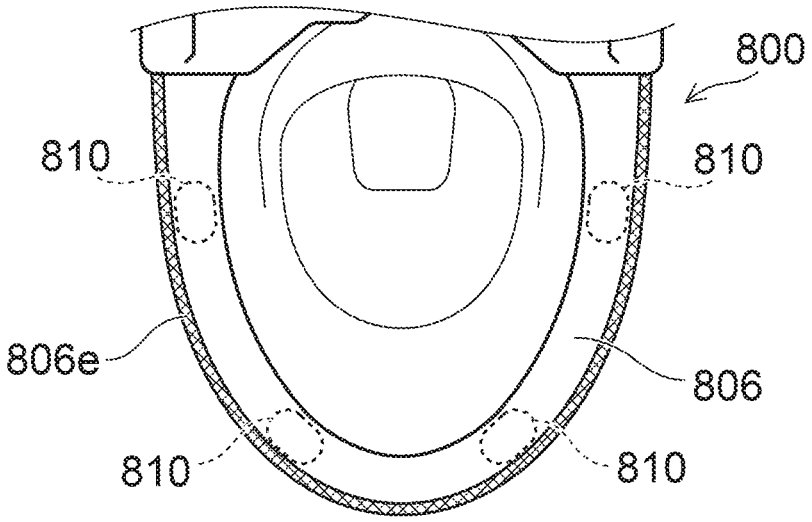

FIG. 26A and FIG. 26B are plan views illustrating the flush toilet and the toilet seat according to the embodiment.

FIG. 26A illustrates the back surface 204 side of the toilet seat 200. A toilet seat leg part 210 is provided at the back surface 204 of the toilet seat 200. The toilet seat leg part 210 is provided to protrude from the back surface 204 and contacts the rim upper surface 806 of the flush toilet 800 in the state in which the toilet seat 200 is closed. Although a total of four toilet seat leg parts 210 is provided in the example, the number and/or the configurations of the toilet seat leg parts 210 are arbitrary.

As shown in FIG. 26B, the rim upper surface 806 of the flush toilet 800 includes a region 810 contacted by the toilet seat leg part 210 in the state in which the toilet seat 200 is closed.

In the case where the mist mode (e.g., the after-mist mode or the manual mist mode) sprays the mist of the sterilizing water onto the rim upper surface 806 and the toilet seat 200, there is an undesirable risk that the mist may scatter outside the flush toilet 800 and the toilet seat device 100 when the toilet lid 300 is in the open state. Therefore, to suppress the scattering of the mist, it is desirable for the toilet lid 300 and the toilet seat 200 to be in the closed state. On the other hand, in the mist mode that sprays the mist of the sterilizing water onto the rim upper surface 806 and the toilet seat 200, when the toilet lid 300 and the toilet seat 200 are in the closed state, the region 810 of the rim upper surface 806 and the toilet seat leg part 210 contact each other; therefore, the mist cannot wet the region 810 and the toilet seat leg part 210. Also, in the state in which the toilet lid 300 and the toilet seat 200 are closed, the rim upper surface 806 and the toilet seat 200 are proximal to each other; therefore, the mist also does not easily reach an outer perimeter part 204*e* of the back surface 204 of the toilet seat 200 and/or an outer perimeter part 806*e* of the rim upper surface 806.

Therefore, in one embodiment of the toilet seat device 100, the after-mist mode or the manual mist mode includes the first process and the second process described below.

Figure 27A:
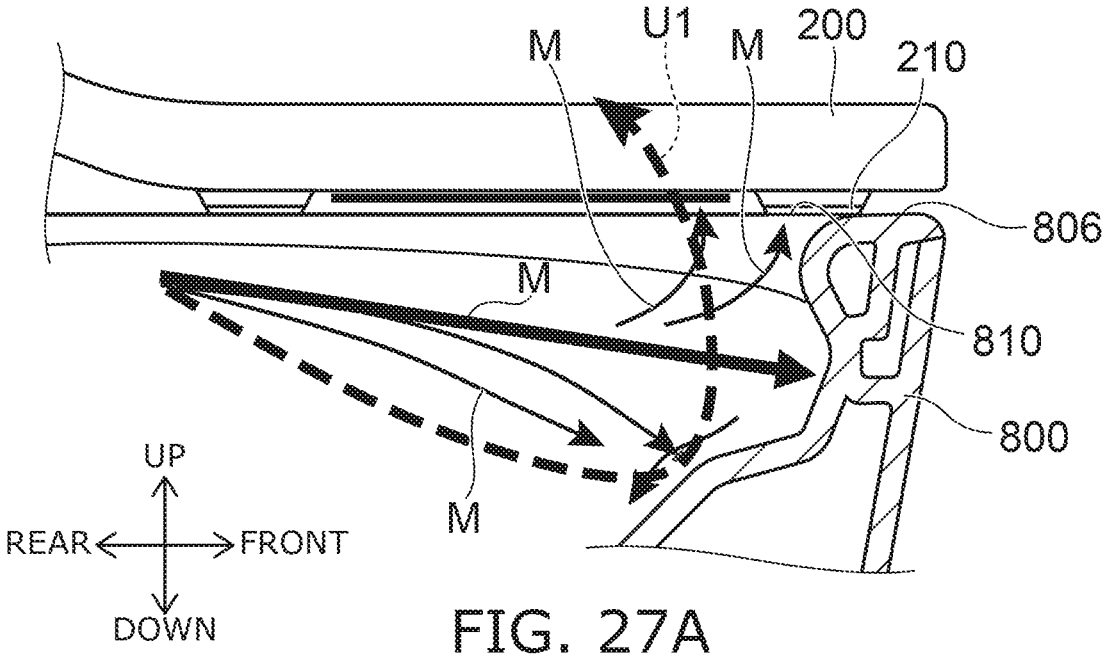
FIG. 27A and FIG. 27B are cross-sectional views illustrating operations in the after-mist mode or the manual mist mode of the toilet seat device according to the embodiment.
Figure 27B:
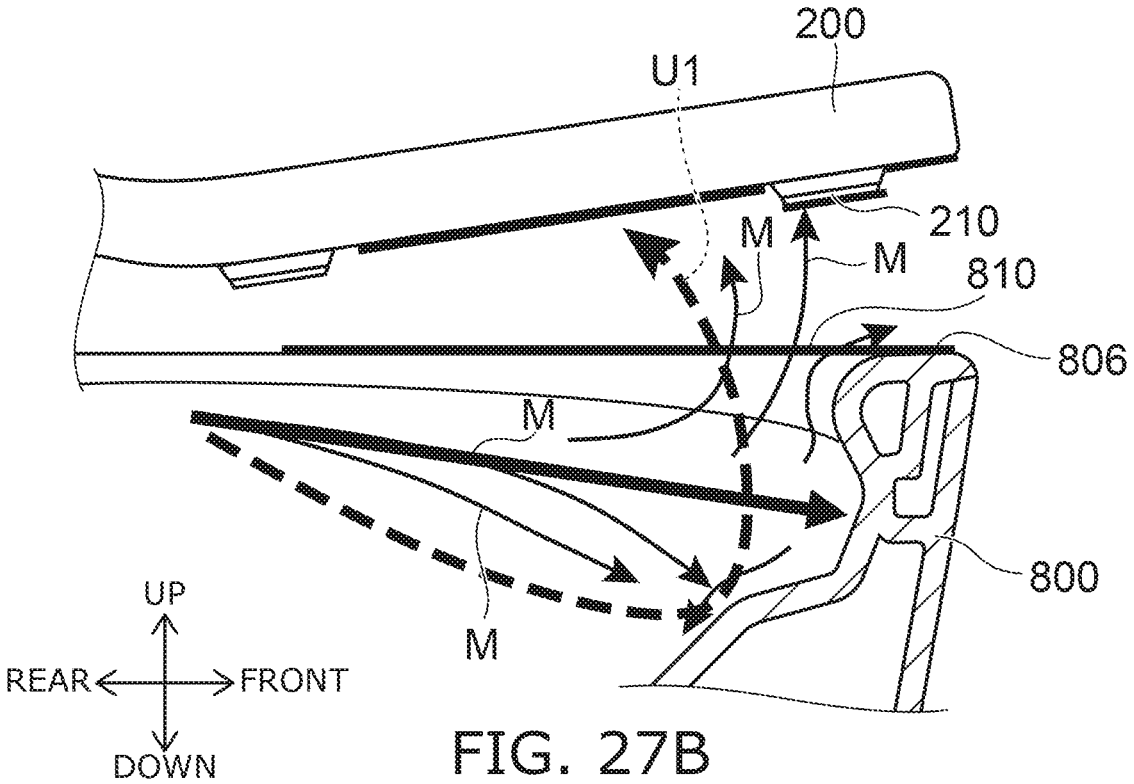

FIG. 27A and FIG. 27B are cross-sectional views illustrating operations in the after-mist mode or the manual mist mode of the toilet seat device according to the embodiment.

FIG. 27A illustrates the first process; and FIG. 27B illustrates the second process. In the first process as shown in FIG. 27A, the controller 405 controls the toilet seat motor 511 and/or the toilet lid motor 512 to change to the state in which the toilet seat 200 and the toilet lid 300 are closed (the fully-closed state). In the state in which the toilet lid 300 is closed, the first process sprays the mist of the sterilizing water onto the rim upper surface 806 and the toilet seat 200. Because the toilet lid 300 is in the closed state in the first process, much of the mist can be sprayed onto the rim upper surface 806 and/or the toilet seat 200 while suppressing the scattering of the mist outside the flush toilet 800 and the toilet seat device 100.

In the second process as shown in FIG. 27B, the controller 405 controls the toilet seat motor 511 and/or the toilet lid motor 512 to change to the state in which the toilet seat 200 and the toilet lid 300 are open. In the state in which the toilet seat 200 and the toilet lid 300 are open, the second process sprays the mist of the sterilizing water onto the rim upper surface 806 and the toilet seat 200. Thereby, the second process sprays the mist of the sterilizing water onto the region 810 where the rim upper surface 806 is contacted by the toilet seat leg part 210. Because the toilet seat 200 is in the open state in the second process, the mist also can be caused to wet the toilet seat leg part 210 and/or the region 810 of the rim upper surface 806. The mist also easily wets the outer perimeter part 806*e* of the rim upper surface 806 and the outer perimeter part 204*e* of the toilet seat 200.

In one time of performing the after-mist mode and the manual mist mode, for example, the controller 405 executes the second process after executing the first process. Or, the first process may be executed after the second process. By performing the first process and the second process described above, the occurrence of bacteria and/or dirt can be suppressed by causing much of the mist to wet a wide area including the region 810 where the rim upper surface 806 is contacted by the toilet seat leg part 210 while suppressing the scattering of the mist outside the flush toilet 800 and the toilet seat device 100.

In the second process of the after-mist mode or the manual mist mode, the scope of the toilet seat 200 and the toilet lid 300 being in the open state includes not only the fully-open state but also a half-open state. The fully-open state is a state in which the degree of opening is a maximum in normal use. The half-open state is a state in which the degree of opening is smaller than that of the fully-open state. That is, the half-open state is a state between the fully-open state and the fully-closed state and is not limited to the degree of opening being half of that of the fully-open state.

In the second process, when the toilet seat 200 is in the fully-open state, it is difficult to cause the mist to wet the toilet seat leg part 210 because the toilet seat leg part 210 is distal to the rim upper surface 806. Conversely, in the second process in the example shown in FIG. 27B, the controller 405 controls the toilet seat motor 511 so that the toilet seat 200 is in the half-open state. Therefore, the distance between the toilet seat leg part 210 and the rim upper surface 806 can be shortened compared to the case where the toilet seat 200 is in the fully-open state. Thereby, in the second process, the mist of the sterilizing water can be caused to wet even the toilet seat leg part 210 which is difficult for the mist of the sterilizing water to reach in the first process.

For example, the controller 405 controls the spray device 481 to cause the total amount (ml) of the mist of the sterilizing water sprayed toward the rim upper surface 806 side in the first process to be more than the total amount (ml) of the mist of the sterilizing water sprayed toward the rim upper surface 806 side in the second process. For example, the total amount of the mist of the sterilizing water wetting the rim upper surface 806 in the first process is more than the total amount of the mist of the sterilizing water wetting the rim upper surface 806 in the second process. The occurrence of bacteria and/or dirt at the rim upper surface 806 can be suppressed further by causing much of the mist of the sterilizing water to wet the rim upper surface 806 in the first process. At this time, in the first process, the toilet lid 300 is in the closed state; therefore, the risk of the mist undesirably scattering outside the flush toilet 800 and the toilet seat device 100 is small even when much of the mist is sprayed. On the other hand, compared to the first process, the mist easily scatters outside the flush toilet 800 and the toilet seat device 100 in the second process in which the toilet lid 300 and the toilet seat 200 are open. Therefore, the scattering of the mist outside the flush toilet 800 and the toilet seat device 100 can be suppressed by causing a relatively small amount of the mist to wet the rim upper surface 806 in the second process.

Specifically, for example, the controller 405 controls the spray device 481 so that the time of spraying the mist of the sterilizing water toward the rim upper surface 806 side in the first process is longer than the time of spraying the mist of the sterilizing water toward the rim upper surface 806 side in the second process. In other words, for example, the time of executing the first process is longer than the time of executing the second process. Thereby, the total amount of the mist sprayed toward the rim upper surface 806 side in the first process can be more than the total amount of the mist sprayed toward the rim upper surface 806 side in the second process.

Figure 28A:
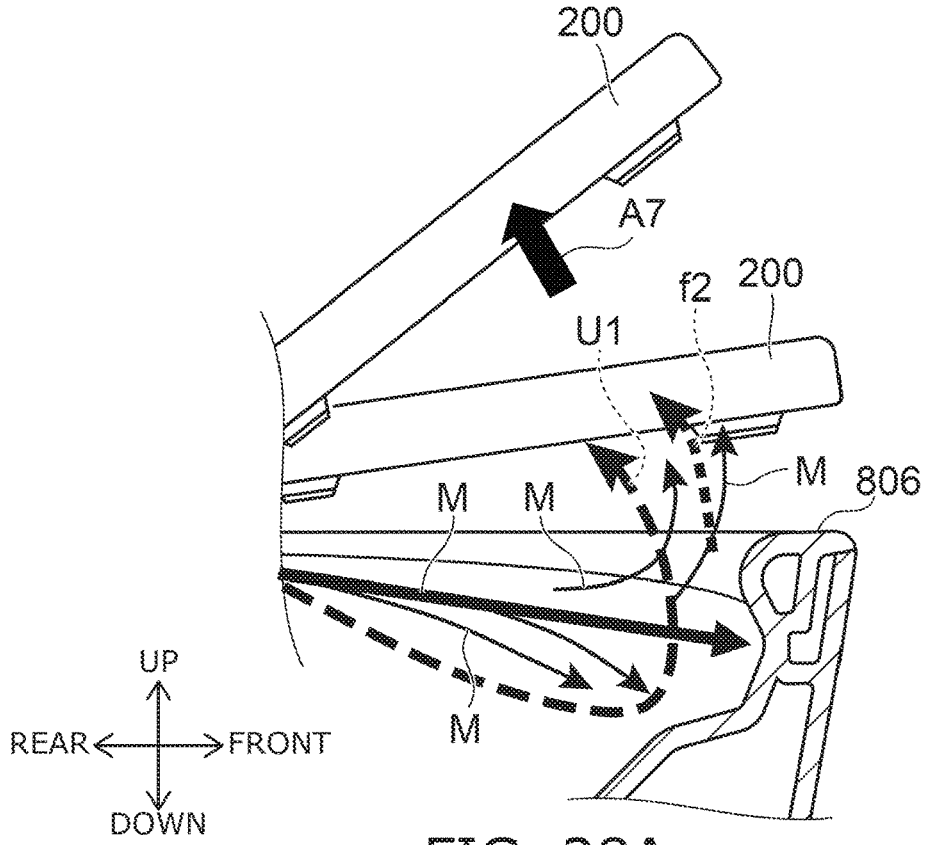
FIG. 28A and FIG. 28B are cross-sectional views illustrating operations in the second process of the after-mist mode or the manual mist mode of the toilet seat device according to the embodiment.
Figure 28B:
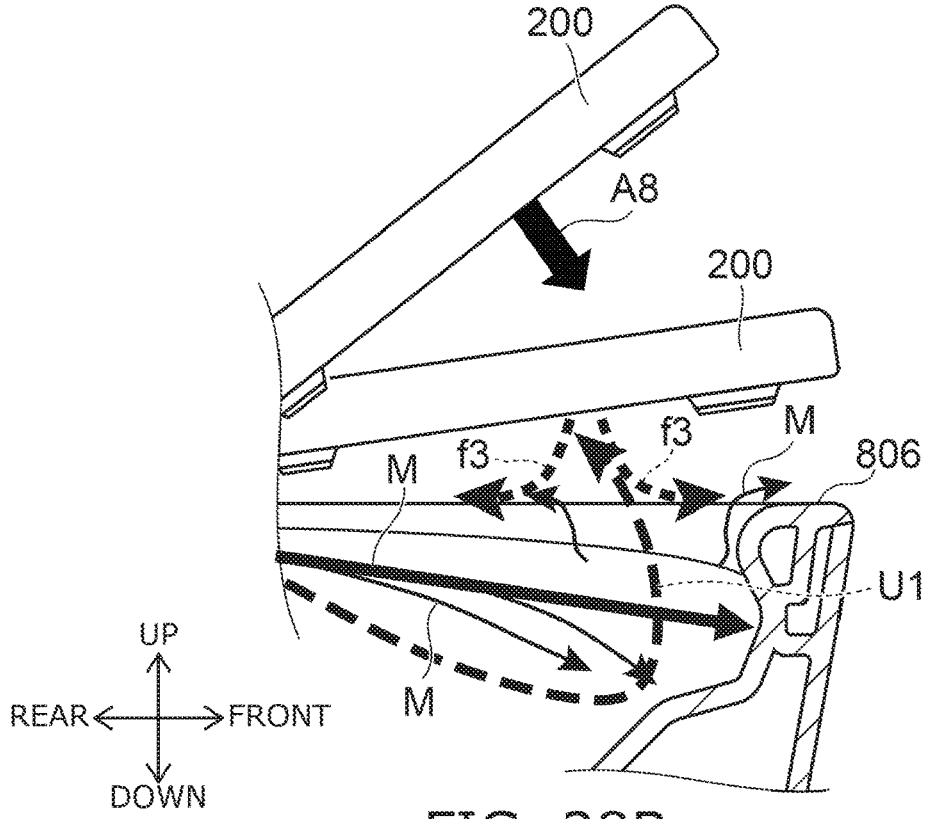

FIG. 28A and FIG. 28B are cross-sectional views illustrating operations in the second process of the after-mist mode or the manual mist mode of the toilet seat device according to the embodiment.

In the second process of the after-mist mode or the manual mist mode, the controller 405 may control the toilet seat motor 511 and the toilet lid motor 512 to move at least one of the toilet seat 200 or the toilet lid 300 in a state in which the mist of the sterilizing water is sprayed toward the rim upper surface 806 side. FIG. 28A shows a state in which the toilet seat 200 is moved in the open direction in the second process. As in arrow A7, an air stream f2 (a rising air stream) is generated at the vicinity of the rim upper surface 806 by rotating the toilet seat 200 upward from below. The mist of the sterilizing water can be caused to wet a wider area of the rim upper surface 806 because the mist of the sterilizing water floats on the air stream f2.

FIG. 28B shows a state in which the toilet seat 200 is moved in the close direction in the second process. As in arrow A8, an air stream f3 is generated at the vicinity of the rim upper surface 806 when the toilet seat 200 is rotated downward from above. Thereby, the mist that is at the vicinity of the rim upper surface 806 can be diffused; and the mist of the sterilizing water can be caused to wet a wider area of the rim upper surface 806.

Although the controller 405 moves the toilet seat 200 in the example shown in FIG. 28A and FIG. 28B, the toilet lid 300 may be moved similarly. In the second process, the controller 405 may stop one of the toilet seat 200 or the toilet lid 300 and move the other, or may move both.

Figure 29:
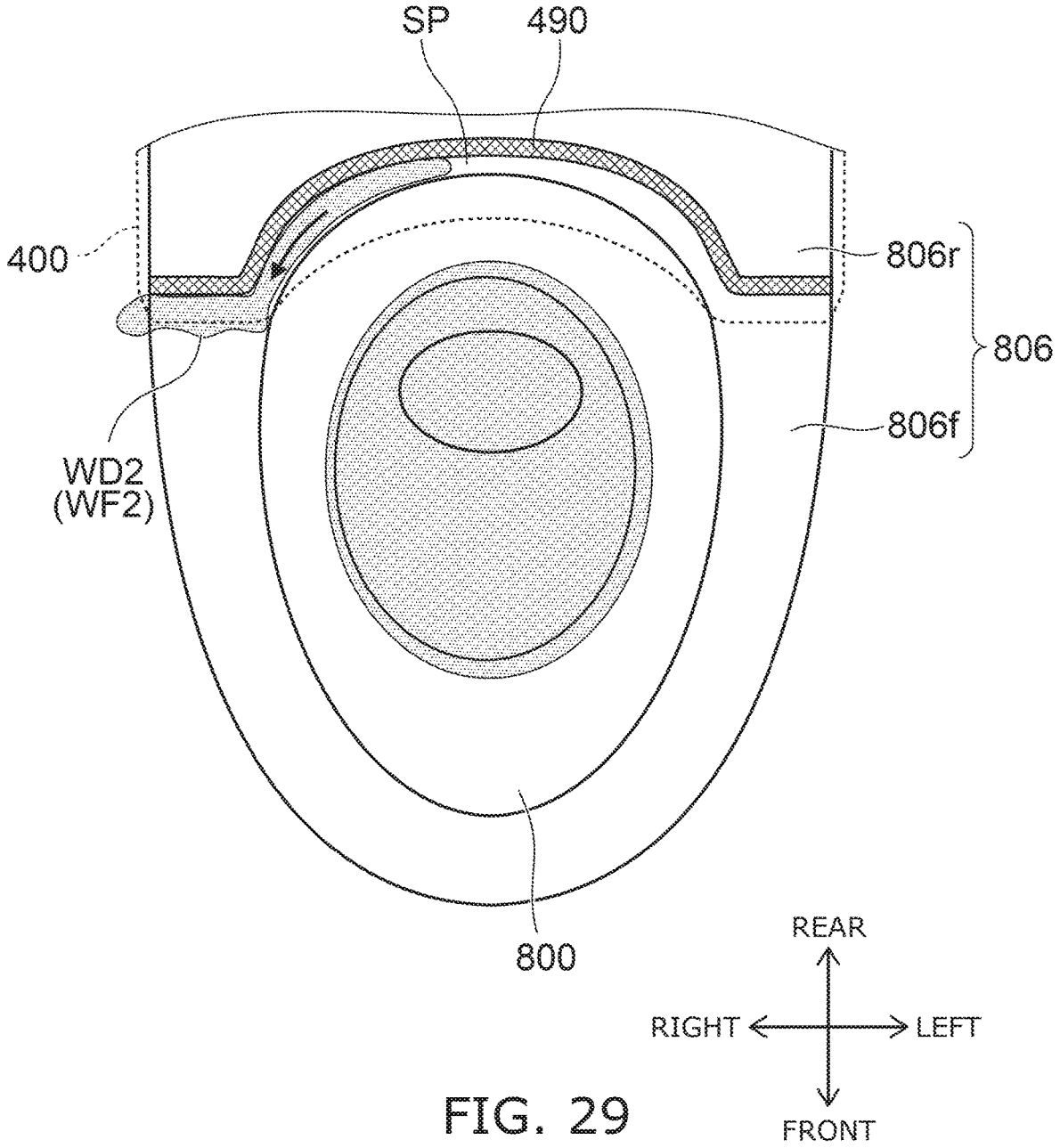
FIG. 29 is a plan view illustrating the toilet device according to the embodiment.

FIG. 29 is a plan view illustrating the toilet device according to the embodiment.

In FIG. 29, the flush toilet 800 is illustrated by solid lines. Also, the casing 400 of the toilet seat device 100 placed on the upper surface, i.e., the rim upper surface 806, of the flush toilet 800 is illustrated by a broken line.

The casing 400 (the main body portion) of the toilet seat device 100 is placed on the rear part of the rim upper surface 806. In other words, the rim upper surface 806 includes a non-placement part 806*f* where the casing 400 is not placed, and a placement part 806*r* where the casing 400 is placed. The placement part 806*r* is positioned rearward of the non-placement part 806*f*. The placement part 806*r* refers to a part of the rim upper surface 806 overlapping the casing 400 in the vertical direction; and the placement part 806*r* may not contact the casing 400.

Packing 490 is provided between the casing 400 and the placement part 806*r* of the rim upper surface 806. The packing 490 is disposed at the front part of the placement part 806*r* to match the configuration of the casing 400. Thereby, the flushing water, the mist, the excrement, etc., can be prevented from entering the rearward side of the packing 490.

A gap SP occurs between the placement part 806*r* and the casing 400 on the front side of the packing 490. For example, in the after-mist mode or the manual mist mode, the mist of the sterilizing water may enter the gap SP when the mist of the sterilizing water is sprayed not only into the bowl 801 but also onto the rim upper surface 806. Because the gap SP is a part not easily visible to the user, the mist that enters the gap SP and wets the placement part 806*r* may unknowingly become large water droplets WD2 or a water film WF2; and water leakage that drips outside the flush toilet 800 may occur.

Therefore, in the after-mist mode or the manual mist mode, the spray device 481 sprays the sterilizing water to cause the average wetting amount per unit area of the sterilizing water wetting the non-placement part 806*f* to be more than the average wetting amount per unit area of the sterilizing water wetting the placement part 806*r*. It is desirable for the spray device 481 to cause the sterilizing water to wet the non-placement part 806*f* but not to cause the sterilizing water to wet the placement part 806*r*.

The occurrence of bacteria and/or dirt at the non-placement part 806*f* can be suppressed by causing much of the sterilizing water to wet the non-placement part 806*f* compared to the placement part 806*r*. Because air does not become stationary easily at the non-placement part 806*f* compared to the placement part 806*r*, the non-placement part 806*f* is a section that dries easily and is a section that the user can easily view and wipe. Therefore, even when the sterilizing water wets the non-placement part 806*f* of the rim upper surface 806, the likelihood is low that the sterilizing water at the non-placement part 806*f* may unknowingly coalesce, become large water droplets or a water film, and drip outside the flush toilet 800. Also, because the amount of the sterilizing water wetting the placement part 806*r* is relatively small, the sterilizing water at the placement part 806*r* can be suppressed from unknowingly coalescing, becoming large water droplets or a water film, and dripping outside the flush toilet 800. Accordingly, the water leakage outside the flush toilet 800 can be suppressed when the mist of the sterilizing water is sprayed onto the rim upper surface 806 of the flush toilet 800.

The average wetting amount per unit area can be measured as follows.

First, the mist that wets the non-placement part 806*f* is wiped using a kim towel after executing the after-mist mode or the manual mist mode. The average wetting amount per unit area of the sterilizing water wetting the non-placement part 806*f* is calculated by dividing the difference between the weight of the kim towel before wiping the mist and the weight after wiping the mist by the surface area of the wiped non-placement part 806*f*. Similarly, the mist that wets the placement part 806*r* on the front side of the packing 490 is wiped using a kim towel after executing the after-mist mode or the manual mist mode. The average wetting amount per unit area of the sterilizing water wetting the placement part 806*r* is calculated by dividing the difference between the weight of the kim towel before wiping the mist and the weight after wiping the mist by the surface area of the wiped placement part 806*r*.

Figure 30:
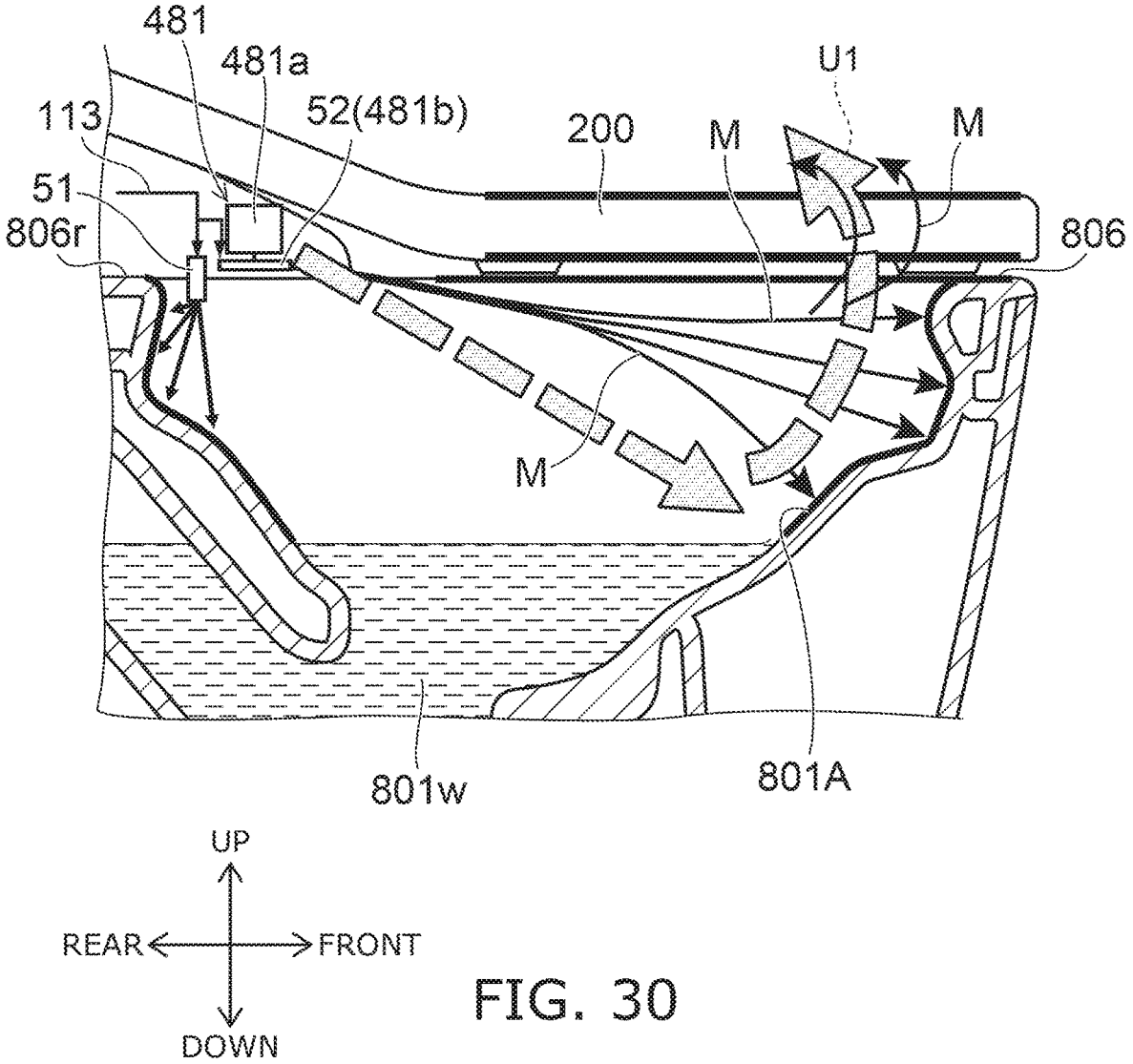
FIG. 30 is a cross-sectional view illustrating operations in the after-mist mode or the manual mist mode of the toilet seat device according to the embodiment.

FIG. 30 is a cross-sectional view illustrating operations in the after-mist mode or the manual mist mode of the toilet seat device according to the embodiment.

Figure 31A:
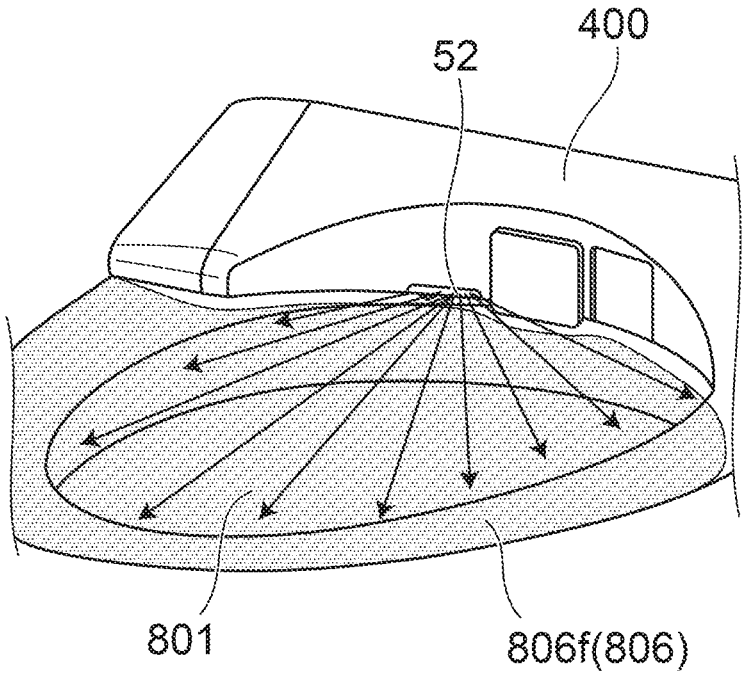
FIG. 31A and FIG. 31B are perspective views illustrating the operations in the after-mist mode or the manual mist mode of the toilet seat device according to the embodiment.
Figure 31B:
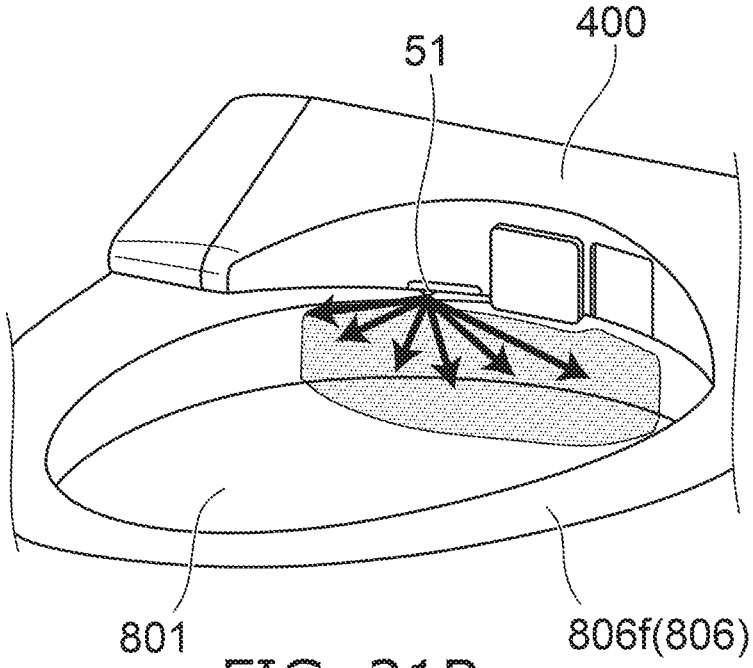

FIG. 31A and FIG. 31B are perspective views illustrating the operations in the after-mist mode or the manual mist mode of the toilet seat device according to the embodiment.

In the example, the spray device 481 includes a first discharger 51 and a second discharger 52. The first discharger 51 includes, for example, a nozzle that can squirt (spray) the service water or the sterilizing water. The second discharger 52 includes, for example, the disk 481*b* described above.

The flow channel 113 that guides the water to the spray device 481 branches into a flow channel supplying water to the first discharger 51 and a flow channel supplying water to the second discharger 52. The water supply to each discharger is controlled by the controller 405. For example, the first discharger 51 and the second discharger 52 simultaneously squirt (spray) the sterilizing water.

FIG. 31A illustrates the operation of the second discharger 52 in the after-mist mode or the manual mist mode. The second discharger 52 causes the sterilizing water to wet the non-placement part 806*f* of the rim upper surface 806. The second discharger 52 also causes the sterilizing water to wet the front side of the second discharger 52 inside the bowl 801.

For example, the second discharger 52 sprays the mist of the sterilizing water frontward and downward. A part of the sprayed mist floats on the rising air stream U1 formed by the blower 513 and is lifted higher than the rim upper surface 806. Thereby, the mist of the sterilizing water wets the non-placement part 806*f*, the toilet seat 200, and the toilet lid 300.

FIG. 31B illustrates the operation of the first discharger 51 in the after-mist mode or the manual mist mode. The first discharger 51 squirts (sprays) the sterilizing water rearward and downward and causes the sterilizing water to wet the rearward side (the placement part 806*r* side) of the first discharger 51 inside the bowl 801.

The spray device 481 is provided in the interior of the casing 400 or below the casing 400. Also, the sterilizing water that is sprayed from the spray device 481 falls gradually by its own weight. Therefore, to cause the sterilizing water to wet the non-placement part 806*f*, it is desirable for the sterilizing water to be sprayed from a high position. Therefore, as shown in FIG. 30, the second discharger 52 is disposed higher than the first discharger 51 (the nozzle water discharge port). Thereby, the sterilizing water can be caused to wet the non-placement part 806*f* more reliably. On the other hand, to suppress the sterilizing water wetting the placement part 806*r*, it is desirable for the sterilizing water to be squirted (sprayed) from a low position. Because the first discharger 51 (the nozzle water discharge port) is disposed lower than the second discharger 52, the sterilizing water that wets the placement part 806*r* can be suppressed further.

It is desirable for the second discharger 52 to be clean because the second discharger 52 causes the sterilizing water to wet the non-placement part 806*f* of the rim upper surface 806 which the user may contact. Therefore, the second discharger 52 is disposed in the interior of the casing 400. Also, the second discharger 52 (the disk 481*b*) is positioned higher than the rim upper surface 806. Thereby, the excrement can be prevented from clinging to the second discharger 52; and the cleanliness of the second discharger 52 can be ensured.

On the other hand, compared to the second discharger 52, the cleanliness of the first discharger 51 does not easily become a problem because the first discharger 51 causes the sterilizing water to wet the placement part 806*r* side inside the bowl 801 where the likelihood of contact by the user is low. Therefore, the first discharger 51 is disposed to protrude below the casing 400. For example, the first discharger 51 (the nozzle water discharge port) is positioned lower than the rim upper surface 806. Thereby, the first discharger 51 can be disposed at a low position; and the sterilizing water that wets the placement part 806*r* can be suppressed further.

The spray device 481 (the second discharger 52) forms at least a part of the sterilizing water sprayed toward the placement part 806*r* side (the rearward side) of the spray device 481 when viewed in the top view to have a size that does not float on the rising air stream U1. On the other hand, the spray device 481 (the first discharger 51) forms at least a part of the sterilizing water sprayed toward the non-placement part 806*f* side (the front side) of the spray device 481 when viewed in the top view to have a size that floats on the rising air stream U1.

Specifically, the spray device 481 causes the sterilizing water sprayed toward the placement part 806*r* side of the spray device 481 when viewed in the top view to have a shower-like form, a film configuration, or a mist-like form having a first particle size. Also, the spray device 481 causes the sterilizing water sprayed toward the non-placement part 806*f* side of the spray device 481 when viewed in the top view to have a mist-like form having a second particle size that is smaller than the first particle size.

Thereby, the sterilizing water that is sprayed from the spray device 481 toward the non-placement part 806*f* side can float on the rising air stream more easily than does the sterilizing water sprayed toward the placement part 806*r* side; and much of the sterilizing water can be caused to wet the non-placement part 806*f*. Conversely the sterilizing water that is sprayed from the spray device 481 toward the placement part 806*r* side floats on the rising air stream less easily than does the sterilizing water sprayed toward the non-placement part 806*f* side; and the sterilizing water that wets the placement part 806*r* can be suppressed.

The average value or the median value of the particle size distribution of the mist can be used to compare the magnitudes of the first particle size and the second particle size. The shower-like form and the film configuration are configurations in which the water has a fine particle larger than the fine particle of the mist. The weight of the sterilizing water in the shower-like form and the film configuration is larger than the weight of the particle of the mist having the first particle size. The sterilizing water that has the shower-like form may have a string-like form or a large-particle form. The configuration and/or the size of the sterilizing water sprayed toward the placement part 806*r* side can be adjusted by using, for example, the configuration of the water discharge port of the first discharger 51, etc.

The case where two dischargers are provided is described in FIG. 30 and FIGS. 31A and 31B. However, the number of dischargers may be one, three, or more. By appropriately changing the spray direction, the spraying area, the particle size of the mist, etc., the sterilizing water that wets the placement part 806*r* can be suppressed while causing much of the sterilizing water to wet the non-placement part 806*f*.

Figure 32:
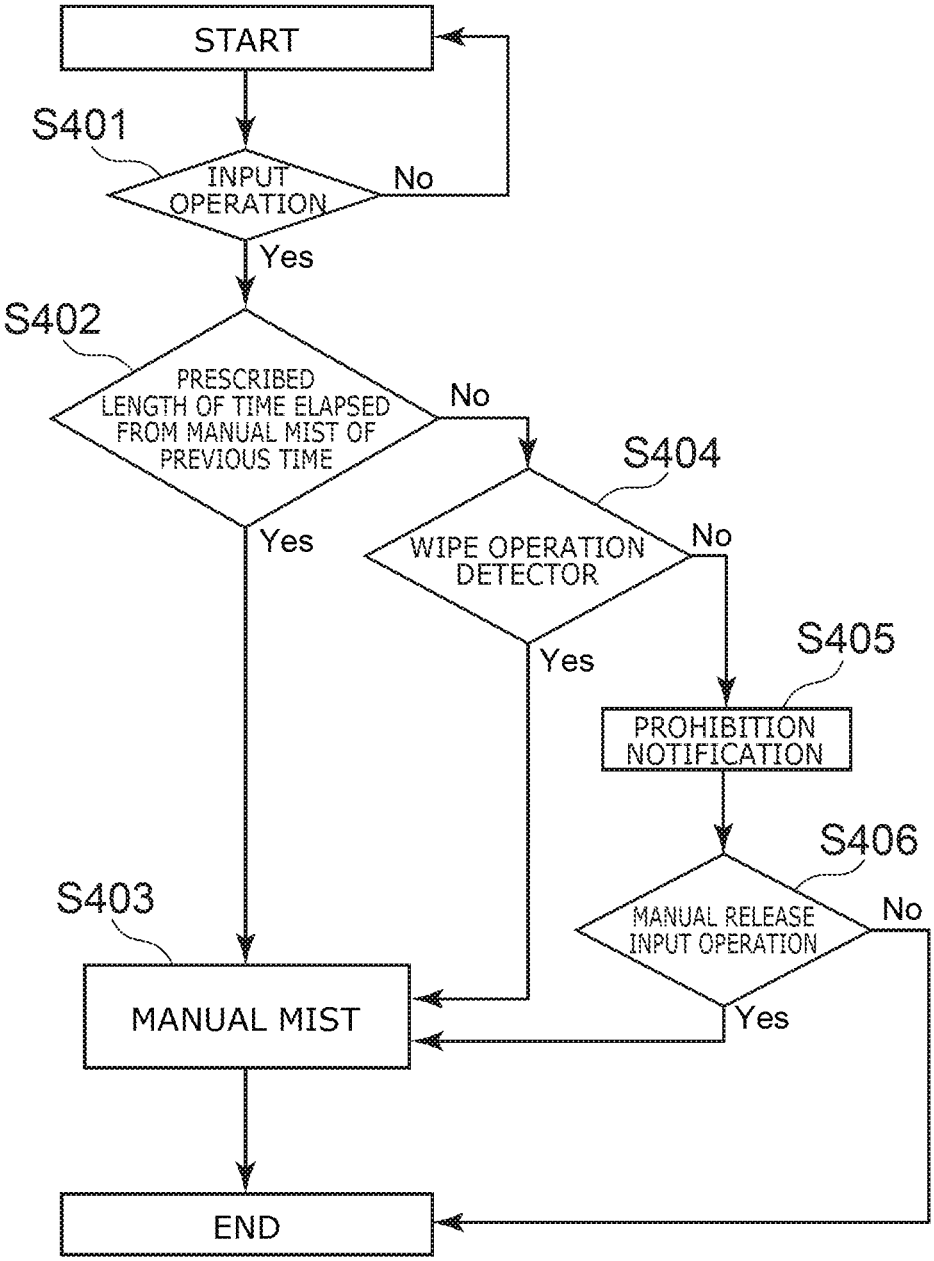
FIG. 32 is a flowchart illustrating operations in the manual mist mode of the toilet seat device according to the embodiment.

FIG. 32 is a flowchart illustrating operations in the manual mist mode of the toilet seat device according to the embodiment.

When the user operates the manual operation part 500, the controller 405 executes the manual mist mode based on the operation information of the manual operation part 500. Here, there is an undesirable risk that the toilet seat 200 may become excessively wet in the case where the operation of the manual operation part 500 is performed consecutively in a short length of time and the manual mist mode is executed consecutively in a short length of time. As a result, there is an undesirable risk that the user that contacts the mist wetting the toilet seat 200 may feel discomfort and/or the wetting mist may drip outside the flush toilet 800.

Therefore, in the example shown in FIG. 32, the controller 405 includes a consecutive manual mist prohibit mode. In the case where the manual operation part 500 is again operated within a prescribed length of time after executing the manual mist mode (before a prescribed length of time has elapsed from the end of the manual mist mode), the consecutive manual mist prohibit mode prohibits the execution of the manual mist mode again until the prescribed length of time has elapsed from the end of the manual mist mode. Also, even in the case where the manual operation part 500 is operated again when executing the manual mist mode, the consecutive manual mist prohibit mode prohibits the execution of the manual mist mode again until the prescribed length of time has elapsed from the end of the manual mist mode.

For example, as shown in FIG. 32, when the user operates the manual operation part 500 and inputs the start of the manual mist mode (step S401: Yes), the controller 405 determines whether or not a prescribed length of time has elapsed from the end of the manual mist mode of the previous time (step S402). In the case where the prescribed length of time has elapsed (step S402: Yes), the controller 405 executes the manual mist mode (step S403). On the other hand, in the case where the manual mist mode is being executed or the prescribed length of time has not elapsed from the end of the manual mist mode of the previous time (step S402: No) and a wipe operation described below is not detected (step S404: No), the controller 405 executes the consecutive manual mist prohibit mode. In other words, the manual mist mode is not executed Thus, the manual mist mode is not executed again due to the consecutive manual mist prohibit mode even when the manual operation part 500 is operated when executing the manual mist mode or within the prescribed length of time after executing the manual mist mode. Thereby, too much of the mist wetting the toilet seat 200 can be suppressed even in the case where the manual operation of spraying the mist is performed consecutively in a short length of time. The discomfort felt by the user due to much of the mist wetting the toilet seat 200 can be suppressed; and the dripping outside the flush toilet 800 of the mist wetting the toilet seat 200 can be suppressed.

For example, the prescribed length of time in step S402 is set to a time such that the wetting mist does not drip outside the flush toilet 800 even in the case where the manual mist mode is executed again and the mist further wets the toilet seat 200. The prescribed length of time is appropriately determined according to the amount of the mist sprayed in the manual mist mode and is, for example, not less than 10 seconds and not more than 5 minutes. The prescribed length of time may be the time for the mist wetting the toilet seat 200 in the manual mist mode of the previous time to evaporate.

The user can remove the bacteria and/or the dirt clinging to the toilet seat 200 by wiping the mist wetting the toilet seat 200 due to the manual mist mode by using toilet paper, etc. In the case where dirt still remains on the toilet seat 200 after the user has wiped substantially all of the mist wetting the toilet seat 200, the user may desire to wipe the remaining dirt by executing the manual mist mode again. In such a case, it is inconvenient for the user to wait for the prescribed length of time Therefore, the controller 405 includes a manual mist release mode in which the execution of the consecutive manual mist prohibit mode before the prescribed length of time has elapsed from the end of the manual mist mode can be released and the manual mist mode can be executed again. Thereby, it is possible to execute the manual mist mode again even though the prescribed length of time has not elapsed from the manual mist mode of the previous time; and the ease of use can be improved.

The toilet seat device 100 includes a wipe operation detector that detects the user performing a wipe operation of the toilet seat 200. The controller 405 executes the manual mist release mode based on detection information of the wipe operation detector.

As shown in FIG. 32, in the case where the wipe operation detector detects that the user performs the wipe operation (step S404: Yes), the manual mist release mode is executed. In other words, it is possible to execute the manual mist mode again; and the manual mist mode is executed (step S403).

For example, the seat contact detection sensor 404 can be used as the wipe operation detector. The controller 405 estimates the existence or absence of the wipe operation based on the detection information of the seat contact detection sensor 404. By utilizing the seat contact detection sensor 404, the wipe operation of the toilet seat by the user can be detected more reliably. For example, in the case where the seat contact detection sensor 404 is a sensor that can detect a load applied to the toilet seat 200, the wipe operation of the user can be detected based on the size of the load applied to the toilet seat 200 and/or the time that the load is applied to the toilet seat 200. For example, in the case where the seat contact detection sensor 404 is a sensor that can acquire the distance to the human body, the wipe operation of the user can be detected based on the change of the distance.

In the case where the user operates the manual operation part 500 to execute the manual mist mode but the manual mist mode is not executed and the mist is not sprayed due to the consecutive manual mist prohibit mode, there is a risk that the user may erroneously recognize the toilet seat device 100 to be malfunctioning. Therefore, in the case where the wipe operation of the user is not detected (step S404: No), the controller 405 uses a notifier to notify that the consecutive manual mist prohibit mode is executed (step S405). Thereby, the misrecognition by the user can be prevented. Any method that can perform the notification such as sound, light, etc., can be used as the notifier. For example, a speaker, an LED, a liquid crystal display, etc., can be provided appropriately in the manual operation part 500 and/or the casing 400 as the notifier.

Further, the toilet seat device 100 includes an operation part (e.g., the manual operation part 500) for the user to input that the wipe operation of the toilet seat 200 is performed. The controller 405 executes the manual mist release mode based on the input information input to the operation part. For example, when the user operates a switch or the like of the manual operation part 500, the input information (the signal) is transmitted to the controller 405; and the controller 405 executes the manual mist release mode when receiving the input information (step S406: Yes). Thereby, it is possible to execute the manual mist mode again; and the manual mist mode is executed (step S403). By utilizing such an operation part, the wipe operation of the toilet seat 200 by the user can be detected more reliably; and the ease of use can be improved. The user may operate the operation part as necessary even without performing the wipe operation.

In the case where the user has not operated the operation part inputting that the wipe operation of the toilet seat 200 is performed (step S406: No), the state in which the execution of the manual mist mode is prohibited is maintained until a prescribed length of time has elapsed from the end of the manual mist mode.

Figure 33:
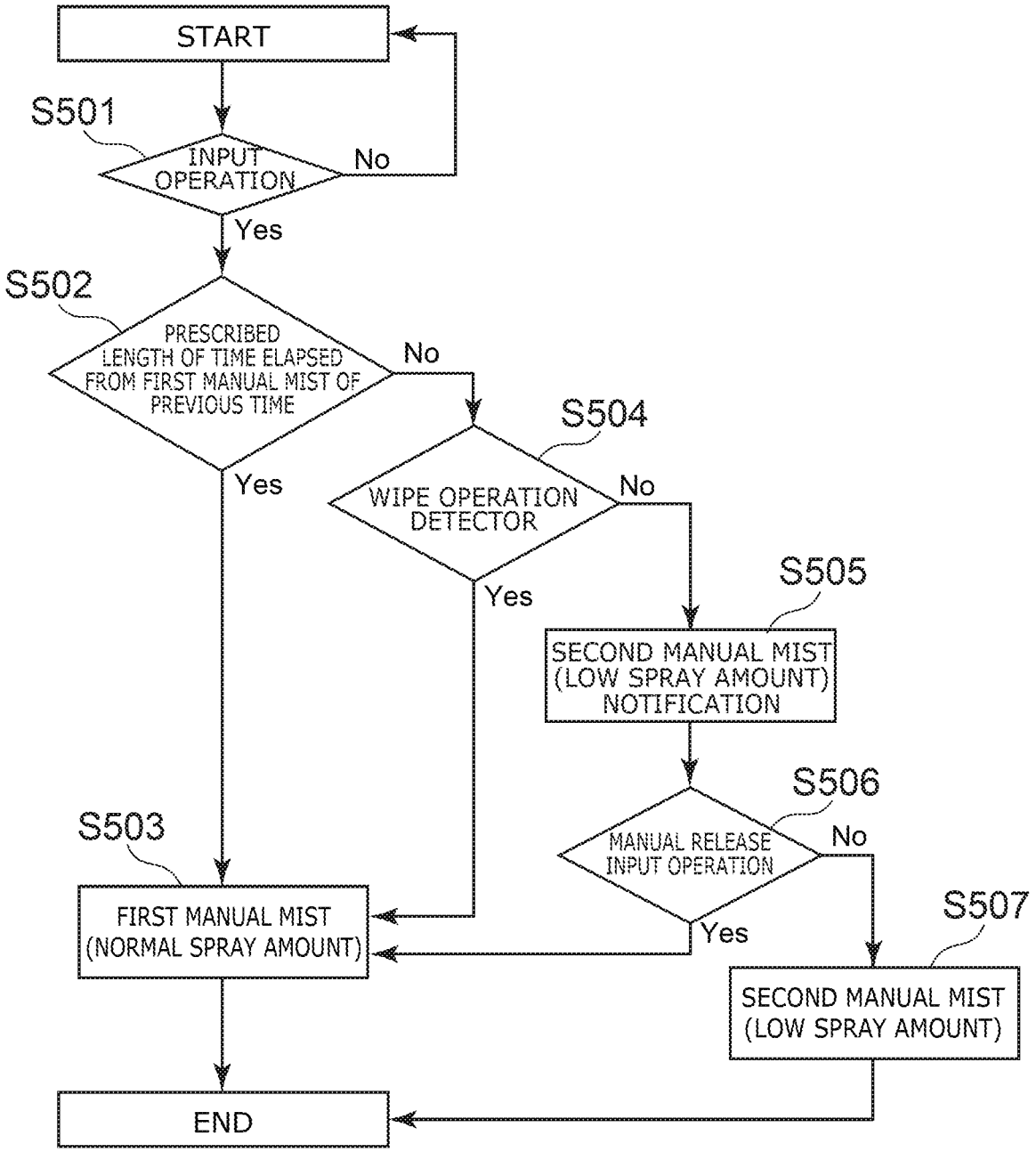
FIG. 33 is a flowchart illustrating another operation in the manual mist mode of the toilet seat device according to the embodiment.

FIG. 33 is a flowchart illustrating another operation in the manual mist mode of the toilet seat device according to the embodiment.

In the example shown in FIG. 33, the controller 405 includes the two types of manual mist modes of a first manual mist mode and a second manual mist mode. The total amount of the mist of the sterilizing water sprayed in the second manual mist mode is less than the total amount of the mist of the sterilizing water sprayed in the first manual mist mode. For example, the spray time in the second manual mist mode is shorter than the spray time in the first manual mist mode.

The first manual mist mode is an operation mode in which the spray device 481 is controlled to spray the mist of the sterilizing water onto the toilet seat 200 when the user operates the manual operation part 500.

On the other hand, the second manual mist mode controls the spray device 481 to spray the mist of the sterilizing water onto the toilet seat 200 in the case where the manual operation part 500 is operated again within a prescribed length of time after executing the first manual mist mode (before a prescribed length of time has elapsed from the end of the first manual mist mode). Also, the second manual mist mode controls the spray device 481 to spray the mist of the sterilizing water onto the toilet seat 200 even in the case where the manual operation part 500 is operated again when executing the first manual mist mode.

In other words, the execution of the first manual mist mode again is prohibited until the prescribed length of time has elapsed from the end of the first manual mist mode; and the second manual mist mode is executed instead.

For example, as shown in FIG. 33, when the user operates the manual operation part 500 and inputs the start of the manual mist mode (step S501: Yes), the controller 405 determines whether or not a prescribed length of time has elapsed from the end of the first manual mist mode of the previous time (step S502). In the case where the prescribed length of time has elapsed (step S502: Yes), the controller 405 executes the first manual mist mode (step S503). On the other hand, in the case where the first manual mist mode is being executed or the prescribed length of time has not elapsed from the end of the first manual mist mode of the previous time (step S502: No) and the wipe operation is not detected (step S504: No), the controller 405 executes the second manual mist mode.

Thus, in the case where the manual operation part 500 is operated while the first manual mist mode is being executed or within a prescribed length of time after executing the first manual mist mode, the second manual mist mode in which the spray amount of the mist is low compared to that of the first manual mist mode is executed. Thereby, too much of the mist wetting the toilet seat 200 can be suppressed even in the case where the manual operation of spraying the mist is performed consecutively. The discomfort felt by the user due to much of the mist wetting the toilet seat 200 can be suppressed; and the dripping outside the flush toilet 800 of the mist wetting the toilet seat 200 can be suppressed.

For example, the prescribed length of time in step S502 is set to a time such that the wetting mist does not drip outside the flush toilet 800 even in the case where the first manual mist mode is executed again and the mist further wets the toilet seat 200. The prescribed length of time is appropriately determined according to the amount of the sprayed mist and is, for example, not less than 10 seconds and not more than 5 minutes. The prescribed length of time may be the time for the mist wetting the toilet seat 200 in the first manual mist mode of the previous time to evaporate.

If the spray amount of the mist due to the second manual mist mode is low and the dirt is difficult to wipe, it may be inconvenient for the user who desires to further wipe the dirt remaining on the toilet seat 200 after executing the first manual mist mode.

Therefore, the controller 405 includes the manual mist release mode in which the first manual mist mode can be executed again before the prescribed length of time has elapsed from the end of the first manual mist mode. Thereby, it is possible to execute the first manual mist mode again even though the prescribed length of time has not elapsed from the first manual mist mode of the previous time; and the ease of use can be improved.

As shown in FIG. 33, in the case where the user is detected by the wipe operation detector to perform the wipe operation (step S504: Yes), the manual mist release mode is executed. In other words, it is possible to execute the first manual mist mode again; and the first manual mist mode is executed (step S503).

In the case where the user operates the manual operation part 500 but the spray amount of the mist is low because the second manual mist mode is executed without executing the first manual mist mode, there is a risk that the user may erroneously recognize the toilet seat device 100 to be malfunctioning. Therefore, in the case where the wipe operation of the user is not detected (step S504: No), the controller 405 uses the notifier to notify that the second manual mist mode is executed (step S505). Thereby, the misrecognition by the user can be prevented.

In the case where the user operates the operation part inputting that the wipe operation of the toilet seat 200 is performed, the input information (the signal) is transmitted to the controller 405; and the controller 405 executes the manual mist release mode when receiving the input information (step S506: Yes). Thereby, it is possible to execute the first manual mist mode again; and the first manual mist mode is executed (step S503).

In the case where the user does not operate the operation inputting that the wipe operation of the toilet seat 200 is performed (step S506: No), the second manual mist mode is executed (step S507).

Figure 34A:
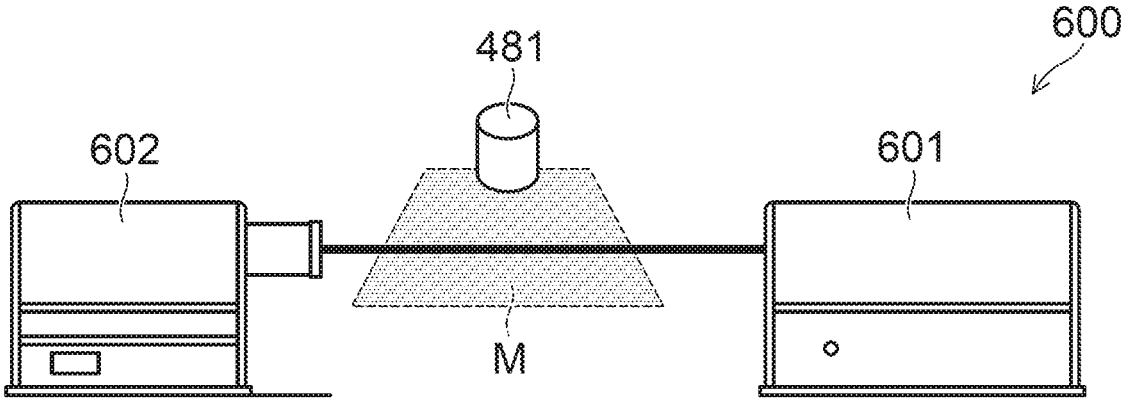
FIG. 34A and FIG. 34B are perspective views illustrating a method for measuring the particle size according to the embodiment.
Figure 34B:
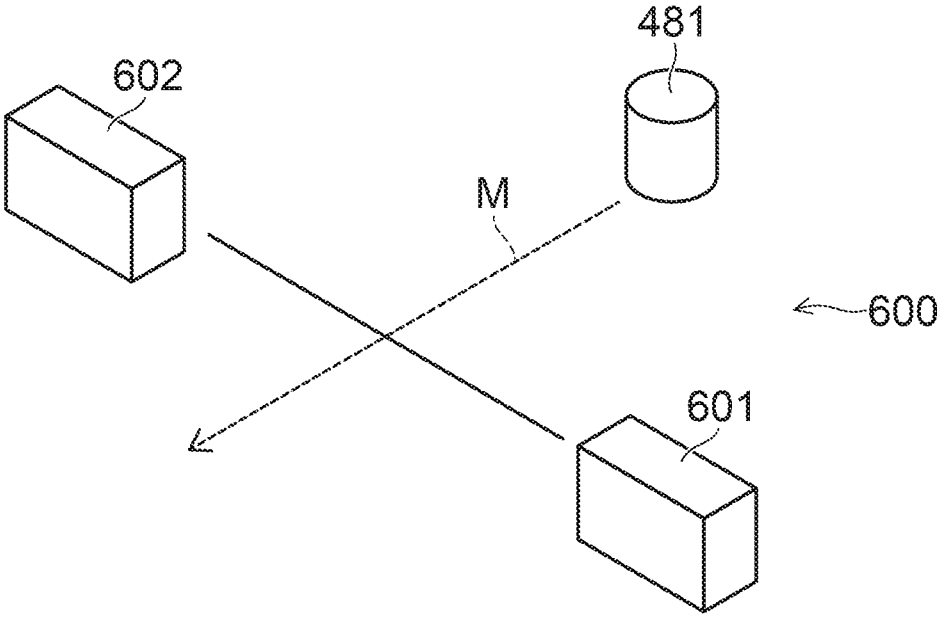

FIG. 34A and FIG. 34B are perspective views illustrating a method for measuring the particle size according to the embodiment.

Laser diffraction is used to measure the particle size. When a laser is irradiated on fine particles, diffraction-scattered light is generated in various directions from the fine particles. The intensity of the diffraction-scattered light has a spatial pattern in the direction in which the light is emitted. The spatial pattern is called a light intensity distribution pattern. The light intensity distribution pattern changes according to the particle size of the fine particle.

The particle size can be calculated by detecting the light intensity distribution pattern by utilizing the correlation between the particle size of the fine particle and the light intensity distribution pattern.

As shown in FIG. 34A and FIG. 34B, a measurement device 600 of the particle size includes a light emitter 601 and a light receiver 602. The light receiver 602 is provided so that the light receiver 602 can receive the laser emitted by the light emitter 601. In the measurement of the particle size, the laser that is emitted by the light emitter 601 is irradiated on the mist M sprayed from the spray device 481. The light receiver 602 receives the diffraction-scattered light generated by the irradiation of the laser. Thereby, the light intensity distribution pattern can be detected. The Aerotrac LDSA-3500A (made by the MicrotracBEL Corporation) can be used as the measurement device.

FIG. 35 is a block diagram illustrating relevant components of a toilet device according to a modification of the embodiment.

FIG. 35 illustrates the relevant components of both the water channel system and the electrical system.

In the example as illustrated in FIG. 35, the solenoid valve 431, the sterilizer 450, the switch valve 472, the spray device 481, the nozzle motor 476, the nozzle 473, the nozzle wash chamber 478, the flow channels 110 to 113, etc., are included in the interior of the flush toilet 800. In the example, the toilet seat motor 511 (the rotating device), the toilet lid motor 512 (the rotating device), the blower 513, the warm air heater 514, etc., also are included in the interior of the flush toilet 800. In the example, the detecting sensor 402 (e.g., the human body detection sensor 403, the seat contact detection sensor 404, etc.) and/or the controller 405 also are included in the interior of the flush toilet 800.

Thus, the members (hereinbelow, called the "functional parts") that are included in the casing 400 interior of the toilet seat device 100 in the example shown in FIG. 4 may be included in the interior of the flush toilet 800. Even in the case where the functional parts are included in the interior of the flush toilet 800, the operations of the spray device 481, etc., can be performed similarly to the case where the functional parts are included in the interior of the casing 400.

The casing 400 of the toilet seat device 100 may be omitted in the case where the functional parts are thus included in the interior of the flush toilet 800. Or, the toilet seat 200 and the toilet lid 300 may be provided instead of the toilet seat device 100. In such a case, for example, the toilet seat 200 and the toilet lid 300 each are pivotally supported openably and closeably with respect to the flush toilet 800. In such a case, for example, the nozzle damper 479, the mist damper 482, and the blower damper 516 also are pivotally supported to be rotatable with respect to the flush toilet 800.

Hereinabove, embodiments of the invention are described. However, the invention is not limited to these descriptions. Appropriate design modifications made by one skilled in the art for the embodiments described above also are within the scope of the invention to the extent that the features of the invention are included. For example, the configurations, the dimensions, the materials, the arrangements, the mounting methods, etc., of the components included in the flush toilet, the toilet seat device, etc., are not limited to those illustrated and can be modified appropriately.

Also, the components included in the embodiments described above can be combined within the limits of technical feasibility; and such combinations are within the scope of the invention to the extent that the features of the invention are included.

What is claimed is:

1. A toilet device, comprising:

a flush toilet including a bowl, a rim upper surface, and a water discharge port, the bowl receiving excrement, the rim upper surface being positioned on the bowl, the water discharge port discharging flushing water into the bowl to discharge the excrement from the bowl, the bowl including a flush region and a non-flush region, the flush region being where the flushing water passes, the non-flush region being positioned higher than the flush region and lower than the rim upper surface;

a toilet seat mounted on the flush toilet, the toilet seat being where a user is seated;

a spray device spraying a mist;

a detecting sensor detecting the user, the detecting sensor having a detecting state and a non-detecting state, the detecting state being a state in which the detecting sensor detects the user, and the non-detecting state being a state in which the detecting sensor does not detect the user; and a controller controlling the spray device based on the detection information of the detecting sensor, the controller executing a pre-mist mode when the detecting sensor changes from the non-detecting state to the detecting state, the pre-mist mode including automatically controlling the spray device, spraying the mist onto the flush region and the non-flush region, and forming a water droplet or a water film by causing the mist to accumulate in the flush region and the non-flush region, and an after-mist mode when the detecting sensor changes from the detecting state to the non-detecting state, the after-mist mode including automatically controlling the spray device to rinse away the water droplet or the water film formed in the non-flush region in the pre-mist mode by increasing a volume of the water droplet or the water film.

2. A toilet seat device mounted on a flush toilet, the flush toilet including a bowl, a rim upper surface, and a water discharge port, the bowl receiving excrement, the rim upper surface being positioned on the bowl, the water discharge port discharging flushing water into the bowl to discharge the excrement from the bowl, the bowl including a flush region and a non-flush region, the flush region being where the flushing water passes, the non-flush region being positioned higher than the flush region and lower than the rim upper surface, the toilet seat device comprising:

a toilet seat where a user is seated;

a spray device spraying a mist;

a detecting sensor detecting the user, the detecting sensor having a detecting state and a non-detecting state, the detecting state being a state in which the detecting sensor detects the user, and the non-detecting state being a state in which the detecting sensor does not detect the user; and a controller controlling the spray device based on the detection information of the detecting sensor, the controller executing a pre-mist mode when the detecting sensor changes from the non-detecting state to the detecting state, the pre-mist mode including automatically controlling the spray device, spraying the mist onto the flush region and the non-flush region, and forming a water droplet or a water film by causing the mist to accumulate in the flush region and the non-flush region, and an after-mist mode when the detecting sensor changes from the detecting state to the non-detecting state, the after-mist mode including automatically controlling the spray device to rinse away the water droplet or the water film formed in the non-flush region in the pre-mist mode by increasing a volume of the water droplet or the water film.

3. A toilet device, comprising:

a flush toilet including a bowl, a rim upper surface, and a water discharge port, the bowl receiving excrement, the rim upper surface being positioned on the bowl, the water discharge port discharging flushing water into the bowl to discharge the excrement from the bowl, the bowl including a flush region and a non-flush region, the flush region being where the flushing water passes, the non-flush region being positioned higher than the flush region and lower than the rim upper surface;

a toilet seat mounted on the flush toilet, the toilet seat being where a user is seated;

a spray device spraying a mist;

a detecting sensor detecting the user, the detecting sensor having a detecting state and a non-detecting state, the detecting state being a state in which the detecting sensor detects the user, and the non-detecting state being a state in which the detecting sensor does not detect the user; and a controller controlling the spray device based on the detection information of the detecting sensor, the controller executing a pre-mist mode by automatically controlling the spray device to spray the mist when the detecting sensor changes from the non-detecting state to the detecting state, the pre-mist mode including a first process of forming a water droplet or a water film by causing the mist to wet the non-flush region, and a second process of rinsing away the water droplet or the water film formed in the non-flush region in the first process by increasing a volume of the water droplet or the water film.

* * * * *